US005380631A

United States Patent [19]

Nozawa et al.

[11] Patent Number: 5,380,631

[45] Date of Patent: Jan. 10, 1995

[54] SILVER HALIDE COLOR PHOTOGRAPHIC LIGHT-SENSITIVE MATERIAL

[75] Inventors: Yasushi Nozawa; Nobuo Seto; Nobutaka Ohki; Masayoshi Toyoda, all of Minami-ashigara, Japan

[73] Assignee: Fuji Photo Film Co., Ltd., Kanagawa, Japan

[21] Appl. No.: 2,465

[22] Filed: Jan. 8, 1993

[30] Foreign Application Priority Data

Jan. 10, 1992 [JP] Japan ..... 4-022041

[51] Int. Cl.[6] ..... G03C 1/46

[52] U.S. Cl. ..... 430/504; 430/505; 430/551; 430/957

[58] Field of Search ..... 430/551, 372, 957, 505, 430/504, 507, 570

[56] References Cited

U.S. PATENT DOCUMENTS

| | | | |
|---|---|---|---|
| 5,077,182 | 12/1991 | Sasaki et al. | 430/957 |
| 5,104,782 | 4/1992 | Seto et al. | 430/551 |
| 5,200,306 | 4/1993 | Odenwalder et al. | 430/957 |

FOREIGN PATENT DOCUMENTS

| | | |
|---|---|---|
| 0203746 | 12/1986 | European Pat. Off. . |
| 0369491 | 5/1990 | European Pat. Off. . |
| 0456257 | 11/1991 | European Pat. Off. . |
| 1158440 | 6/1989 | Japan . |

OTHER PUBLICATIONS

Patent Abstracts of Japan, vol. 10, No. 232 (P-486)(2288) 12 Aug. 1986 and JP-A-61065234 (Konishiroku) 3 Apr. 1986.

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic light-sensitive material having at least one negative silver halide emulsion layer on a support, wherein the silver halide color photographic light-sensitive material contains at least one type of a compound which reacts with the oxidized form of a developing agent to release a development inhibitor or a precursor of a development inhibitor and/or at least one type of a compound which cleaves after reacting with the oxidized form of a color developing agent, the cleaved compound of which in turn reacts with another molecule of the oxidized form of a color developing agent to cleave a development inhibitor, and contains at least one type of a compound selected from Formulas (A) and (B) below. In Formulas (A) and (B), each of $R_{a1}$ to $R_{a5}$ and $R_{b1}$ to $R_{b5}$ represents a hydrogen atom, an alkyl group or other groups. $R_{a1}$ to $R_{a5}$ are not simultaneously hydrogen atoms, and one or two of $R_{b2}$ to $R_{b5}$ are hydroxyl groups.

Formula (A)

Formula (B)

13 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a silver halide color photographic light-sensitive material and, more particularly, to a silver halide color photographic light-sensitive material excellent in color reproduction, sharpness, and graininess and improved in deterioration with time in a latent image after exposure and an increase in fog during storage.

2. Description of the Related Art

In recent years, the image qualities of color light-sensitive materials, such as color reproduction, sharpness, and graininess have been significantly advanced. However, there is no end to requirements for the image qualities of light-sensitive materials, so demands have arisen for further progress.

For example, it is known to those skilled in the art that the color reproduction, sharpness, and graininess of a color negative film can be improved by using development inhibitor releasing couplers (so-called DIR couplers), and this technique already has been put into practical use.

The DIR couplers are described in, e.g., JP-A-57-151944 ("JP-A" means Published Unexamined Japanese Patent Application), JP-A-57-154234, JP-A-60-184248, JP-A-60-37346, and U.S. Pat. No. 4,248,962, all described in RD-17643.

The present inventors intended to achieve further improvements in image qualities by using these DIR coupler techniques and have investigated the effect of increasing the use amount of these couplers or production of functional couplers having larger effects.

It was, however, found that a totally unexpected side effect occurred due to these techniques although the image qualities were surely improved; that is, the stability of a latent image after exposure was degraded significantly in light-sensitive materials in which the effects of the development inhibitor releasing compounds were enhanced. Light-sensitive materials for photography are not always developed immediately after photographed but sometimes developed when several months or a year has elapsed after photographed. Therefore, it is desirable that the performance of light-sensitive materials remain unchanged during these periods of storage. The stability of a latent image after exposure includes two conventionally known factors of latent image fading, in which the sensitivity apparently decreases, and latensification, in which it apparently increases. An example of recent studies is described in "The Journal of Photographic Science" by E. F. Thurston, Vol. 38 (pp. 34 to 40, 1990). Latensification is large in light-sensitive materials in which the effects of development inhibitor releasing compounds are enhanced, so light-sensitive materials in which the development inhibiting effect is enhanced to the intended degrees are difficult to put into practical use.

It is also well known to those skilled in the art that, in order to improve the graininess of a light-sensitive material, sensitivity increasing techniques for decreasing the sizes of silver halide grains are important. Recently, to decrease the grain sizes and increase the sensitivities of silver halide grains, the following techniques have been studied and have achieved remarkable results: the improvements in addition timings of sensitizing dyes (e.g., U.S. Pat. Nos. 4,183,756 and 4,225,666, JP-A-58-7,629, JP-A-59-9,658, JP-A-59-48,756, JP-A-59-113,920, JP-A-1-100,533, and JP-A-1-223,411); the use of tabular grains (e.g., U.S. Pat. Nos. 4,434,226, 4,414,310, 4,433,048, 4,414,306, and 4,459,353); and the improvements in reduction-sensitizing methods (e.g., JP-B-57-33572 ("JP-B" means Published Examined Japanese Patent Application), JP-B-58-1410, JP-A-57-82831, JP-A-57-179835, JP-A-2-136852, and EP 0348934). It was, however, found that any of the improvements in addition timings of sensitizing dyes, the increase in amount of sensitizing dyes obtained by the use of tabular grains, and the rise in sensitivity obtained by reduction sensitization was accompanied by degradation in latensification. In addition, it was surprising that the degree of degradation was abnormally large in the abovementioned light-sensitive materials in which the effects of development inhibitor releasing compounds were enhanced.

SUMMARY OF THE INVENTION

It is, therefore, an object of the present invention to provide a silver halide color photographic light-sensitive material excellent in color reproduction, sharpness, and graininess and improved in deterioration with time in a latent image after exposure.

The present inventors have made extensive studies and found that the above object of the present invention can be achieved by the following means.

A silver halide color photographic light-sensitive material having at least one negative silver halide emulsion layer on a support, wherein the silver halide color photographic light-sensitive material contains at least one type of a compound which reacts with the oxidized form of a developing agent to release a development inhibitor or a precursor of a development inhibitor and/or at least one type of a compound which cleaves after reacting with the oxidized form of a color developing agent, the cleaved compound of which in turn reacts with another molecule of the oxidized form of a color developing agent to cleave a development inhibitor, and contains at least one type of a compound selected from Formulas (A) and (B) below.

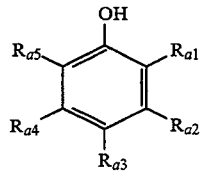

Formula (A)

In Formula (A), $R_{a1}$ to $R_{a5}$ may be identical or different and each represents a hydrogen atom, a group of alkyl, alkenyl, aryl, a heterocyclic ring, alkyloxycarbonyl, aryloxycarbonyl, acyl, sulfonyl, carbamoyl, sulfamoyl, acylamino or sulfonamido, a halogen atom, or —X—$R_{a0}$ wherein —X— represents —O—, —S—, or —N($R_{a6}$)— and $R_{a0}$ represents a group of alkyl, alkenyl, aryl, a heterocyclic ring, acyl, or sulfonyl. $R_{a6}$ represents a hydrogen atom or the group defined for $R_{a0}$. Of the groups represented by $R_{a1}$ to $R_{a5}$, substituents at the ortho positions with each other may combine to form a 5- to 7-membered ring.

Note that the groups represented by $R_{a1}$ to $R_{a5}$ are not simultaneously hydrogen atoms, and if $R_{a3}$ is a halogen atom, —O—$R_{a0}$, or —S—$R_{a0}$, at least one of $R_{a1}$ and $R_{a5}$ is an alkyl group.

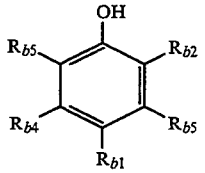

Formula (B)

In Formula (B), $R_{b1}$ represents a hydrogen atom, a group of alkyl, alkenyl, aryl, a heterocyclic ring, alkyloxycarbonyl, aryloxycarbonyl, acyl, sulfonyl, carbamoyl, sulfamoyl or acylamino, a halogen atom, or —X—$R_{b0}$ wherein —X— represents —O—, —S—, or —N($R_{b6}$)— and $R_{b0}$ represents a group of alkyl, alkenyl, aryl, a heterocyclic ring, acyl, or sulfonyl. $R_{b6}$ represents a hydrogen atom or the group defined for $R_{b0}$. $R_{b2}$ to $R_{b5}$ may be identical or different and each represents a hydroxyl group or the group defined for $R_{b1}$. Of the groups represented by $R_{b1}$ to $R_{b5}$, substituents at the ortho positions with each other may combine to form a 5- to 7-membered ring.

Note that the groups represented by $R_{b1}$ to $R_{b5}$ are not simultaneously hydrogen atoms, and one or two of $R_{b2}$ to $R_{b5}$ are hydroxyl groups.

DETAILED DESCRIPTION OF THE INVENTION

The present invention will be described in more detail below.

First, compounds represented by Formulas (A) and (B) of the present invention will be described in detail below.

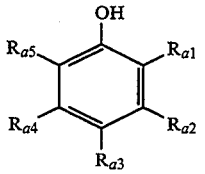

Formula (A)

In Formula (A), $R_{a1}$ to $R_{a5}$ may be identical or different and each represents a hydrogen atom, a group of alkyl, alkenyl, aryl, a heterocyclic ring, alkyloxycarbonyl, aryloxycarbonyl, acyl, sulfonyl, carbamoyl, sulfamoyl, acylamino or sulfonamido, a halogen atom, or —X—$R_{a0}$ wherein —X— represents —O—, —S—, or —N($R_{a6}$)— and $R_{a0}$ represents a group of alkyl, alkenyl, aryl, a heterocyclic ring, acyl, or sulfonyl. $R_{a6}$ represents a hydrogen atom or the group defined for $R_{a0}$. Of the groups represented by $R_{a1}$ to $R_{a5}$, substituents at the ortho positions with each other may combine to form a 5- to 7-membered ring.

Note that the groups represented by $R_{a1}$ to $R_{a5}$ are not simultaneously hydrogen atoms, and if $R_{a3}$ is a halogen atom, —O—$R_{a0}$, or —S—$R_{a0}$, at least one of $R_{a1}$ and $R_{a5}$ is an alkyl group.

A compound represented by Formula (A) will be described in detail below.

The substituents described in the present invention can further have substituents.

In Formula (A), $R_{a1}$ to $R_{a5}$ may be identical or different and each represents a hydrogen atom, an alkyl group (e.g., methyl, t-butyl, t-octyl, cyclohexyl, 2'-hydroxybenzyl, and 4'-hydroxybenzyl, in which a preferable number of carbon atoms is 1 to 30), an alkenyl group (e.g., allyl and vinyl, in which a preferable number of carbon atoms is 2 to 30), an aryl group (e.g., phenyl, 2-hydroxyphenyl, and 4-hydroxyphenyl, preferably phenyl and substituted phenyl having 6 to 30 carbon atoms), a heterocyclic group (e.g., 4-morpholinyl, 1-piperidyl, and 1-pyrrolidinyl, preferably a saturated hetero ring having 4 to 15 carbon atoms), an alkyloxycarbonyl group (e.g., ethoxycarbonyl and hexadecyloxycarbonyl), an aryloxycarbonyl group (e.g., phenoxycarbonyl and 2,4-di-t-butylphenoxycarbonyl), an acyl group (e.g., acetyl, benzoyl, and myristoyl), a sulfonyl group (e.g., methanesulfonyl, benzenesulfonyl, and 2-hydroxybenzenesulfonyl), a carbamoyl group (e.g., dimethylcarbamoyl, methylphenylcarbamoyl, and dodecylcarbamoyl), a sulfamoyl group (e.g., dimethylsulfamoyl and dodecylsulfamoyl), an acylamino group (e.g. acetylamino, myristoylamino and 2,4-di-t-amylphenoxyacetylamino) or a sulfonamido group (e.g. ethanesulfonamido and octanesulfonamido), a halogen atom (e.g., chlorine, bromine, and fluorine), or —X—$R_{a0}$.

—X— represents —O—, —S—, or —N($R_{a6}$)—. $R_{a0}$ represents an alkyl group (e.g., methyl, isopropyl, octyl, benzyl, hexadecyl, methoxyethyl, and cyclohexyl, in which a preferable number of carbon atoms is 1 to 26), an alkenyl group (e.g., allyl and vinyl, in which a preferable number of carbon atoms is 2 to 26), an aryl group (e.g., phenyl, 4-methoxyphenyl, and naphthyl, preferably phenyl or substituted phenyl having 6 to 30 carbon atoms), a heterocyclic group (e.g., 2-tetrahydropyranyl and pyridyl), an acyl group (e.g., acetyl, benzoyl, and tetradecanoyl), or a sulfonyl group (e.g., methanesulfonyl, benzenesulfonyl, and octanesulfonyl). $R_{a6}$ represents a hydrogen atom or the group defined for $R_{a0}$. Of the groups represented by $R_{a1}$ to $R_{a5}$, substituents at the ortho positions with each other may combine to form a 5- to 7-membered ring (e.g., a chroman ring and an indane ring), and this may form a spiro ring or a bicyclo ring.

Note that the groups represented by $R_{a1}$ to $R_{a5}$ are not simultaneously hydrogen atoms, and if $R_{a3}$ is a halogen atom, —O—$R_{a0}$, or —S—$R_{a0}$, at least one of $R_{a1}$ and $R_{a5}$ is an alkyl group.

Of compounds represented by Formula (A), those preferable for the effects of the present invention are enumerated below.

- A compound having a substituent at the position of any of $R_{a1}$, $R_{a3}$, and $R_{a5}$ and a hydrogen atom at the α position of at least one of these substituents.
- A compound in which substituents at the ortho positions with each other of the groups represented by $R_{a1}$ to $R_{a5}$ combine to form a chroman ring, a coumaran ring, or a indane ring.

Of compounds represented by Formula (A), those represented by Formulas (A-I) and (A-II) below are particularly preferable, and those represented by Formula (A-II) are most preferable for the effects of the present invention.

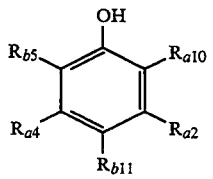

Formula (A-I)

-continued

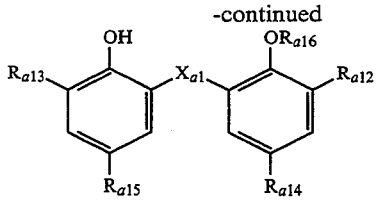

Formula (A-II)

In Formula (A-I), $R_{a10}$ represents alkyl, and $R_{a11}$ represents alkyl, alkoxy, or aryloxy. $R_{a2}$, $R_{a4}$, and $R_{a5}$ represent the groups defined in Formula (A). In a compound represented by Formula (A-I), it is preferable for the effects of the present invention that each of $R_{a2}$, $R_{a4}$, and $R_{a5}$ be a hydrogen atom, alkyl, or alkoxy.

In a compound represented by Formula (A-I), it is also preferable that $R_{a2}$ and $R_{a11}$, $R_{a2}$ and $R_{a10}$, or $R_{a4}$ and $R_{a11}$ combine to form an indane ring, a coumaran ring, or a chroman ring, or a spiro ring or a bicyclo ring of any of these rings.

In Formula (A-II), each of $R_{a12}$ to $R_{a15}$ represents alkyl, $R_{a16}$ represents a hydrogen atom, alkyl, alkenyl, aryl, acyl, or sulfonyl, and $X_{a1}$ represents a single bond, —O—, —S—, or —CH($R_{a17}$)— wherein $R_{a17}$ represents a hydrogen atom, alkyl, or aryl. In a compound represented by Formula (A-II), it is preferable for the effects of the present invention that $R_{a16}$ be a hydrogen atom or $X_{a1}$ be —CH($R_{a17}$)—. In this case, it is particularly preferable that $R_{a17}$ be a hydrogen atom or an alkyl group (in which a preferable number of carbon atoms is 1 to 11).

Practical examples of a compound represented by Formula (A) are presented below, but the present invention is not limited to these examples.

(A-1)

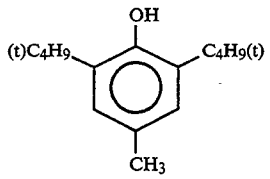

(A-2)

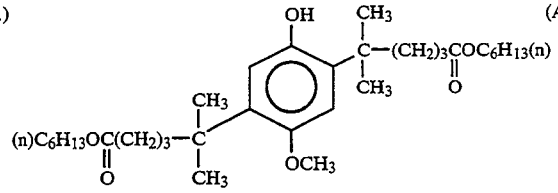

(A-3)

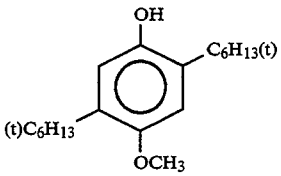

(A-4)

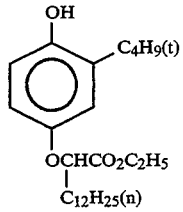

(A-5)

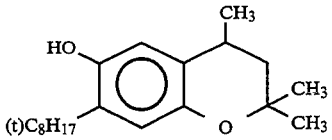

(A-6)

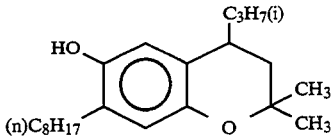

(A-7)

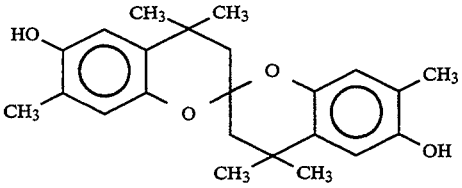

(A-8)

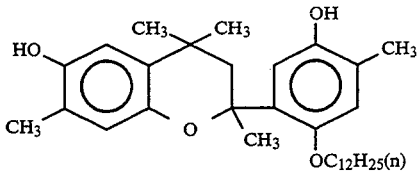

(A-9)

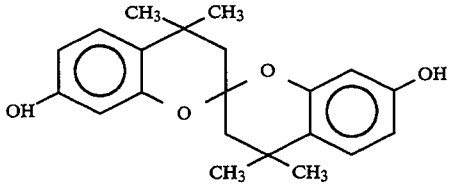

(A-14)

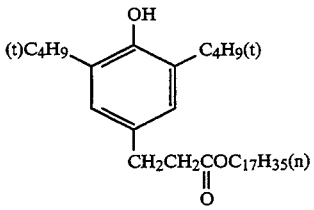

(A-15)

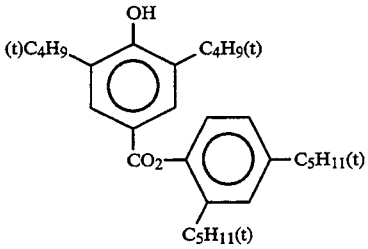

(A-16)

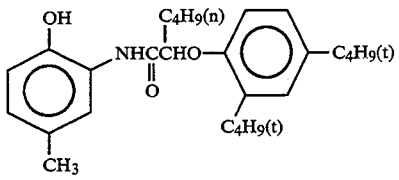

-continued
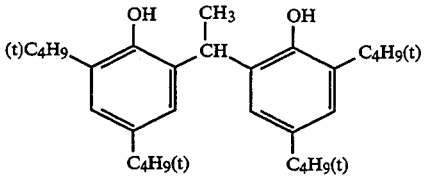
(A-17)
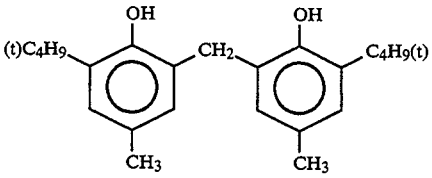
(A-18)
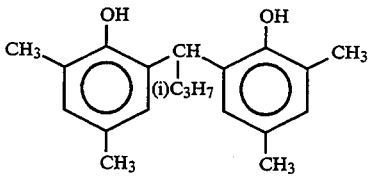
(A-19)
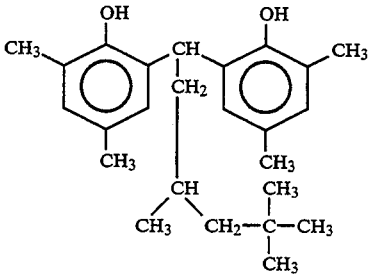
(A-20)
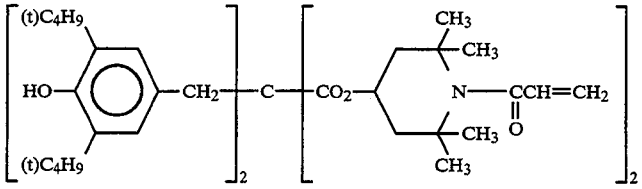
(A-21)
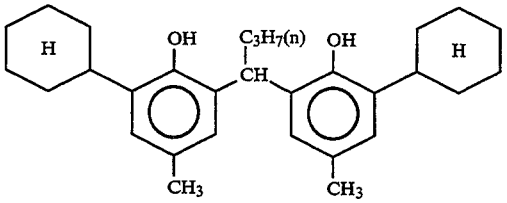
(A-22)
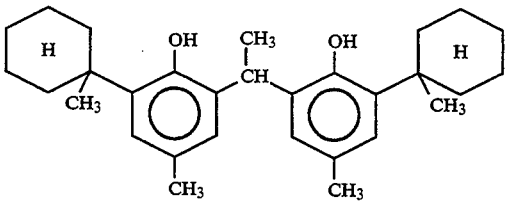
(A-23)
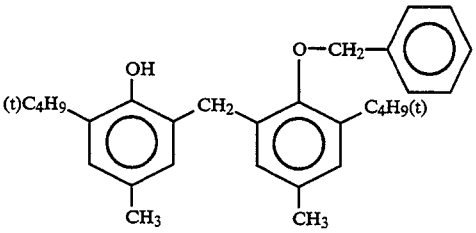
(A-24)
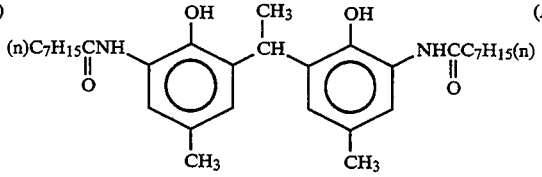
(A-25)
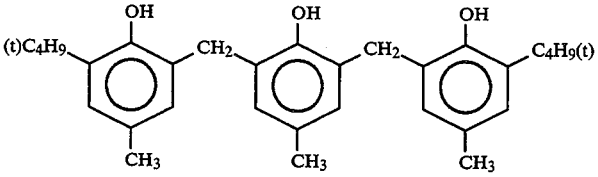
(A-26)
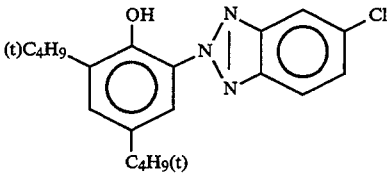
(A-27)
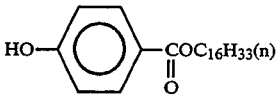
(A-28)

-continued
(A-29)
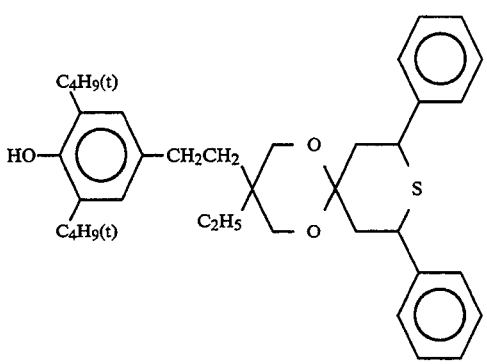
(A-30)
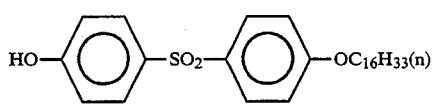
(A-31)
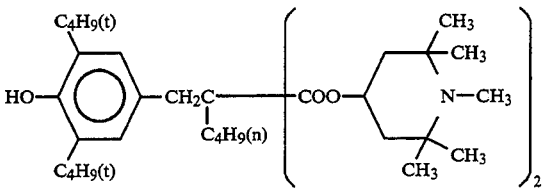
(A-32)
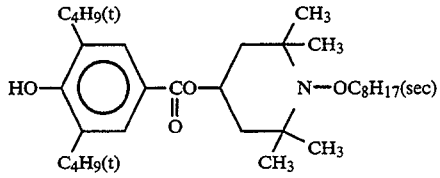
(A-33)
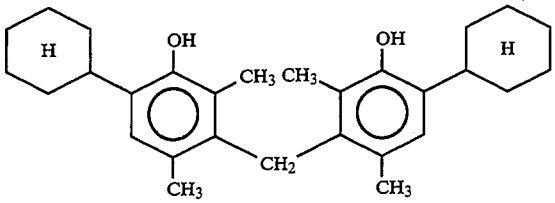
(A-34)
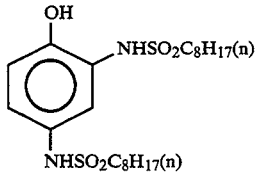
(A-35)
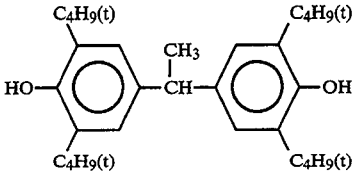
(A-36)
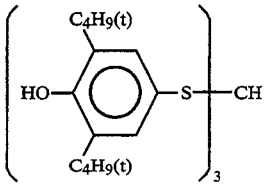
(A-37)
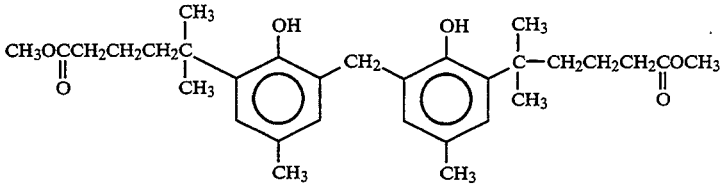
(A-38)
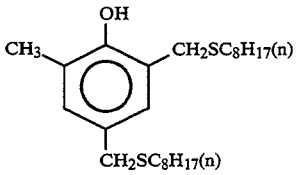
(A-39)
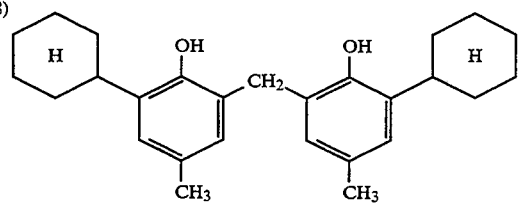
(A-40)
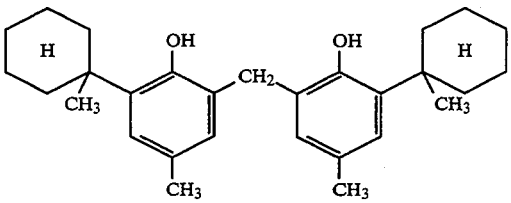
(A-41)
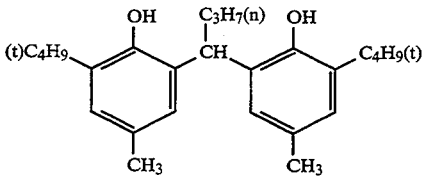

-continued
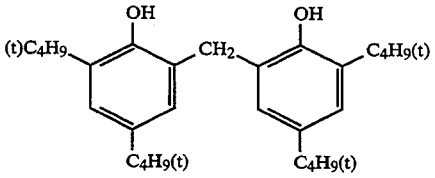
(A-42)
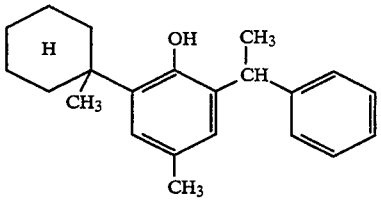
(A-43)
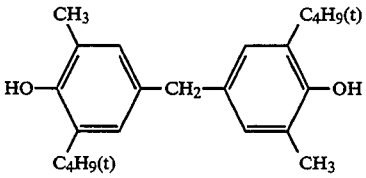
(A-44)
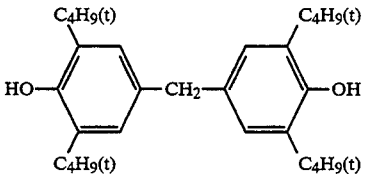
(A-45)
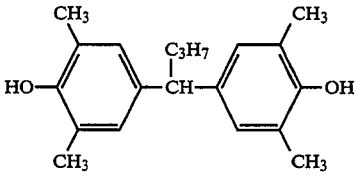
(A-46)
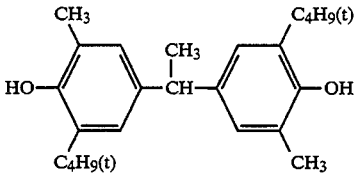
(A-47)
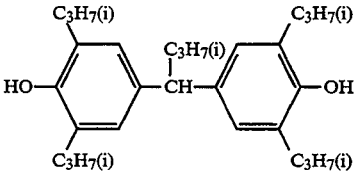
(A-48)
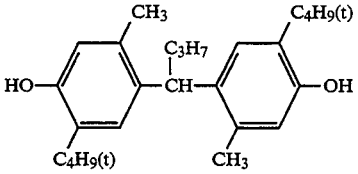
(A-49)
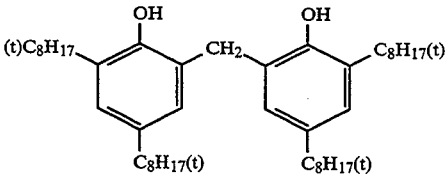
(A-50)
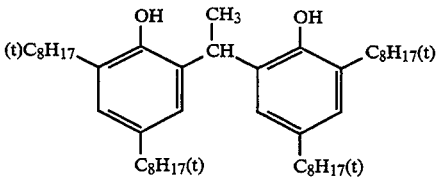
(A-51)
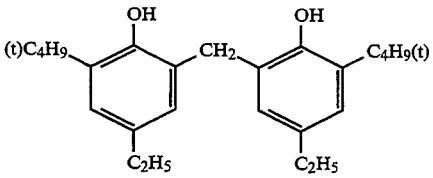
(A-52)
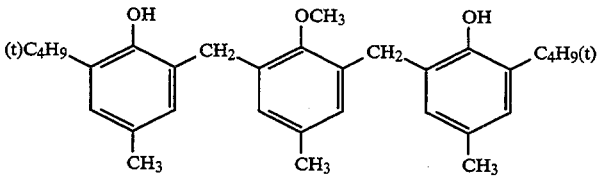
(A-53)
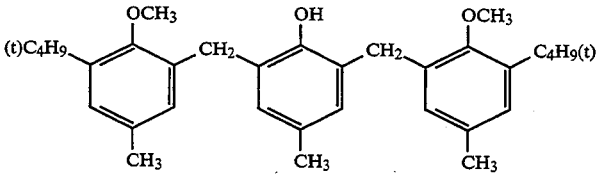
(A-54)

-continued
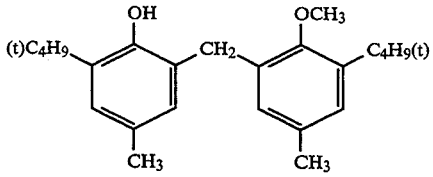
(A-55)
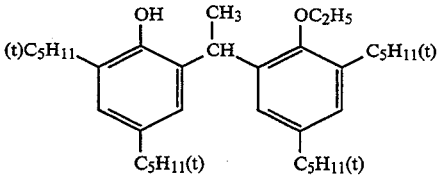
(A-56)
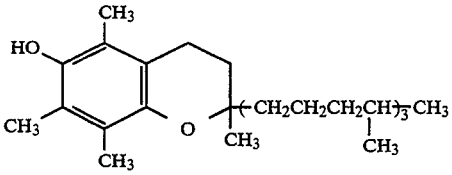
(A-57)
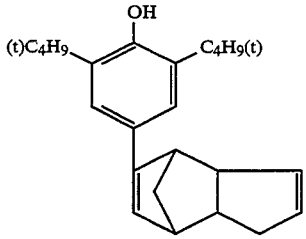
(A-58)
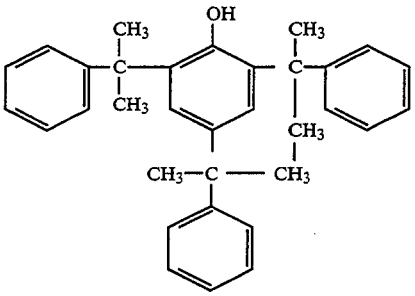
(A-59)
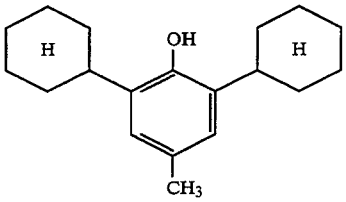
(A-60)
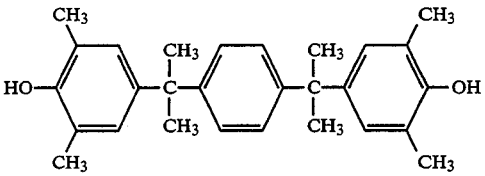
(A-61)
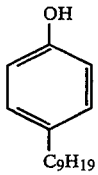
(A-62)
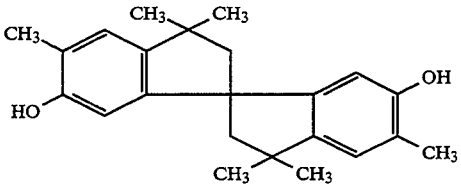
(A-63)
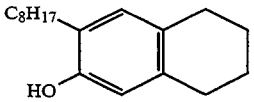
(A-64)
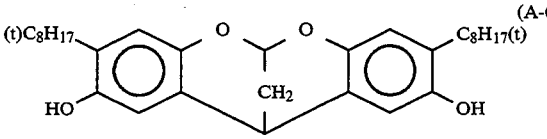
(A-65)
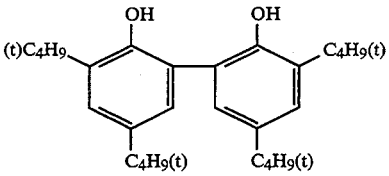
(A-66)
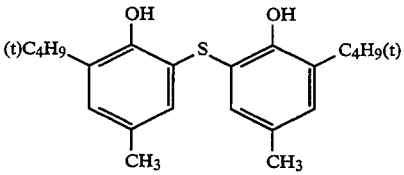
(A-67)
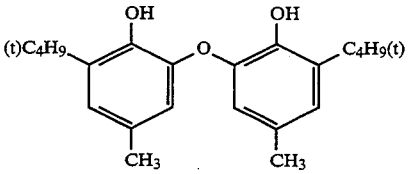
(A-68)
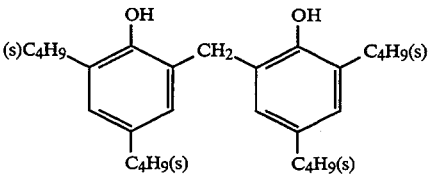
(A-69)
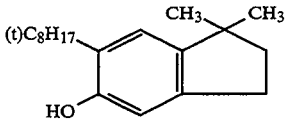
(A-70)

-continued (A-71)

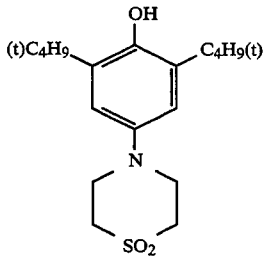

(A-72)

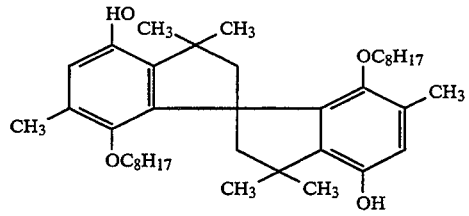

(A-73)

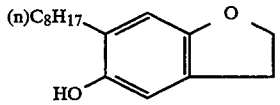

Other preferable examples of a compound represented by Formula (A) and methods of synthesizing them are described in, e.g., U.S. Pat. Nos. 3,432,300, 3,573,050, 3,574,627, 3,700,455, 3,764,337, 3,930,866, 4,113,495, 4,120,723, 4,268,593, 4,430,425, 4,745,050, and 2,043,931, EP 176,845, JP-B-48-31256, JP-B-54-12055, JP-A-1-137258, and JP-A-1-137254.

Formula (B)

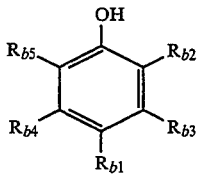

In Formula (B), $R_{b1}$ represents a hydrogen atom, a group of alkyl, alkenyl, aryl, a heterocyclic ring, alkyloxycarbonyl, aryloxycarbonyl, acyl, sulfonyl, carbamoyl, sulfamoyl or acylamino, a halogen atom, or —X—$R_{b0}$ wherein —X— represents —O—, —S—, or —N($R_{b6}$)—, and $R_{b0}$ represents a group of alkyl, alkenyl, aryl, a heterocyclic ring, acyl, or sulfonyl. $R_{b6}$ represents a hydrogen atom or the group defined for $R_{b0}$. $R_{b2}$ to $R_{b5}$ may be identical or different and each represents a hydroxyl group or the group defined for $R_{b1}$. Of the groups represented by $R_{b1}$ to $R_{b5}$, substituents at the ortho positions with each other may combine to form a 5- to 7-membered ring.

Note that the groups represented by $R_{b1}$ to $R_{b5}$ are not simultaneously hydrogen atoms, and one or two of $R_{b2}$ to $R_{b5}$ are hydroxyl groups.

A compound represented by Formula (B) will be described in more detail below.

The substituents described in the present invention can further have substituents.

In Formula (B), $R_{b1}$ to $R_{b5}$ may be identical or different and each represents an alkyl group (e.g., methyl, t-butyl, t-octyl, pentadecyl, cyclohexyl, benzyl, and 2',4'-hydroxybenzyl, in which a preferable number of carbon atoms is 1 to 30), an alkenyl group (e.g., allyl and vinyl, in which a preferable number of carbon atoms is 2 to 30), an aryl group (e.g., phenyl and 3,4-dihydroxyphenyl, preferably phenyl which has 6 to 30 carbon atoms and may be substituted), a heterocyclic group (e.g., 4-morpholinyl, 1-piperidyl, and 1-pyrrolidinyl, preferably a saturated hetero ring having 4 to 15 carbon atoms), an alkyloxycarbonyl group (e.g., ethoxycarbonyl and hexadecyloxycarbonyl), an aryloxycarbonyl group (e.g., phenoxycarbonyl and 2,4-di-t-butylphenoxycarbonyl), an acyl group (e.g., acetyl, benzoyl, and myristoyl), a sulfonyl group (e.g., methanesulfonyl, benzenesulfonyl, and 2-hydroxybenzenesulfonyl), a carbamoyl group (e.g., dimethylcarbamoyl, methylphenylcarbamoyl, and dodecylcarbamoyl), a sulfamoyl group (e.g., dimethylsulfamoyl and dodecylsulfamoyl), an acylamino group (e.g. acetylamino, myristoylamino and 2,4-di-t-amylphenoxyacetylamino), a halogen atom (e.g., chlorine, bromine, and fluorine), or —X—$R_{b0}$. Each of $R_{b2}$ to $R_{b5}$ further represents a hydroxyl group.

—X— represents —O—, —S—, or —N($R_{b6}$)—. Each of $R_{b0}$ and $R_{b6}$ represents an alkyl group (e.g., methyl, ethyl, isobutyl, isopropyl, octyl, benzyl, hexadecyl, methoxyethyl, and cyclohexyl, in which a preferable number of carbon atoms is 1 to 26), an alkenyl group (e.g., allyl and vinyl, in which a preferable number of carbon atoms is 2 to 26), an aryl group (e.g., phenyl, 4-methoxyphenyl, and naphthyl, preferably phenyl or substituted phenyl having 6 to 30 carbon atoms), a heterocyclic group (e.g., 2-tetrahydropyranyl and pyridyl), an acyl group (e.g., acetyl, benzoyl, and tetradecanoyl), or a sulfonyl group (e.g., methanesulfonyl, benzenesulfonyl, and octanesulfonyl). $R_{b6}$ also represents a hydrogen atom. Of the groups represented by $R_{b1}$ to $R_{b5}$, substituents at the ortho positions with each other may combine to form a 5- to 7-membered ring (e.g., a chroman ring, a coumaran ring, and a indane ring), and this may form a spiro ring or a bicyclo ring.

Note that the groups represented by $R_{b1}$ to $R_{b5}$ are not simultaneously hydrogen atoms, and one or two of $R_{b2}$ to $R_{b5}$ are hydroxyl groups.

A compound represented by Formula (B) preferably has a total number of carbon atoms of 15 or more for the effects of the present invention.

Of compounds represented by Formula (B), those preferable for the effects of the present invention are enumerated below.

A compound in which only one of $R_{b2}$ and $R_{b5}$ represents a hydroxyl group.

A compound in which only one of $R_{b3}$ and $R_{b4}$ represents a hydroxyl group.

Of compounds represented by Formula (B), those represented by Formulas (B-I) and (B-II) below are particularly preferable, and those represented by Formula (B-II) are most preferable for the effects of the present invention.

Formula (B-I)

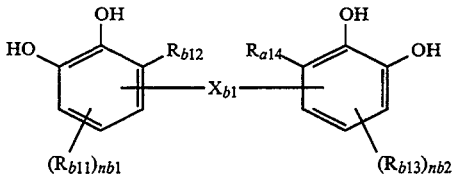

Formula (B-II)

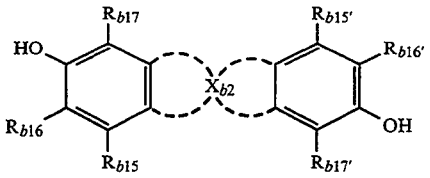

In Formula (B-I), $R_{b11}$ and $R_{b13}$ may be identical or different and each represents a group of alkyl, alkenyl, aryl, a heterocyclic ring, alkyloxycarbonyl, aryloxycarbonyl, acyl, sulfonyl, carbamoyl or sulfamoyl, a halogen atom, or —$X_{b3}$—$R_{b18}$ wherein—$X_{b3}$— represents —O—, —S—, or —N($R_{b19}$)—, and $R_{b18}$ represents a group of alkyl, alkenyl, aryl, a heterocyclic ring, acyl, or sulfonyl. $R_{b19}$ represents a hydrogen atom or the group defined for $R_{b18}$. $R_{b12}$ and $R_{b14}$ may be identical or different and each represents a hydrogen atom, a hydroxyl group, or the group defined for $R_{b11}$. —$X_{b1}$— represents a single bond, —O—, —S—, —SO2—, —C(O)—, or —(C($R_{b20}$)($R_{b21}$))$_{nb3}$— wherein $R_{b20}$ and $R_{b21}$ may be identical or different and each represents a group of a hydrogen atom, alkyl, or aryl. Each of nb1, nb2, and nb3 represents 1 or 2.

In Formula (B-I), it is preferable for the effects of the present invention that each of $R_{b11}$ to $R_{b14}$ be a group of alkyl, aryl or a hetero ring, a halogen atom, —O—$R_{b18}$, or —S—$R_{b18}$.

In Formula (B-I), for the effects of the present invention, —$X_{b1}$— is preferably a single bond, —O—, —S—, or —C($R_{b20}$)($R_{b21}$)—, and most preferably —O—, —S—, or —CH($R_{b20}$)—.

In Formula (B-II), $R_{b15}$ to $R_{b17}$ and $R_{b15}'$ to $R_{b17}'$ may be identical or different and each represents a hydrogen atom, a group of hydroxy, alkyl, alkenyl, aryl, a hetero ring, alkyloxycarbonyl, aryloxycarbonyl, acyl, sulfonyl, carbamoyl or sulfamoyl, a halogen atom, or —$X_{b3}$—$R_{b18}$ wherein $X_{b3}$ and $R_{b18}$ represent the same groups defined in Formula (B-I). $X_{b2}$ represents a nonmetallic atom group required to form, together with a benzene ring, a spiroindane ring, a spirochroman ring, a spirocoumaran ring, a bicycloindane ring, a bicyclochroman ring, or a bicyclocoumaran ring. Note that one or two of $R_{b15}$ to $R_{b17}$ and one or two of $R_{b15}'$ to $R_{b17}'$ are hydroxyl groups.

In Formula (B-II), it is preferable for the effects of the present invention that $R_{b15}$ to $R_{b17}$ and $R_{b15}'$ to $R_{b17}'$ be identical or different and each represent a hydrogen atom, a group of hydroxy, alkyl, alkenyl, aryl or a hetero ring, a halogen atom, —O—$R_{b18}$, or —S—$R_{b18}$. In this case, $R_{b18}$ is preferably alkyl or aryl.

In formula (B-II), it is preferable for the effects of the present invention that $X_{b2}$ form a spiroindane ring, a spirochroman ring, or a spirocoumaran ring, together with the benzene ring.

Practical examples of a compound represented by Formula (B) of the present invention are presented below, but the present invention is not limited to these examples.

(B-1)

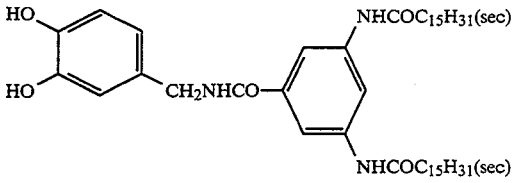

(B-2)

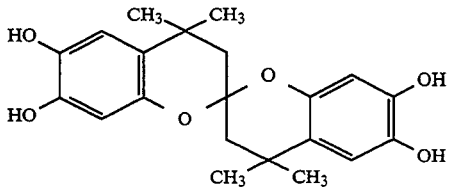

(B-3)

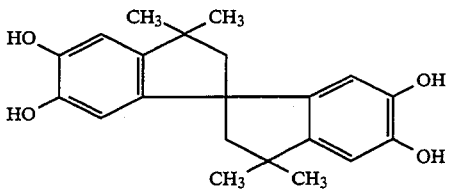

(B-4)

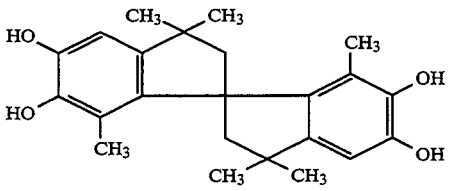

(B-5)

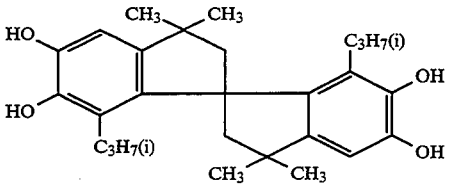

(B-6)

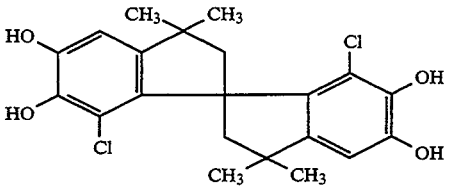

(B-7)

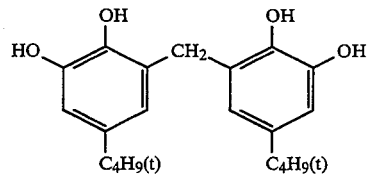

(B-8)

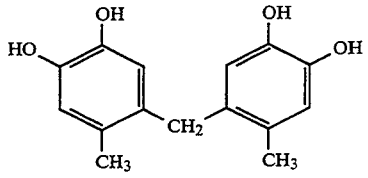

-continued
(B-9)
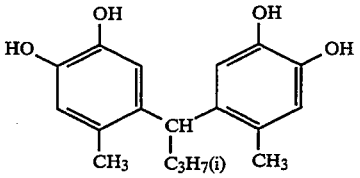
(B-10)
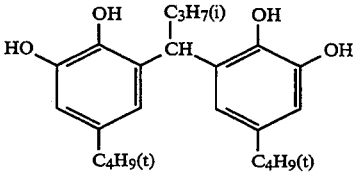
(B-11)
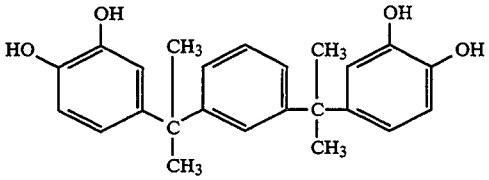
(B-12)
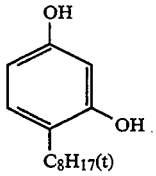
(B-13)
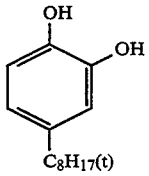
(B-14)
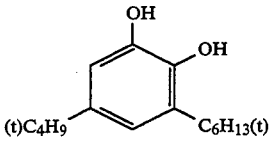
(B-15)
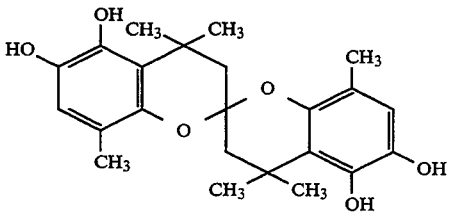
(B-16)
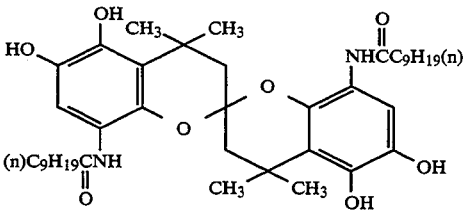
-continued
(B-17)
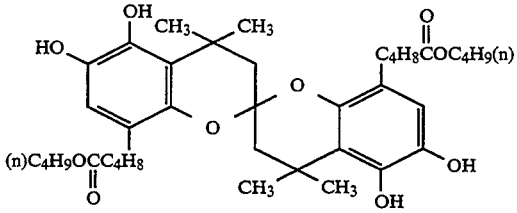
(B-18)
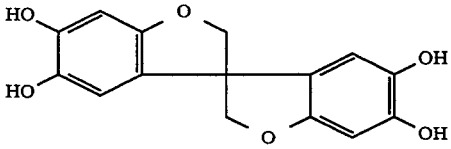
(B-19)
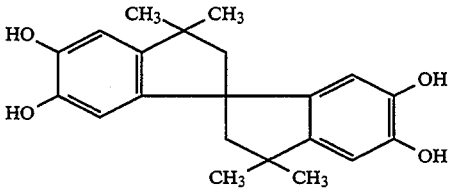
(B-20)
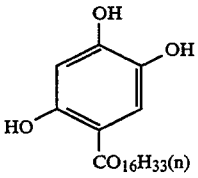
(B-21)
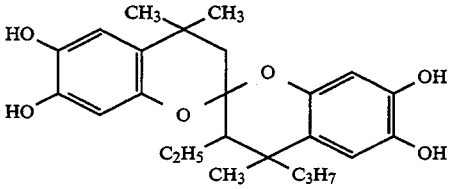
(B-22)
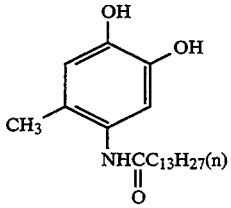
(B-23)
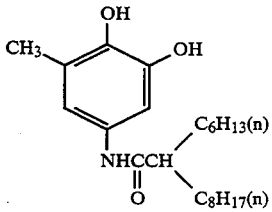
(B-24)
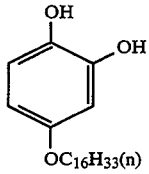

-continued
(B-25)
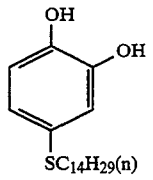
(B-26)
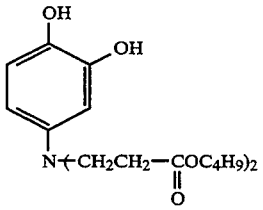
(B-27)
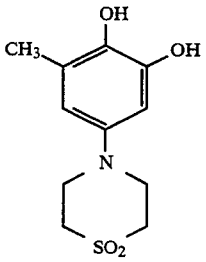
(B-28)
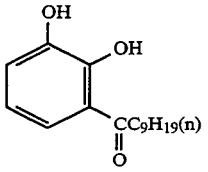
(B-29)
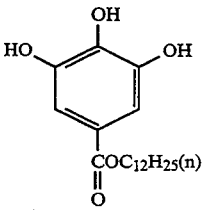
(B-30)
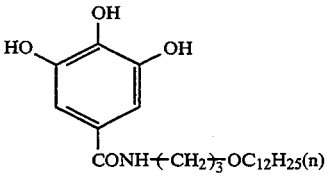
(B-31)
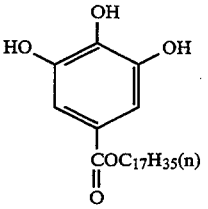
(B-32)
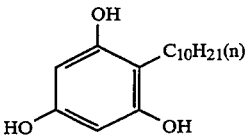
-continued
(B-33)
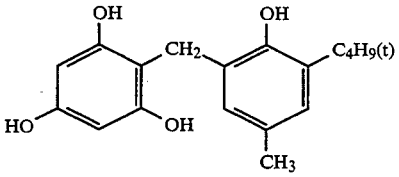
(B-34)
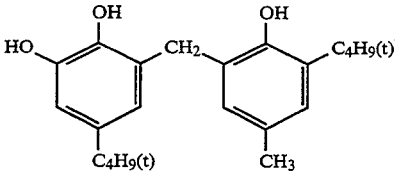
(B-35)
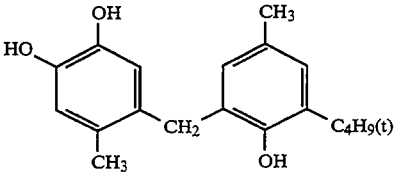
(B-36)
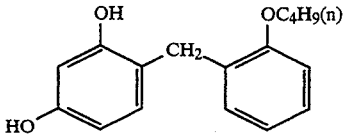
(B-37)
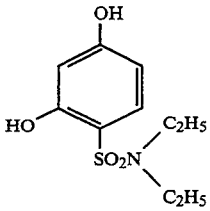
(B-38)
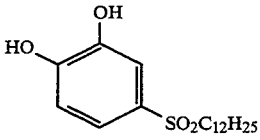
(B-39)
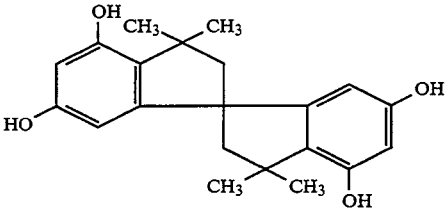
(B-40)
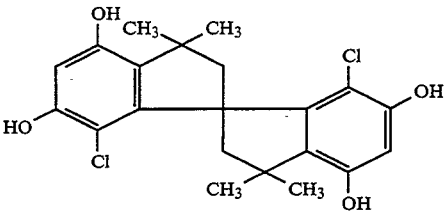
(B-41)
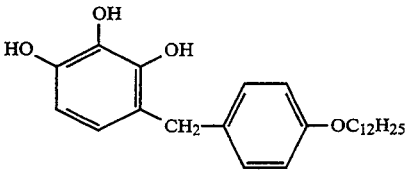

-continued (B-42)

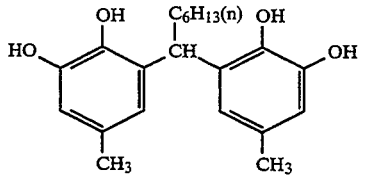

(B-43)

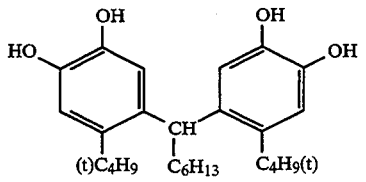

(B-44)

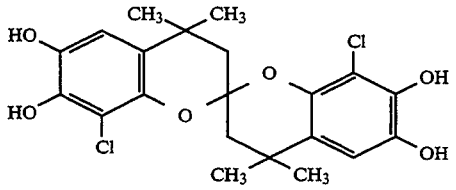

(B-45)

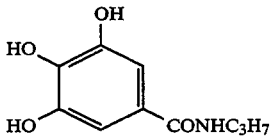

(B-46)

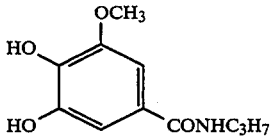

(B-47)

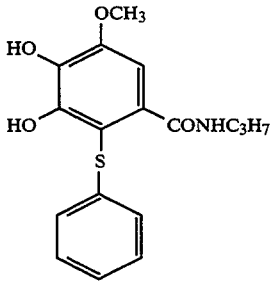

(B-48)

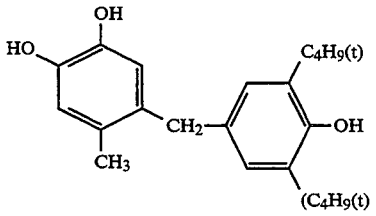

(B-49)

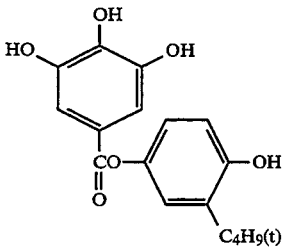

A compound represented by Formula (B) of the present invention can be synthesized by the methods described in, e.g., JP-B-48-31256, JP-B-54-12055, JP-B-49-20977, JP-B-60-19308, JP-B-62-45545, JP-B-63-56230, JP-A-62-273531, and JP-A-55-25729, or methods according to these methods.

It is known from, e.g., JP-B-43-4133, that gallic acid-based compounds included in compounds represented by Formula (B) of the present invention are used in order to prevent fog during storage. However, the latensification preventing effect of the present invention, particularly that occurring in the presence of DIR compounds is not at all known to those skilled in the art, indicating that the effect of the present invention was surprising.

Likewise, the use of catechol derivatives included in compounds represented by Formula (B) of the present invention in silver halide emulsions is known from, e.g., British Patent 2,054,187, U.S. Pat. Nos. 3,582,333, 3,671,248, 3,902,905, and 3,522,053, JP-A-56-52734, JP-A-58-28714, and JP-A-61-91651. However, these inventions are made for the purposes of improving development properties, preventing fog, and improving gradation. Therefore, the latensification preventing effect of the present invention, particularly that occurring in the presence of DIR compounds are not at all known to those skilled in the art, demonstrating that the effect of the present invention was surprising.

In addition, JP-A-57-176032 discloses a technique to improve the stability of a latent image by using certain kinds of a cyanine dye, a thiosulfonic acid compound, and an antioxidant, and compounds included in compounds represented by Formulas (A) and (B) of the present invention are exemplified as this antioxidant. However, JP-A-57-176032 does not refer to the latensification preventing effect that occurs in the presence of a compound which reacts with the oxidized form of a developing agent to release a development inhibitor or a precursor of a development inhibitor and/or a compound which cleaves after reacting with the oxidized form of a color developing agent, the cleaved compound of which reacts with another molecule of the oxidized form of a color developing agent to cleave a development inhibitor. In particular, it was surprising that compounds represented by Formulas (A) and (B) of the present invention could effectively prevent latensification in the presence of these compounds without degrading image qualities and sensitivity.

Although compounds represented by Formulas (A) and (B) of the present invention can be contained in any layer of the light-sensitive material, they are preferably contained in negative silver halide emulsion layer. The negative silver halide emulsion means, as is well known to those skilled in the art, an emulsion in which an amount of silver or dyes produced directly by development is increased as the exposure amount of silver halide grains is increased.

It is preferable that the present invention be applied to negative-type silver halide color photographic light-sensitive materials.

The compounds of the present invention can be added to a material by dissolving in water, alcohols, esters, or ketones, or in a solvent mixture of them and adding the resultant solution to the material. Alternatively, the compounds can be added to a material by dissolving in a high-boiling organic solvent, dispersing the resultant solution, and adding the dispersion to the material. A combination of this method and oil-soluble compounds represented by Formulas (A) and (B) is preferable because the compounds added are readily fixed to a layer to which they are added. A method of adding the compounds by co-emulsifying them with couplers is also preferable.

The addition amount of compounds represented by Formulas (A) and (B) of the present invention is preferably $1\times10^{-4}$ to 10 mols, more preferably $1\times10^{-3}$ to 1 mol, and most preferably $5\times10^{-3}$ to $1\times10^{-1}$ mol per mol of a silver halide in a layer to which they are added.

Compounds represented by Formulas (A) and (B) of the present invention must be used only to control latent image performance. Therefore, it is necessary that the compounds have no other adverse effects on a light-sensitive material. The present inventors found, in the course of investigation, several compounds, other than compounds represented by Formulas (A) and (B), which were able to more or less prevent latensification. However, many of these compounds had only insignificant effects or induced fog or desensitization upon addition or during storage. The present inventors have begun to understand that compounds represented by Formulas (A) and (B) of the present invention have no adverse effects while keeping their significant latensification preventing effects and, to our surprise, that they also have an effect of preventing an unpreferable phenomenon in that fog of a light-sensitive material increases during storage.

It is more preferable that compounds represented by Formulas (A) and (B) of the present invention do not substantially react with the oxidized form of a color developing agent during color development since, if they react with the oxidized form of a color developing agent, side effects such as a decrease in sensitivity and a soft tone occur. The gallic acid-based compound known from, e.g., JP-B-43-4133, to have a fog preventing effect during storage before exposure or the example antioxidant (32) used as an oxidant to improve the stability of a latent image in Example 3 of JP-A-57-176032 is a compound which reacts with the oxidized form of a color developing agent. In this case, "a compound does not substantially react with the oxidized form of a color developing agent during color development" means that when a compound represented by Formula (A) or (B) of the present invention is added to a light-sensitive material, a photographic performance obtained by development immediately after exposure does not substantially change. "A photographic performance does not substantially change" means that a sensitivity reduction is 0.1 logE or less, preferably 0.05 logE or less.

The present invention must contain at least one type of a compound which reacts with the oxidized form of a developing agent to release a development inhibitor or a precursor of a development inhibitor and/or at least one type of a compound which cleaves after reacting with the oxidized form of a color developing agent, the cleaved compound of which in turn reacts with another molecule of the oxidized form of a color developing agent to cleave a development inhibitor.

These compounds will be described below.

The couplers are represented by Formulas (I), (II), and (III) below:

A—DI Formula (I)

A—(TIME)$_a$—DI Formula (II)

A—(TIME)$_i$—RED—DI Formula (III)

wherein A represents a coupler moiety which causes a coupling reaction with the oxidized form of an aromatic primary amine developing agent to split off DI, (TIME-)a-DI, or RED-DI, TIME represents a timing group which cleaves DI after split off from A by the coupling reaction, RED represents a group which reacts with the oxidized form of a developing agent to cleave DI after split off from A, DI represents a development inhibitor moiety, a represents 1 or 2, and i represents 0 or 1. If a represents 2, two TIMEs may be identical or different. DI preferably represents a diffusing development inhibitor moiety.

A coupler moiety represented by A will be described.

If A represents a yellow image coupler moiety, examples of the coupler moiety are a pivaloylacetanilide type coupler moiety, a benzoylacetanilide type coupler moiety, a malondiester type coupler moiety, a malondiamide type coupler moiety, a dibenzoylmethane type coupler moiety, a benzothiazolylacetamide type coupler moiety, a malonestermonoamide type coupler moiety, a benzoxazolylacetamide type coupler moiety, a benzoimidazolylacetamide type coupler moiety, and a cycloalkanoylacetamide type coupler moiety. A coupler moiety described in U.S. Pat. Nos. 5,021,332 or 5,021,330 or EP 421,221A can also be used.

If A represents a magenta image forming coupler moiety, examples of the coupler moiety are a 5-pyrazolone type coupler moiety, a pyrazolobenzimidazole type coupler moiety, a pyrazolotriazole type coupler moiety, a pyrazoloimidazole type coupler moiety, and a cyanoacetophenone type coupler moiety.

If A represents a cyan image forming coupler moiety, examples of the coupler moiety are phenol type and naphthol type coupler moieties. It is also possible to use a coupler moiety described in U.S. Pat. No. 4,746,602 or EP 249,453A.

A can also be a coupler moiety which leaves essentially no color image. Examples of the coupler moiety of this type are indanone type and acetophenone type coupler moieties, and eluting coupler moieties described in EP 443,530A and 444,501A.

Preferable examples of A in Formulas (I), (II), and (III) are coupler moieties represented by Formulas (Cp-1), (Cp-2), (Cp-3), (Cp-4), (Cp-5), (Cp-6), (Cp-7), (Cp-8), (Cp-9), and (Cp-10). There couplers are preferable because of their high coupling rates.

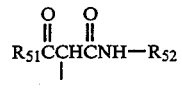
Formula (Cp-1)

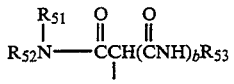
Formula (Cp-2)

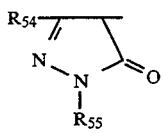
Formula (Cp-3)

-continued

Formula (Cp-4)

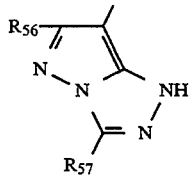

Formula (Cp-5)

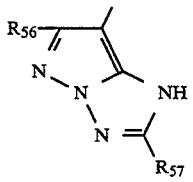

Formula (Cp-6)

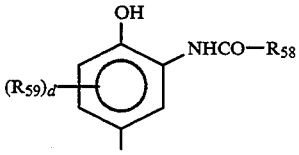

Formula (Cp-7)

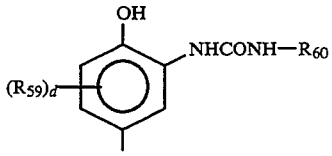

Formula (Cp-8)

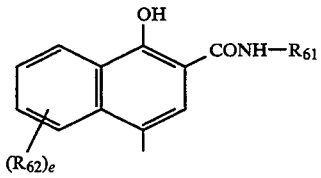

Formula (Cp-9)

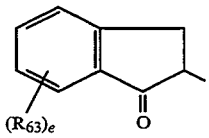

Formula (Cp-10)

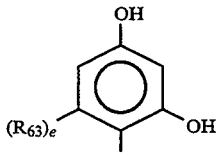

In the above formulas, a free bonding hand deriving from a coupling position represents the bonding position of the coupling split-off group.

In the above formulas, if $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, or $R_{63}$ includes a nondiffusing group, the group is so selected as to have a total number of carbon atoms of 8 to 40, preferably 10 to 30. Otherwise, the total number of carbon atoms is preferably 15 or less. In the case of a bis, telomer, or polymer type coupler, one of the above substituents represents a divalent group and couples with, e.g., a repeating unit. In this case, the number of carbon atoms may fall outside the range defined above.

$R_{51}$ to $R_{63}$, b, d, and e will be described in detail below. In the following description, $R_{41}$ represents a group of alkyl, aryl, or a heterocyclic ring, $R_{42}$ represents a group of aryl or a heterocyclic ring, and each of $R_{43}$, $R_{44}$, and $R_{45}$ represents a group of a hydrogen atom, alkyl, aryl, or a heterocyclic ring. $R_{51}$ represents the same meaning as $R_{41}$. Each of $R_{52}$ and $R_{53}$ represents the same meaning as $R_{43}$. b represents 0 or 1. $R_{54}$ represents a group having the same meaning as $R_{41}$, or a group of $R_{41}CO(R_{43})N$—, $R_{41}SO_2(R_{43})N$—, $R_{41}(R_{43})N$—, $R_{41}S$—, $R_{43}O$—, or $R_{45}(R_{43})NCON(R_{44})$—.

$R_{55}$ represents a group having the same meaning as $R_{41}$. Each of $R_{56}$ and $R_{57}$ represents a group having the same meaning as $R_{43}$, or a group of $R_{41}S$—, $R_{43}O$—, $R_{41}CO(R_{43})N$—, or $R_{41}SO_2(R_{43})N$—. $R_{58}$ represents a group having the same meaning as $R_{41}$. $R_{59}$ represents a group having the same meaning as $R_{41}$, or a group of $R_{41}CO(R_{43})N$—, $R_{41}OCO(R_{43})N$—, $R_{41}SO_2(R_{43})N$—, $R_{43}(R_{44})NCO(R_{45})N$—, $R_{410}$—, $R_{41}S$—, a halogen atom, or $R_{41}(R_{43})N$—. d represents 0 to 3. If d represents the plural number, a plurality of $R_{59}$'s represent the same substituent or different substituents. $R_{60}$ represents a group having the same meaning as $R_{41}$. $R_{61}$ represents a group having the same meaning as $R_{41}$. $R_{62}$ represents a group having the same meaning as $R_{41}$, or a group of $R_{41}CONH$—, $R_{41}OCONH$—, $R_{41}SO_2NH$—, $R_{43}(R_{44})NCONH$—, $R_{43}(R_{44})NSO_2NH$—, $R_{43}O$—, $R_{41}S$—, a halogen atom, or $R_{41}NH$—. $R_{63}$ represents a group having the same meaning as $R_{41}$, or a group of $R_{43}CO(R_{44})N$—, $R_{43}(R_{44})NCO$—, $R_{41}SO_2(R_{43})N$—, $R_{41}(R_{43})NSO_2$—, $R_{41}SO_2$—, $R_{43}OCO$—, $R_{43}O$—$SO_2$—, a halogen atom, nitro, cyano, or $R_{43}CO$—. e represents an integer from 0 to 4. If a plurality of $R_{62}$'s or $R_{63}$'s are present, they may be identical or different.

In the above description, the alkyl group is a saturated or unsaturated, chain-like or cyclic, straight-chain or branched, and substituted or nonsubstituted alkyl group having 1 to 32, preferably 1 to 22 carbon atoms. Representative examples of the alkyl group are methyl, ethyl, propyl, isopropyl, n-butyl, t-butyl, i-butyl, t-amyl, n-hexyl, cyclohexyl, 2-ethylhexyl, n-octyl, 1,1,3,3-tetramethylbutyl, n-decyl, n-dodecyl, n-hexadecyl, and n-octadecyl.

The aryl group is preferably substituted or non-substituted phenyl having 6 to 20 carbon atoms or substituted or nonsubstituted naphthyl.

The heterocyclic group is preferably a 3- to 8-membered substituted or nonsubstituted heterocyclic group having 1 to 20, preferably 1 to 7 carbon atoms and a heterocyclic atom selected from a nitrogen atom, an oxygen atom, and a sulfur atom. Representative examples of the heterocyclic group are 2-pyridyl, 2-benzoxazolyl, 2-imidazolyl, 2-benzimidazolyl, 1-indolyl, 1,3,4-thiadiazole-2-yl, 1,2,4-triazole-2-yl, and 1-indolynyl.

If the alkyl group, the aryl group, and the heterocyclic group described above have substituents, representative examples of the substituents are groups of a halogen atom, $R_{47}O$—, $R_{46}S$—, $R_{47}CO(R_{48})N$—, $R_{47}(R_{48})NCO$—, $R_{46}OCO(R_{47})N$—, $R_{46}SO_2(R_{47})N$—, $R_{47}(R_{48})NSO_2$—, $R_{46}SO_2$—, $R_{47}OCO$—, $R_{47}NCO(R_{48})N$—, $R_{47}CONHSO_2$—, $R_{47}NHCONHSO_2$—, a group having the same meaning as $R_{46}$, $R_{47}(R_{48})N$—, $R_{46}COO$—, $R_{47}OSO_2$—, cyano, and nitro. $R_{46}$ represents a group of alkyl, aryl, or a heterocyclic ring, and each of $R_{47}$, $R_{48}$, and $R_{49}$ represents a group of alkyl, aryl, a heterocyclic ring, or a hydrogen atom. These alkyl, aryl, and heterocyclic groups have the same meanings as defined above.

Preferable ranges of $R_{51}$ to $R_{63}$, b, d, and e will be described below.

$R_{51}$ is preferably a group of alkyl, aryl, or a heterocyclic ring. Each of $R_{52}$ and $R_{55}$ is preferably aryl. If b is 1, $R_{53}$ is preferably aryl. If b is 0, $R_{53}$ is preferably a heterocyclic ring. $R_{54}$ is preferably $R_{41}CONH$— or $R_{41}(R_{43})N$—.

Each of $R_{56}$ and $R_{57}$ is preferably alkyl, $R_{41}O$—, or $R_{41}S$—.

$R_{58}$ is preferably alkyl or aryl. In Formula (Cp-6), $R_{59}$ is preferably a chlorine atom, alkyl, or $R_{41}CONH$—. d is preferably 1 or 2. $R_{60}$ is preferably aryl. In Formula (Cp-7), $R_{59}$ is preferably $R_{41}CONH$—. In Formula (Cp-7), d is preferably 1. $R_{61}$ is preferably alkyl or aryl. In Formula (Cp-8), e is preferably 0 or 1. $R_{62}$ is preferably $R_{41}OCONH$—, $R_{41}CONH$—, or $R_{41}SO_2NH$—, and the substitution position of any of these substituents is preferably the 5th position of a naphthol ring. In Formula (Cp-9), $R_{63}$ is preferably $R_{41}CONH$—, $R_{41}SO_2NH$—, $R_{41}(R_{43})NSO_2$—, $R_{41}SO_2$—, $R_{41}(R_{43})NCO$—, nitro, or cyano. In Formula (Cp-10), $R_{63}$ is preferably $R_{43}NCO$—, $R_{43}OCO$—, or $R_{43}CO$—.

A development inhibitor represented by DI will be described below.

Examples of a development inhibitor represented by DI are described in Research Disclosure Vol. 76, No. 17643, (December, 1978), U.S. Pat. Nos. 4,477,563, 5,021,332, 5,026,628, 3,227,554, 3,384,657, 3,615,506, 3,617,291, 3,733,201, 3,933,500, 3,958,993, 3,961,959, 4,149,886, 4,259,437, 4,095,984, 4,782,012, 1,450,479, and 5,034,311. The development inhibitor is preferably a heterocyclic thio group, a heterocyclic seleno group, or a triazolyl group (monocyclic or condensed-ring 1,2,3-triazolyl or 1,2,4-triazolyl), and most preferably tetrazolylthio, tetrazolylseleno, 1,3,4-oxadiazolylthio, 1,3,4-thiadiazolylthio, 1-(or 2-)benzotriazolyl, 1,2,4-triazole-1-(or 4-)yl, 1,2,3-triazole-1-yl, 2-benzothiazolylthio, 2-benzoxazolylthio, 2-benzoimidazolylthio, or a derivative of any of them. Preferable development inhibitors are represented by Formulas DI-1 to DI-6 below:

DI-1

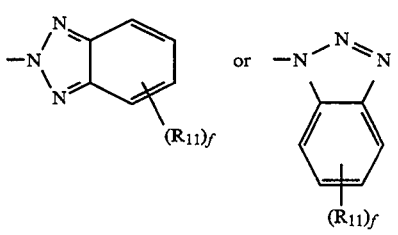

DI-2

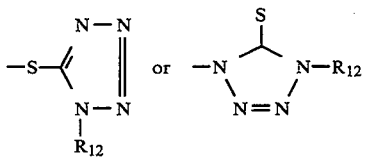

DI-3

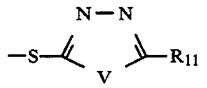

DI-4

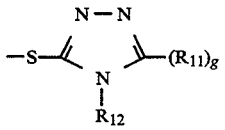

-continued

DI-5

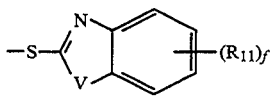

DI-6

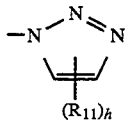

wherein $R_{11}$ represents a halogen atom (e.g., a bromine atom and a chlorine atom), an alkoxycarbonyl group (having 2 to 20, preferably 2 to 10 carbon atoms; e.g., methoxycarbonyl and isoamyloxycarbonylmethoxy), an acylamino group (having 2 to 20, preferably 2 to 10 carbon atoms; e.g., hexaneamido and benzamido), a carbamoyl group (having 1 to 20, preferably 1 to 10 carbon atoms; e.g., N-butylcarbamoyl, N,N-diethylcarbamoyl, and N-mesylcarbamoyl), a sulfamoyl group (having 1 to 20, preferably 1 to 10 carbon atoms; e.g., N-butylsulfamoyl), an alkoxy group (having 1 to 20, preferably 1 to 10 carbon atoms; e.g., methoxy and benzyloxy), an aryloxy group (having 6 to 10, preferably 6 to 10 carbon atoms; e.g., phenoxy, 4-methoxyphenoxy, and naphthoxy), an aryloxycarbonyl group (having 7 to 21, preferably 7 to 11 carbon atoms; e.g., phenoxycarbonyl), an alkoxycarbonylamino group (having 1 to 20, preferably 1 to 10 carbon atoms; e.g., ethoxycarbonylamino), a cyano group, a nitro group, an alkylthio group (having 1 to 20, preferably 1 to 10 carbon atoms; e.g., methylthio and hexylthio), a ureido group (having 1 to 20, preferably 1 to 10 carbon atoms; e.g., N-phenylureido), an aryl group (having 6 to 10 carbon atoms, which is a 3- to 12-membered, preferably 5- or 6-membered monocyclic or condensed-ring heterocyclic group containing at least one hetero atom selected from a nitrogen atom, an oxygen atom, and a sulfur atom; e.g., 2-pyridyl, 1-pyrrolyl, morpholino, and indolyl), an alkyl group (having 1 to 20, preferably 1 to 10 carbon atoms, which is a straight-chain, branched, or cyclic and saturated or unsaturated alkyl group; e.g., methyl, ethyl, butoxycarbonylmethyl, 4-methoxybenzyl, and benzyl), an acyl group (having 1 to 20, preferably 2 to 10 carbon atoms; e.g., acetyl and benzoyl), an arylthio group (having 6 to 10, preferably 6 to 10 carbon atoms; e.g., phenylthio and naphthylthio), or an aryloxycarbonylamino group (having 7 to 11 carbon atoms; e.g., phenoxycarbonylamino). These substituents can further have their substituents. Examples of the substituents are those enumerated above.

In the above formulas, $R_{12}$ represents an aryl group (having 6 to 10 carbon atoms; e.g., phenyl, naphthyl, 4-methoxyphenyl, and 3-methoxycarbonylphenyl), a heterocyclic group (having 1 to 10 carbon atoms, which is a 3- to 12-membered, preferably 5- or 6-membered monocyclic or condensed-ring heterocyclic group containing at least one hetero atom selected from a nitrogen atom, an oxygen atom, and a sulfur atom; e.g., 2-pyridyl, 1-pyrrolyl, morpholino, and indolyl), or an alkyl group (having 1 to 20, preferably 1 to 10 carbon atoms, which is a straight-chain, branched, or cyclic and saturated or unsaturated alkyl group; e.g., methyl, ethyl, butoxycarbonylmethyl, 4-methoxybenzyl, or benzyl). V represents an oxygen atom or a sulfur atom. f represents 1 to 4, g represents 0 or 1, and h represents 1 or 2.

If the development inhibitor releasing compound of the present invention is represented by Formula (I), each of $R_{11}$ and $R_{12}$ in the formula represents a group except for an aryl group and an alkyl group having 5 or more carbon atoms.

A group represented by TIME will be described below.

A group represented by TIME can be any coupling group as long as it can cleave DI after cleaved from A during development. Examples of the group are a group described in U.S. Pat. Nos. 4,146,396, 4,652,516, or 4,698,297, which uses a cleavage reaction of hemiacetal; a timing group described in U.S. Pat. Nos. 4,248,962, 4,847,185, or 4,857,440, which causes a cleavage reaction by using an intramolecular nucleophilic substitution reaction; a timing group described in U.S. Pat. Nos. 4,409,323 or 4,421,845, which causes a cleavage reaction by using an electron transfer reaction; a group described in U.S. Pat. No. 4,546,073, which causes a cleavage reaction by using a hydrolytic reaction of iminoketal; and a group described in West German Patent 2,626,317, which causes a cleavage reaction by using a hydrolytic reaction of ester. TIME couples with A by a hetero atom, preferably an oxygen atom, a sulfur atom, or a nitrogen atom contained in it. Preferable examples of TIME are those represented by Formulas (T-1), (T-2), and (T-3) below:

$$*\text{—W—}(Y{=}Y)_j\text{—C}(R_{21})R_{22}\text{—}^{**} \qquad \text{Formula (T-1)}$$

$$*\text{—W—CO—}^{**} \qquad \text{Formula (T-2)}$$

$$*\text{—W—LINK—E—}^{**} \qquad \text{Formula (T-3)}$$

wherein * represents a position where TIME couples with A in Formula (II) or (III), ** represents a position where TIME couples with DI, TIME (if a represents the plural number), or RED, W represents an oxygen atom, a sulfur atom, or $>N\text{-}R_{23}$, each of X and Y represents methine or a nitrogen atom, j represents 0, 1, or 2, and each of $R_{21}$, $R_{22}$, and $R_{23}$ represents a hydrogen atom or a substituent. If X and Y represent substituted methine, this substituent and two arbitrary substituents of $R_{21}$, $R_{22}$, and $R_{23}$ may or may not combine to form a cyclic structure (e.g., a benzene ring or a pyrazole ring). In Formula (T-3), E represents an electrophilic group, and LINK represents a coupling group which three-dimensionally links W to E so that they can cause an intramolecular nucleophilic substitution reaction.

Practical examples of TIME represented by Formula (T-1) are as follows.

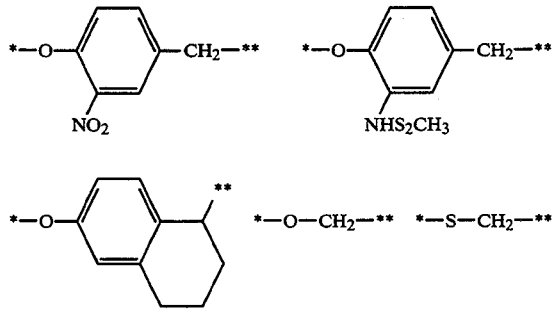

-continued

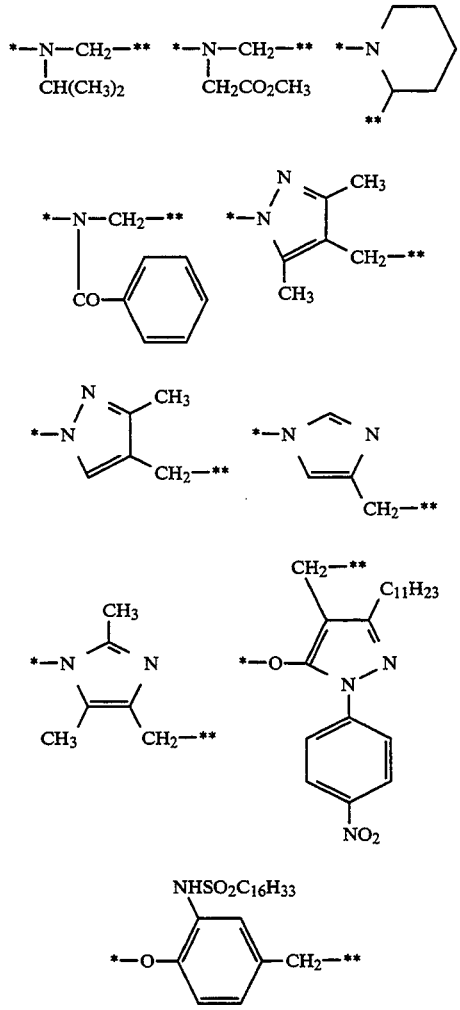

Practical examples of TIME represented by Formula (T-2) are as follows.

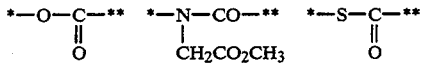

Practical examples of TIME represented by Formula (T-3) are as follows.

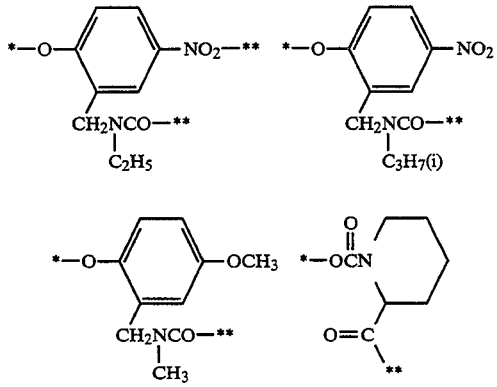

-continued

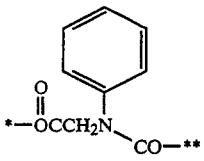

Practical examples of $(TIME)_a$ when a represents 2 or more in Formula (II) are as follows.

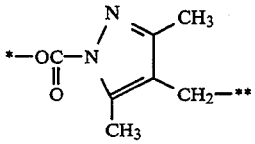

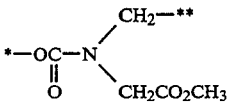

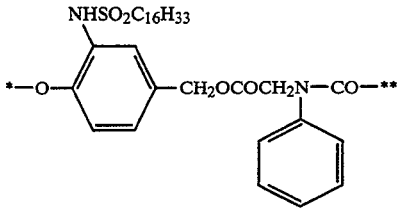

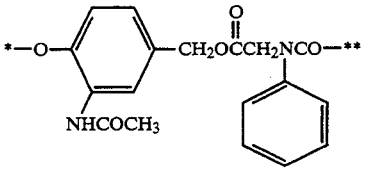

-continued

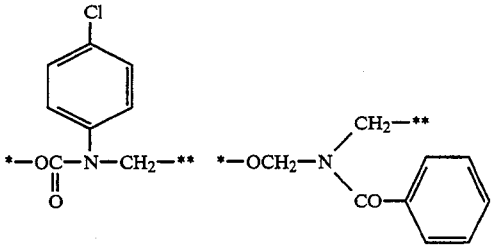

A group represented by RED in Formula (III) will be described below.

RED-DI is cleaved from A and can be cross-oxidized by an oxidative substance, such as the oxidized form of a developing agent, present in development. RED-DI can be any compound as long as it cleaves DI when oxidized. Examples of RED are hydroquinones, catechols, pyrogallols, 1,4-naphthohydroquinones, 1,2-naphthohydroquinones, sulfonamidophenols, hydrazides, and sulfonamidonaphthols. Practical examples of these groups are described in JP-A-61-230135, JP-A-62-251746, JP-A-61-278852, U.S. Pat. Nos. 3,364,022, 3,379,529, 4,618,571, 3,639,417, and 4,684,604, and J. Org. Chem., vol. 29, page 588 (1964).

Of these compounds, preferable examples of RED are hydroquinones, 1,4-naphthohydroquinones, 2-(or 4-)sulfonamidophenols, pyrogallols, and hydrazides. Of these compounds, a redox group having a phenolic hydroxyl group combines with A or TIME by an oxygen atom of the phenol group.

Representative examples of the compounds used in the present invention are presented below, but the present invention is not limited to these examples.

(D-1)

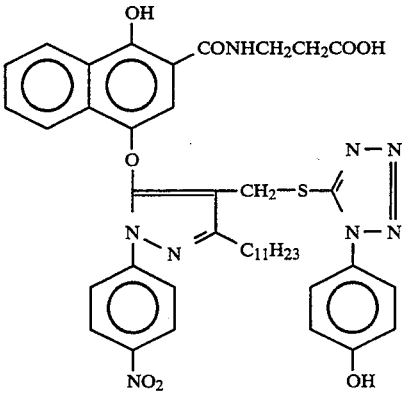

(D-2)

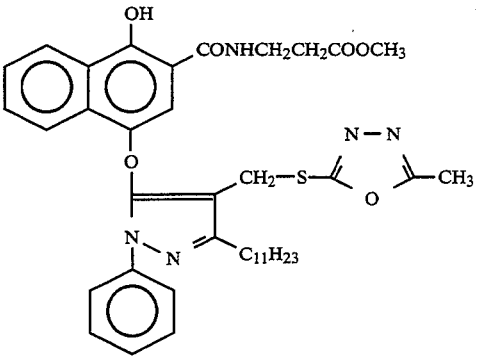

-continued
(D-3)
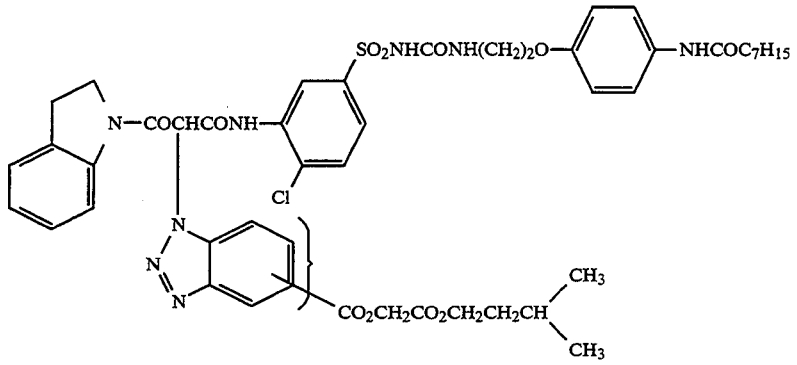
(D-4)
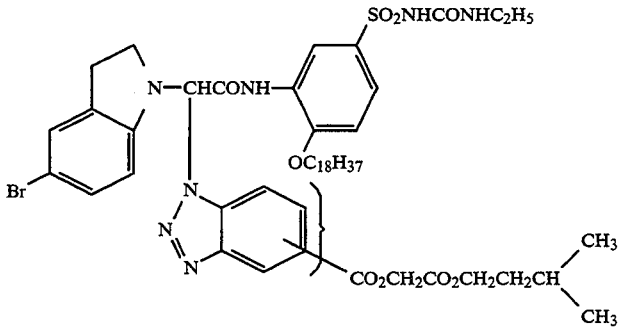
(D-5)
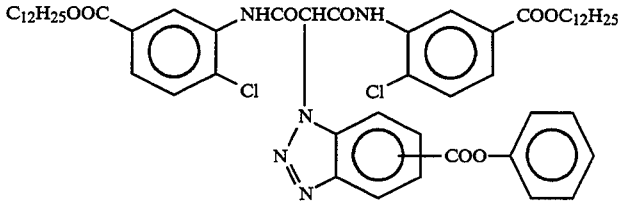
(D-6)
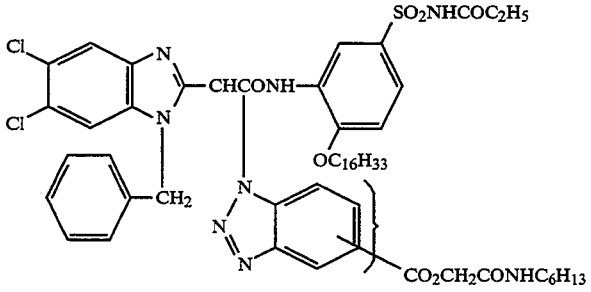
(D-7)
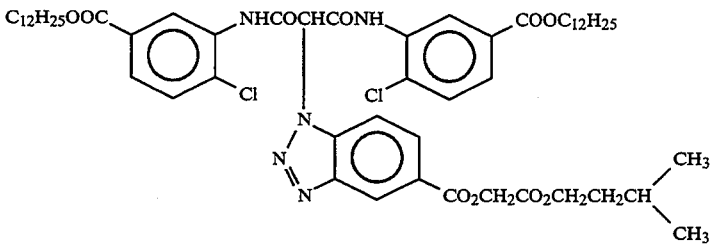

-continued
(D-8)
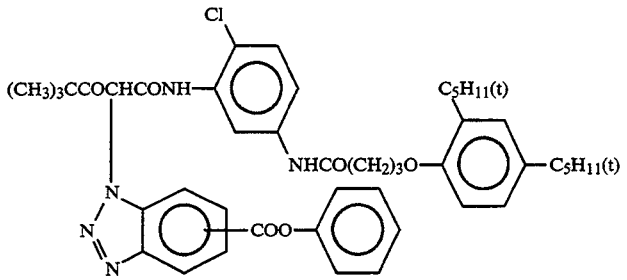
(D-9)
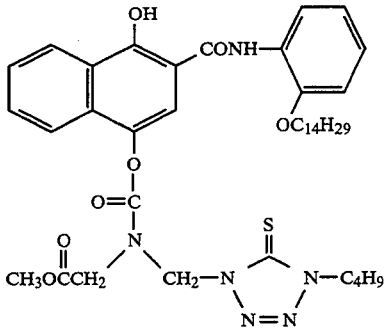
(D-10)
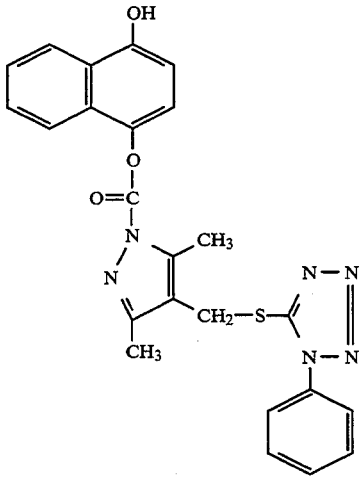
(D-11)
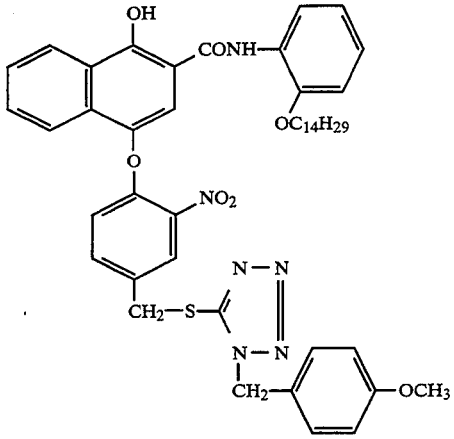

-continued
(D-12)
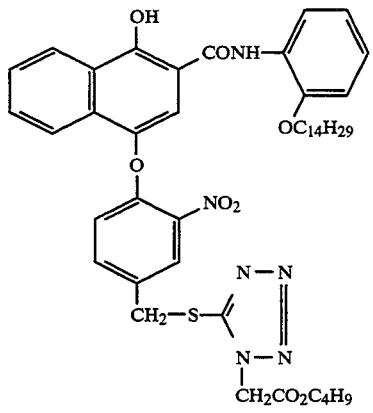
(D-13)
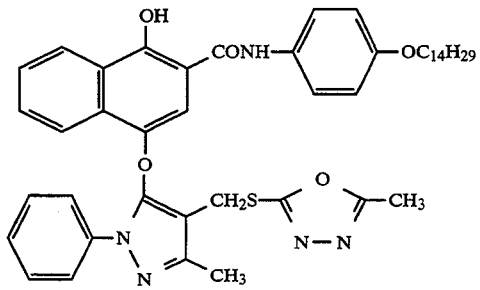
(D-14)
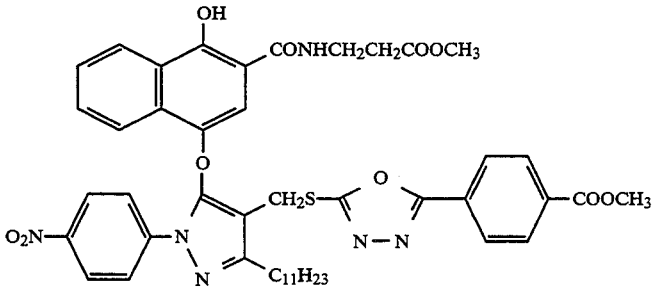
(D-15)
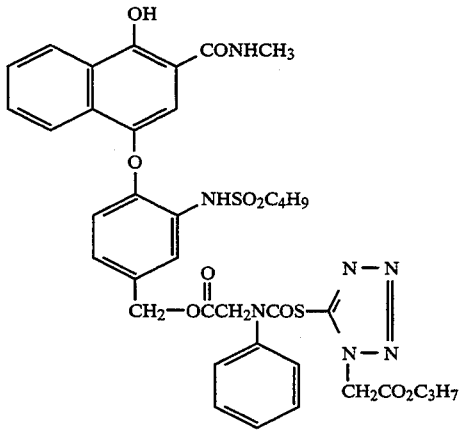

-continued
(D-16)
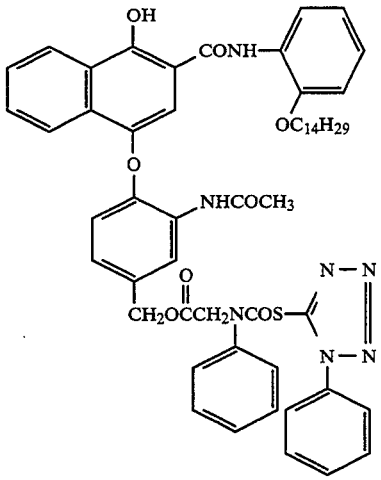
(D-17)
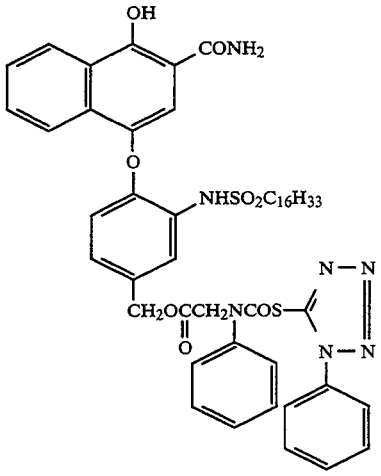
(D-18)
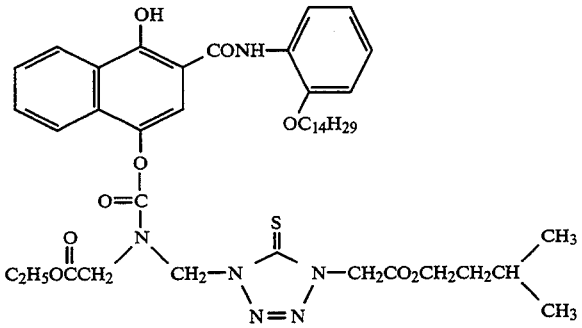
(D-19)
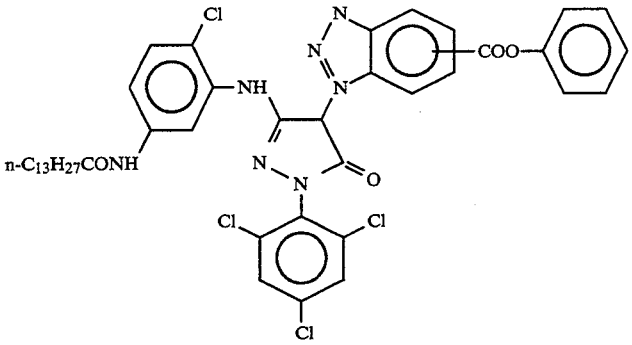

-continued
(D-20)
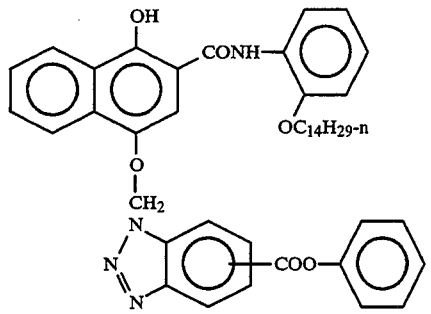
(D-21)
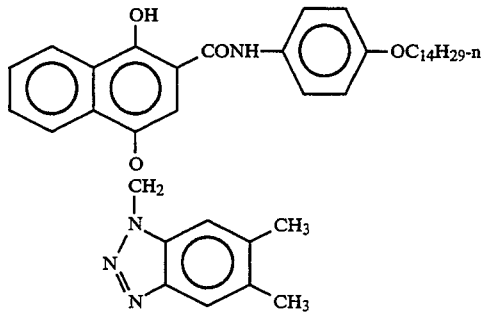
(D-22)
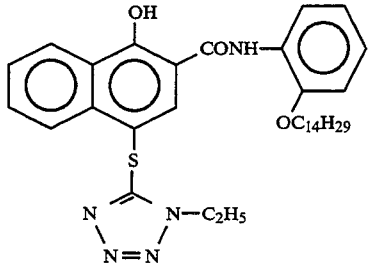
(D-23)
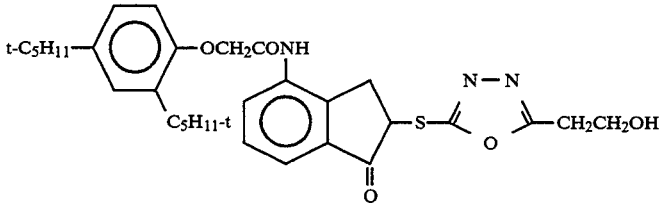
(D-24)
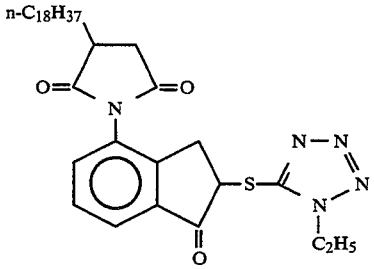
(D-25)
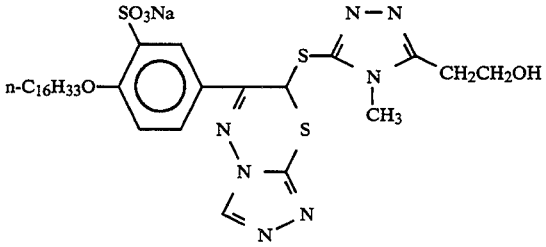

-continued
(D-26)
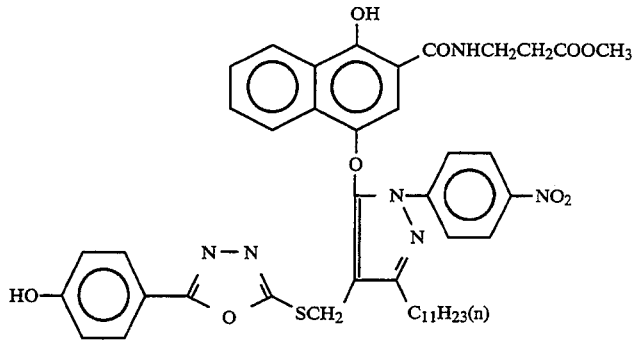
(D-27)
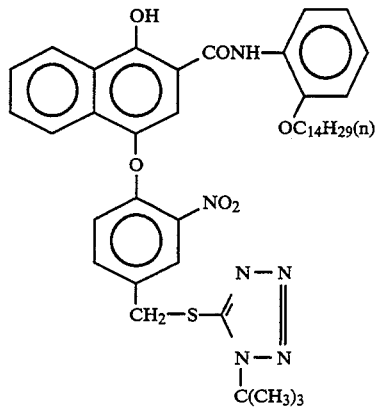
(D-28)
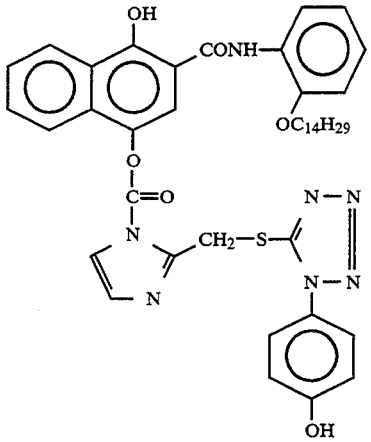
(D-29)
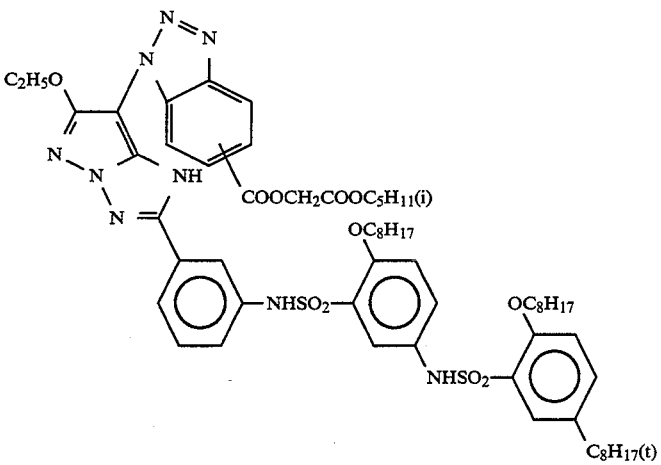

-continued
(D-30)
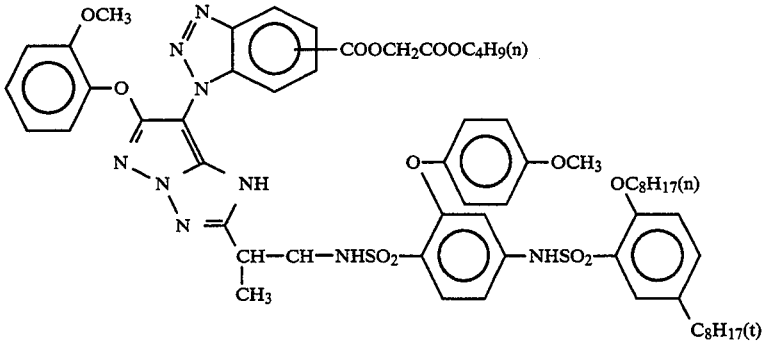
(D-31)
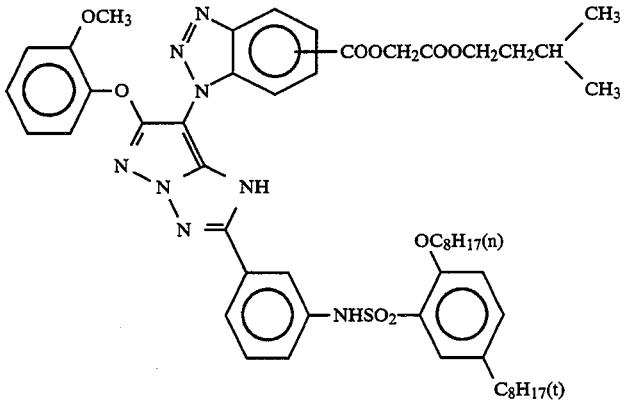
(D-32)
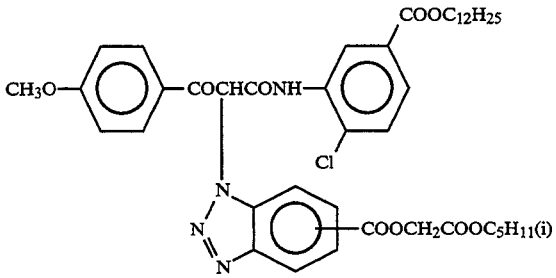
(D-33)
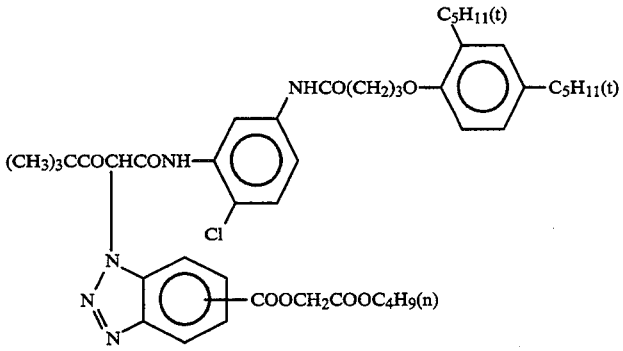
(D-34)
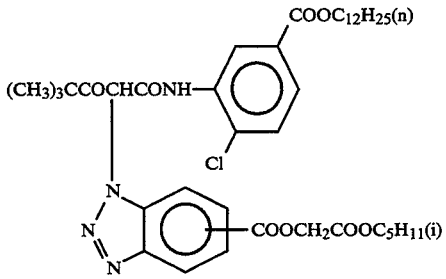

-continued
(D-35)
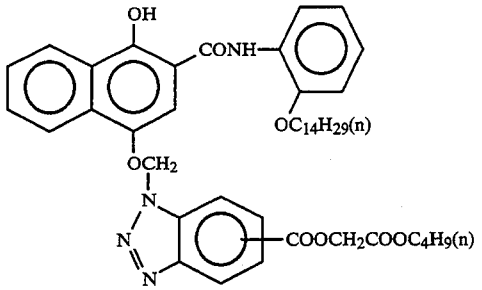
(D-36)
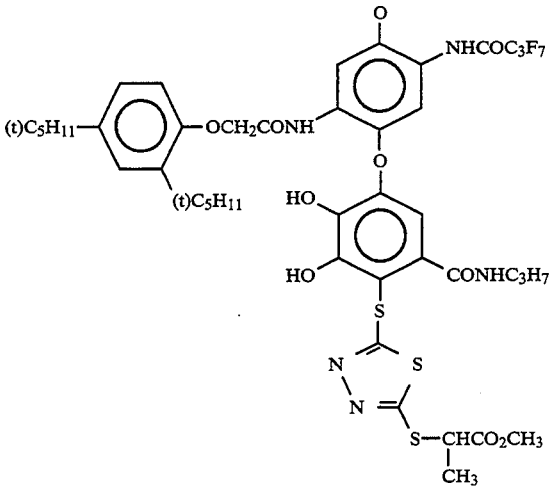
(D-37)
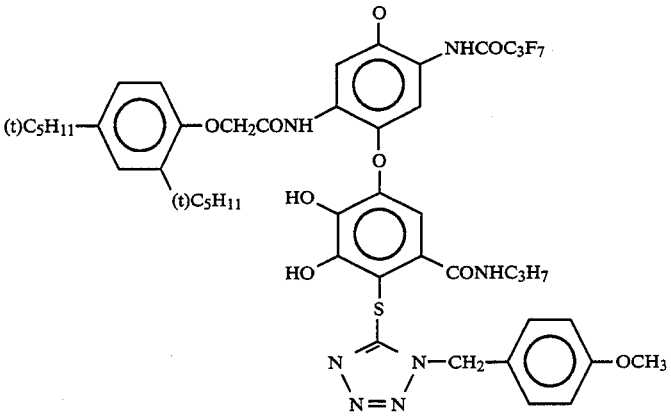
(D-38)
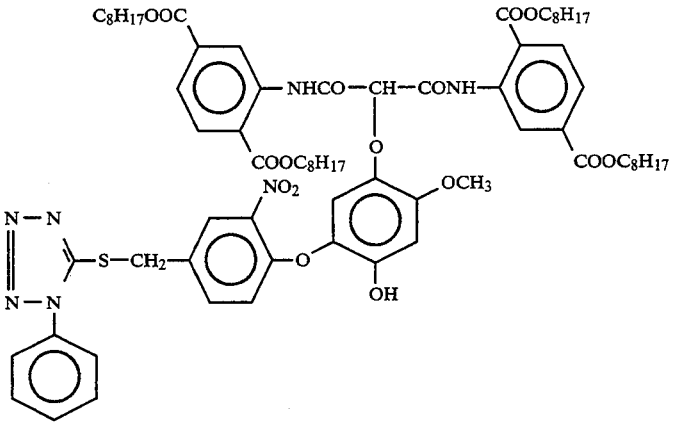

-continued (D-39)

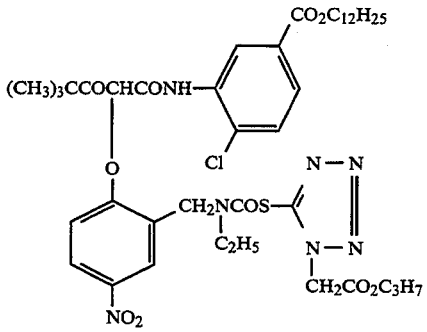

(D-40)

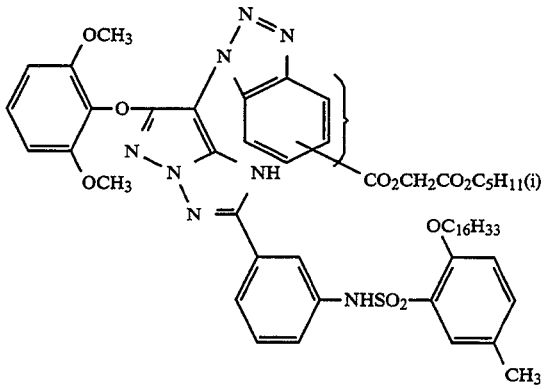

Although these compounds of the present invention can be contained in any layer of the light-sensitive material, they are preferably used in negative silver halide emulsion layers. To improve color reproduction and sharpness, it is necessary to further enhance an interlayer effect to be described later. For this purpose, a large amount of the compounds of the present invention must be used; that is, the total addition amount to the light-sensitive material is preferably $1\times10^{-5}$ mol/m$^2$ or more. The compounds of the present invention can be added in the same manner as conventional couplers as will be described later.

In the present invention, it is preferable that the interlayer effect on at least one color-sensitive layer present in the light-sensitive material be 1.3 or more in terms of color reproduction and sharpness. If the material is so designed as to impose an interlayer effect larger for color reproduction and sharpness, the latensification described above becomes worse, and this increases the usefulness of the present invention.

The term "color-sensitive layer" herein used means a silver halide emulsion layer unit constituted by one or more layers sensitive to substantially the same color. An ordinary color light-sensitive material comprises three color-sensitive layers, i.e., blue-, green-, and red-sensitive layers.

The "interlayer effect on . . . " is an effect measured by the method described in JP-A-61-65234.

In the present invention, it is preferable that the interlayer effect on at least one color-sensitive layer present in the light-sensitive material be 1.3 or more, and it is more preferable that the interlayer effect on at least two color-sensitive layers be 1.3 or more. The interlayer effect is most preferably 1.4 or more.

Although the addition amount of spectral sensitizing dyes used in the present invention can be arbitrarily selected, it is preferably $5\times10^{-4}$ to $1\times10^{-2}$, more preferably $7\times10^{-4}$ to $7\times10^{-3}$, and most preferably $1\times10^{-3}$ to $5\times10^{-3}$ per mol of a silver halide.

The addition of spectral sensitizing dyes can be performed at any timing. For example, the addition can be performed immediately before coating, after or during chemical sensitization, simultaneously with addition of chemical sensitizers, before start of chemical sensitization, during washing, or during grain formation. The addition is preferably performed from completion of nucleation in grain formation to start of chemical sensitization.

Two or more types of sensitizing dyes can be used together. In this case, the two or more types of sensitizing dyes can be mixed and added simultaneously or added independently at different timings.

The sensitizing dyes can also be added at one time, divisionally added several times, or successively added by using, e.g., a pump.

To add the sensitizing dyes for use in the present invention to a silver halide emulsion of the present invention, they may be dispersed directly in the emulsion or added to the emulsion by dissolving into a solvent, such as water, acetone, methanol, ethanol, propanol, methylcellosolve, or phenol, or a solvent mixture of them and adding the resultant solution to the emulsion.

In addition, ultrasonic waves can be used in dissolution, and it is also preferable to add the sensitizing dyes by using the methods described in, e.g., U.S. Pat. No. 3,469,987, JP-B-46-24185, JP-B-44-23389, JP-B-44-27555, JP-B-57-22091, U.S. Pat. Nos. 3,822,135 and 4,006,025, JP-A-53-102733, JP-A-58-105141, and JP-A-51-74624.

The sensitizing dyes for use in the present invention to be added before completion of chemical sensitization can be arbitrarily selected from sensitizing dyes known to those skilled in the art. Preferably, the dyes are selected from cyanine dyes represented by Formula (1):

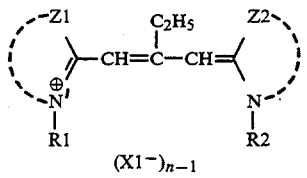

Formula (1)

Sensitizing dyes represented by Formula (1) used in the present invention will be described below.

An alkyl group represented by $R_1$ and $R_2$ is preferably a lower alkyl group, e.g., methyl, ethyl, propyl, and butyl. Examples of an anion represented by $X_1^-$ are a chloride, a bromide, thiocyanate, sulfamate, methylsulfate, and p-toluenesulfonate.

Each of Z1 and Z2 represents an atom group required to form a thiazole ring, a benzothiazole ring, a naphthothiazole ring, an oxazole ring, a benzoxazole ring, or a naphthoxazole ring.

Of compounds represented by Formula (1), particularly useful sensitizing dyes are represented by Formula (2) below:

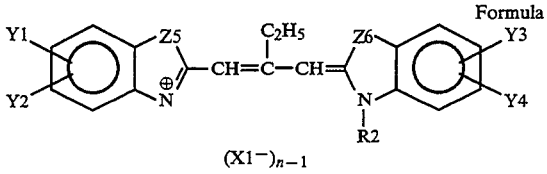

Formula (2)

wherein Z5 and Z6 may be identical or different and each represents a sulfur atom or an oxygen atom. Each of Y1, Y2, Y3, and Y4 represents a group of a hydrogen atom, a halogen atom, hydroxy, alkoxy, amino, acylamido, acyloxy, alkoxycarbonyl, alkoxycarbonylamino, alkyl, or aryl.

Y1 and Y2 and/or Y3 and Y4 may combine to form, e.g., a benzene ring. This benzene ring can have a substituent.

R1, R2, $X_1^-$, and n have the same meanings as in Formula (1).

It is preferable that in an alkyl group of at least one of R1 and R2, preferably alkyl groups of both of R1 and R2, at least one carbon atom bond to at least three atoms except for hydrogen atoms. It is also preferable that at least one of R1 and R2 be an alkyl group having an organic acid group and represented by Formula (3) below:

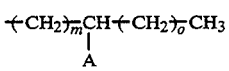

Formula (3)

wherein A represents an organic acid group, and each of m and o represents an integer from 0 to 5. Examples of the organic acid group are groups of carboxy, sulfo, and phosphoryl.

Examples of the alkyl group in which at least one carbon atom bonds to at least three atoms except for hydrogen atoms will be described below.

Examples are 2-methylpropyl, t-butyl, 2-methylbutyl, 1,1-dimethylpropyl, 3-methylbutyl, 1,2-dimethylpropyl, 2-methylpentyl, 1,1-dimethylbutyl, 1-isopropylpropyl, 3-methylpentyl, 1,2-dimethylbutyl, 1-ethyl-1-methylpropyl, 4-methylpentyl, 1,3-dimethylbutyl, 1,1-dimethylpentyl, 1-isopropylbutyl, 1,4-dimethylpentyl, 1-methylpropyl, 1-methylbutyl, 1-methylpentyl, 2-methylhexyl, 1-methyl-4,4-dimethylpentyl, 3,4,4-trimethylpentyl, 3,5,5-trimethylhexyl, 3-carboxy-1-methylpropyl, 3-carboxybutyl, 3-carboxy-1-methylbutyl, 3-carboxy-1,1-dimethylpropyl, 4-carboxy-3-methylbutyl, 2-carboxy-2-methylpropyl, 3-carboxy-2-methylpropyl, 1-methyl-3-sulfopropyl, 3-sulfobutyl, 1-methyl-3-sulfobutyl, 1,1-dimethyl-3-sulfopropyl, 2-methyl-2-sulfopropyl, and 2-methyl-3-sulfopropyl.

Of compounds represented by Formula (3), those in which m=2 or 3, o=0 or 1, and A=sulfo group are preferable. More preferably, m=2 and o=0.

Examples of a 5- or 6-membered heterocyclic ring formed by $Z_3$ or $Z_4$ are as follows.

Examples are a thiazole nucleus (e.g., thiazole, 4-methylthiazole, 4-phenylthiazole, 4,5-dimethylthiazole, and 4,5-diphenylthiazole), a benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5-hydroxy-6-methylbenzothiazole, tetrahydrobenzothiazole, 4-phenylbenzothiazole, and 5-styrylbenzothiazole), a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, and 5-methoxynaphtho[2,3-d]thiazole), a thiazoline nucleus (e.g., thiazoline, 4-methylthiazoline, and 4-nitrothiazoline), an oxazole nucleus (e.g., oxazole, 4-methyloxazole, 4-nitrooxazole, 5-methyloxazole, 4-phenyloxazole, 4,5-diphenyloxazole, and 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, and 5-ethoxybenzoxazole), and a naphthoxazole nucleus (e.g., naphtho[2,1-d]oxazole, naphtho[1,2-d]oxazole, naphtho[2,3-d]oxazole, and 5-nitronaphtho[2,1-d]oxazole).

Practical examples of compounds represented by Formulas (1) and (2) are presented below.

S-1
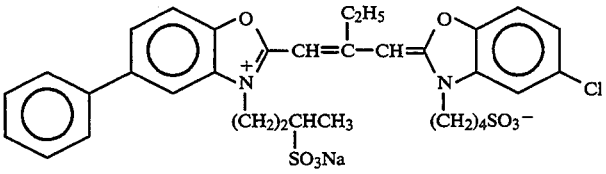
S-2
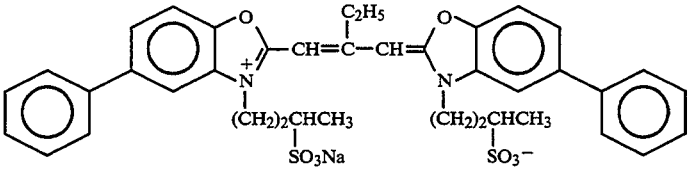
S-3
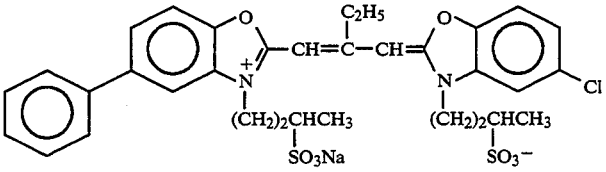
S-4
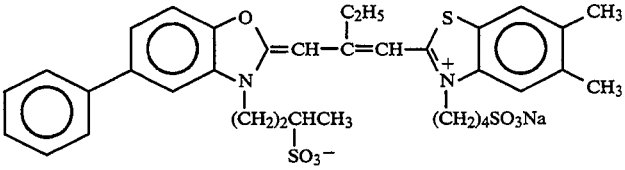
S-5
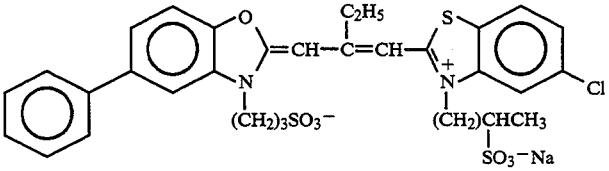
S-6
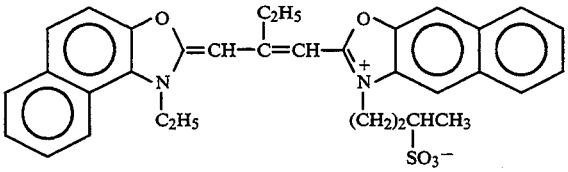
S-7
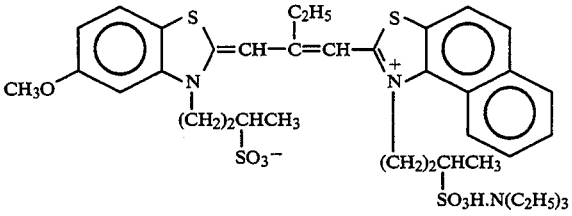
S-8
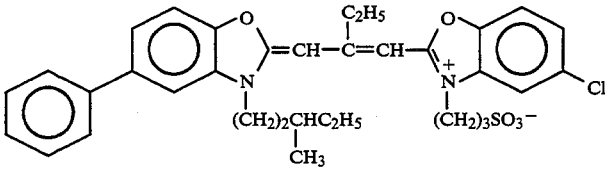

-continued
S-9
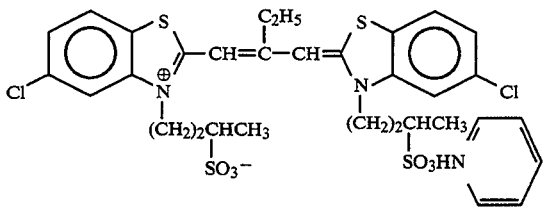
S-10
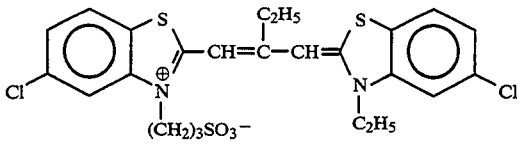
S-11
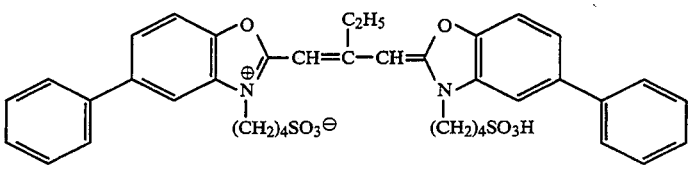
S-12
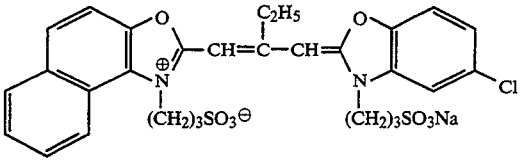
S-13
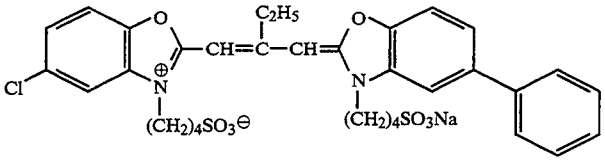
S-14
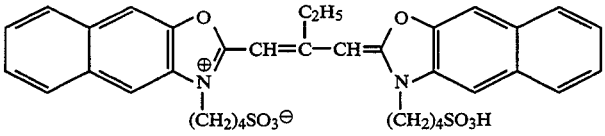
S-15
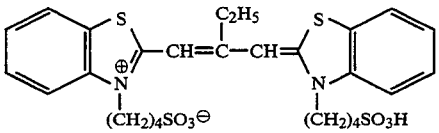
S-16
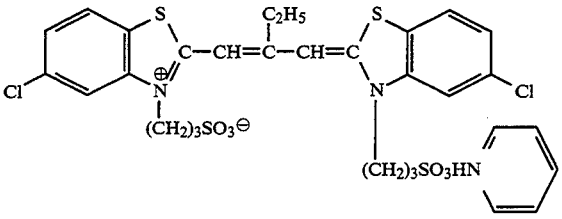
S-17
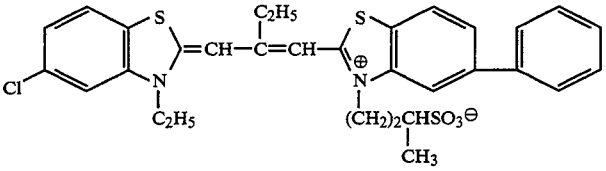

-continued

S-18

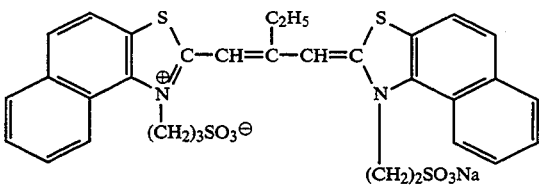

S-19

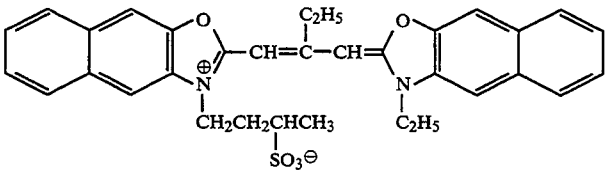

In the present invention, it is preferable to use a tabular emulsion, in which the aspect ratio of silver halide grains occupying 60% or more of the total projected area of all silver halide grains is 3 or more and more preferably, 3 or more and less than 20, in at least one negative silver halide emulsion layer.

The tabular grain literally means an emulsion having a flat outer shape. Although an emulsion having a plurality of parallel twin planes and (111) surfaces is well known to those skilled in the art, but a regular-crystal emulsion anisotropically grown having no twin planes is also known. A known example of the latter emulsion is a tabular grain with (100) faces as described in Journal of Cryst. Growth, by Migno et al., Vol. 23, p. 207 (1974).

The aspect ratio of a tabular grain means the ratio of a diameter to a thickness, i.e., a value obtained by dividing the diameter of a silver halide grain by its thickness. In this case, the diameter of a silver halide grain means that of a circle having an area equal to the projected area of that silver halide grain observed by using an optical microscope or an electron microscope.

In the present invention, the average aspect ratio of all silver halide grains contained in at least one negative silver halide emulsion layer is preferably 3 to 20, more preferably 4 to 15, and most preferably 5 to 12.

It is desirable that grains occupying 60% or more, preferably 70% or more, and most preferably 80% or more of the total projected area of all silver halide grains fall within the above range of the average aspect ratio.

The average grain size of the tabular grains used in the present invention is 0.2 to 10.0 μm, preferably 0.3 to 5.0 μm, and their average grain thickness is preferably 0.5 μm or less. More preferable tabular grains have an average grain size of 0.3 to 5.0 μm, an average grain thickness of 0.5 μm or less, and an average aspect ratio of 3.0 to 8.0, and occupy 85% or more of the total projected area of all silver halide grains in one emulsion layer.

The tabular grains used in the present invention are described in, e.g., the report by Cugnac and Chateau; Duffin, "Photographic Emulsion Chemistry" (Focal Press, New York, 1966), pp. 66 to 72; and A. P. H. Trivelli, W. F. Smith ed., "Phot. Journal" 80 (1940), p. 285. The tabular grains can be easily prepared in accordance with the methods described in, e.g., JP-A-58-113927, JP-A-58-113928, and JP-A-58-127921. For example, seed crystals in which tabular grains are present in an amount of 40 wt % or more are formed in a comparatively high pAg atmosphere with a pBr of 1.3 or less. Subsequently, the seed crystals are grown while maintaining the pBr value substantially constant and adding silver and a halogen solution simultaneously, thereby preparing tabular grains. In this grain growth process, it is desirable that silver and a halogen solution be added so as not to produce new crystal nuclei.

The size of tabular silver halide grains used in the present invention can be adjusted by controlling the temperature during nucleation and/or grain growth, by selecting the type or quality of a solvent, or by controlling the addition rates of silver salt and a halide used in the grain growth.

The grain size distribution of the tabular grains may be either wide or narrow.

Although the tabular silver halide grains used in the present invention may consist of any of silver chloride, silver bromide, silver bromochloride, silver bromoiodide, silver iodochloride, and silver bromochloroiodide, they consist of preferably silver bromoiodide, silver iodochloride, or silver bromochloroiodide, more preferably silver bromoiodide, silver iodochloride, or silver bromochloroiodide with an average silver iodide content of 3.0 mol % or more, and most preferably silver bromoiodide, silver iodochloride, or silver bromochloroiodide with an average silver iodide content of 3.0 to 30.0 mol %.

The grain structure with respect to a halogen composition of the tabular silver halide grains of the present invention may be any of a uniform structure, a double or multiple structure, and a structure in which a composition distribution is localized. However, the grain structure is preferably a double or multiple structure.

In the present invention, it is preferable to use a silver halide emulsion containing silver halide grains subjected to reduction sensitization in at least one of the negative silver halide emulsion layers.

The reduction sensitization will be described below.

The process of manufacturing a silver halide emulsion is roughly divided into steps of grain formation, desalting, chemical sensitization, and coating. The grain formation step is subdivided into nucleation, ripening, and growth. These steps are not performed in a predetermined order but performed in a reverse order or repeatedly. The reduction sensitization can be basically performed in any of these steps. That is, the reduction sensitization can be performed during nucleation or physical ripening, as the early stages of the grain formation, during growth, or prior to or after chemical sensitization. If chemical sensitization is to be performed in combination with gold sensitization, the reduction sensitization is preferably performed before the chemical sensitization so that undesired fog is not produced. Most preferably, the reduction sensitization is performed during growth of silver halide grains. This method of performing reduction sensitization during growth includes a method of performing reduction sensitization while silver halide grains are being physically ripened or being grown upon addition of water-soluble silver salt and water-soluble alkali halide, and a method of performing reduction sensitization while temporarily stopping growth and then performing growth again.

The reduction sensitization of the present invention can be selected from any of a method of adding known reducing agents to a silver halide emulsion, a method called silver ripening in which growth or ripening is performed in a low-pAg atmosphere with a pAg of 1 to 7, and a method called a high-pH ripening in which growth or ripening is performed in a high-pH atmosphere with a pH of 8 to 11. Two or more of these methods can be performed together.

The method of adding reduction sensitizers is preferable because the level of reduction sensitization can be finely controlled.

Known examples of the reduction sensitizers are stannous chloride, amines and polyamines, a hydrazine derivative, formamidinesulfinic acid, a silane compound, a borane compound, and ascorbic acid and its derivative. These known compounds can be selectively used in the present invention, or two or more types of these compounds can be used together. Preferable compounds as the reduction sensitizer are stannous chloride, thiourea dioxide, dimethylamineborane, and ascorbic acid and its derivative. Although the addition amount of these sensitizers must be so selected as to meet the emulsion preparing conditions, it is preferably $10^{-7}$ to $10^{-1}$ mol per mol of a silver halide.

The reduction sensitizers can be added by dissolving in water or a solvent, such as alcohols, glycols, ketones, esters, or amides, and adding the resultant solution during grain formation or before or after chemical sensitization. The addition can be performed at any timing during the emulsion preparing process, but it is most preferable to perform the addition during grain growth. Although the reduction sensitizers can be added to a reactor vessel in advance, it is more preferable to add them at an appropriate timing during grain formation. It is also possible to add the reduction sensitizers to an aqueous solution of water-soluble silver salt or water-soluble alkali halide and perform grain formation by using the solution. Alternatively, it is preferable to add the solution of reduction sensitizers divisionally several times or successively over a long time period as grain formation progresses.

To perform the reduction sensitization of the present invention while maintaining fog or stability, it is more preferable that the reduction sensitization be performed inside silver halide grains so that a large number of reduction sensitization specks are not present near the surface of each silver halide grain.

More specifically, the reduction sensitization can be performed inside silver halide grains by performing it during growth of the grains as described above. In addition, the following methods can be adopted in order that a large number of reduction sensitization specks are not present near the surface of each silver halide grain.

1. Do not perform reduction sensitization in the last half of growth of silver halide grains.

2. After grain formation, perform processing for reducing, preferably eliminating reduction sensitization specks near the surface of each grain. Preferably, treat the grain surface with an oxidizing agent against silver.

More specifically, for item 1 above, completely use up the added reduction sensitizers in the middle of grain formation, deactivate the reduction sensitizers remaining in the middle of grain formation by, e.g., oxidation, or essentially deactivate the reduction sensitizers remaining in the last half of grain formation by, e.g., increasing the pAg or decreasing the pH. In the case of silver ripening or high-pH ripening, increase the pHg or decrease the pH in the last half of grain formation.

For item 2 above, on the other hand, it is possible to effectively use the method of performing ripening at a high pAg and a low pH or the method of performing ripening by adding an oxidizing agent against silver. Known oxidizing agents can be used as the oxidizing agent against silver.

A preferable method is the method of performing an oxidizing treatment for the grain surface of item 2 above.

A most preferable method is to add at least one of compounds represented by Formulas (XI) to (XIII) below. Although these compounds are also effective when used in oxidizing of reduction sensitization specks after grain formation, it is surprising that even if they are used in the middle of grain growth in which reduction sensitization is performed, the reduction sensitization can be performed very effectively while maintaining, e.g., fog and stability provided that the conditions are properly selected.

$$R—SO_2S—M \qquad \text{Formula (XI)}$$

$$R—SO_2S—R^1 \qquad \text{Formula (XII)}$$

$$R—SO_2S—L_m—SSO_2—R^2 \qquad \text{Formula (XIII)}$$

wherein R, $R^1$, and $R^2$ may be identical or different and each represents an aliphatic group, an aromatic group, or a heterocyclic group, M represents a cation, L represents a divalent coupling group, and m represents 0 or 1. Compounds represented by Formulas (XI) to (XIII) may be polymers containing divalent groups derived from structures represented by Formulas (XI) to (XIII) as repeating units. If possible, R, $R^1$, $R^2$, and L may join together to form a ring.

Thiosulfonic acid-based compounds represented by Formulas (XI), (XII), and (XIII) will be described in more detail below. If each of R, $R^1$, and $R^2$ is an aliphatic group, this aliphatic group is a saturated or unsaturated and straight-chain, branched, or cyclic aliphatic hydrocarbon group, preferably an alkyl group having 1 to 22 carbon atoms, an alkenyl group having 2 to 22 carbon atoms, or an alkinyl group. These groups can have substituents. Examples of the alkyl group are methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of the alkenyl group are allyl and butenyl.

Examples of the alkinyl group are propargyl and butynyl.

An aromatic group represented by R, $R^1$, and $R^2$ includes a monocyclic or condensed-ring aromatic group, preferably that having 6 to 20 carbon atoms, for example, phenyl and naphthyl. These aromatic groups may be substituted.

A heterocyclic group represented by R, $R^1$, and $R^2$ is a 3- to 15-membered, preferably 3- to 6-membered ring having at least one element selected from nitrogen, oxygen, sulfur, selenium, and tellurium and at least one carbon atom. Examples are pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, and thiadiazole.

Examples of substituents for R, $R^1$, and $R^2$ are an alkyl group (e.g., methyl, ethyl, and hexyl), an alkoxy group (e.g., methoxy, ethoxy, and octyloxy), an aryl group (e.g., phenyl, naphthyl, and tolyl), a hydroxy group, a halogen atom (e.g., fluorine, chlorine, bromine, and iodine atoms), an aryloxy group (e.g., phenoxy), an alkylthio group (e.g., methylthio and butylthio), an arylthio group (e.g., phenylthio), an acyl group (e.g., acetyl, proptonyl, butyryl, and varelyl), a sulfonyl group (e.g., methylsulfonyl and phenylsulfonyl), an acylamino group (e.g., acetylamino and benzoylamino), a sulfonylamino group (e.g., acetoxy and benzoxy), a carboxyl group, a cyano group, a sulfo group, an amino group, an $—SO_2SM$ group (M represents a monovalent cation), and an $—SO_2{}^{R1}$ group.

A divalent coupling group represented by L is an atom or an atom group containing at least one of C, N, S, and O. Examples are alkylene, alkenylene, alkinylene, arylene, —O—, —S—, —NH—, —CO—, and $SO_2$—, and combinations of them.

L is preferably a divalent aliphatic group or a divalent aromatic group. Examples of the divalent aliphatic group represented by L are:

$$\text{-}(CH_2)_n\text{-} \quad (n = 1 \text{ to } 12),$$

$$-CH_2-CH=CH-CH_2-,$$

$$-CH_2C\equiv CCH_2-,$$

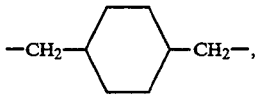

xylylene

Examples of the divalent group represented by L are phenylene and naphthylene.

These substituents can be further substituted by the substituents described so far.

M is preferably a metal ion or an organic cation. Examples of the metal ion are lithium ion, sodium ion, and potassium ion. Examples of the organic cation are ammonium ion (e.g., ammonium, tetramethylammonium, and tetrabutylammonium), phosphonium ion (e.g., tetraphenylphosphonium), and a guanidyl group.

When compounds represented by Formulas (XI) to (XIII) are polymers, examples of repeating units of the polymers are as follows.

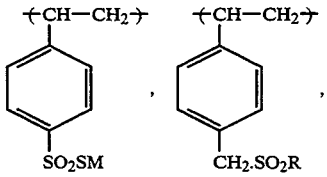

-continued

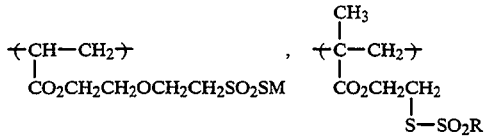

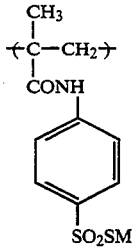

These polymers may be homopolymers or copolymers with other copolymerizing monomers.

Practical examples of compounds represented by Formulas (XI), (XII), and (XIII) are presented below, but the present invention is not limited to these examples.

$CH_3SO_2SNa$ (1-1)

$C_2H_5SO_2SNa$ (1-2)

$C_3H_7SO_2SK$ (1-3)

$C_4H_9SO_2SLi$ (1-4)

$C_6H_{13}SO_2SNa$ (1-5)

$C_8H_{17}SO_2SNa$ (1-6)

$CH_3(CH_2)_3CH(C_2H_5)CH_2SO_2S.NH_4$ (1-7)

$C_{10}H_{21}SO_2SNa$ (1-8)

$C_{12}H_{25}SO_2SNa$ (1-9)

$C_{16}H_{33}SO_2SNa$ (1-10)

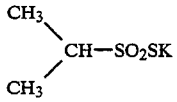

(1-11)

t-$C_4H_9SO_2SNa$ (1-12)

$CH_3OCH_2CH_2SO_2S.Na$ (1-13)

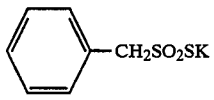

(1-14)

$CH_2=CHCH_2SO_2Na$ (1-15)

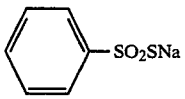

(1-16)

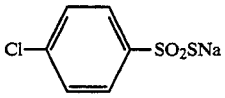

(1-17)

-continued
(1-18)
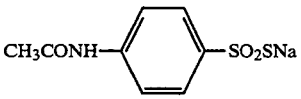
(1-19)
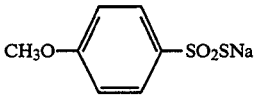
(1-20)
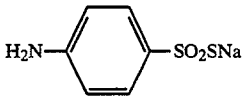
(1-21)
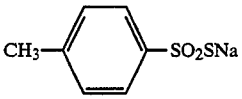
(1-22)
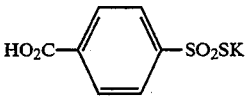
(1-23)
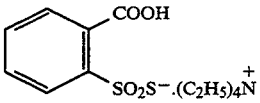
(1-24)
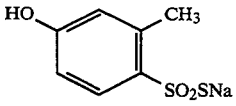
(1-25)
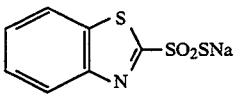
(1-26)
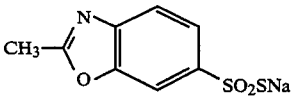
(1-27)
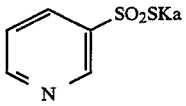
(1-28)
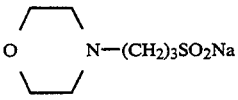
$KSSO_2(CH_2)_2SO_2SK$ (1-29)
$NaSSO_2(CH_2)_4SO_2SNa$ (1-30)
$NaSSO_2(CH_2)_4S(CH_2)_4SO_2SNa$ (1-31)
(1-32)
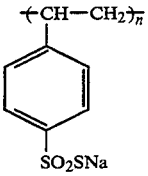
-continued
(1-33)
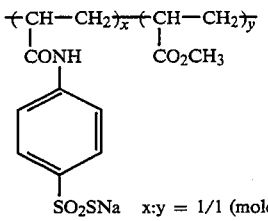
x:y = 1/1 (mole ratio)
$C_2H_5SO_2S—CH_3$ (2-1)
$C_8H_{17}SO_2SCH_2CH_3$ (2-2)
(2-3)
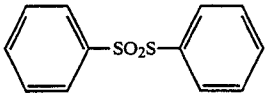
(2-4)
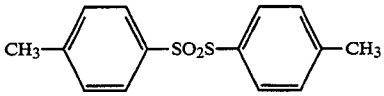
$C_2H_5SO_2SCH_2CH_2CN$ (2-5)
(2-6)
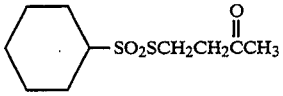
(2-7)
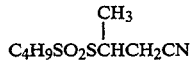
(2-8)
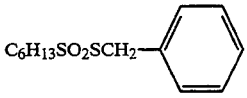
(2-9)
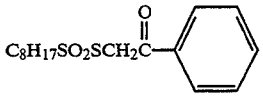
(2-10)
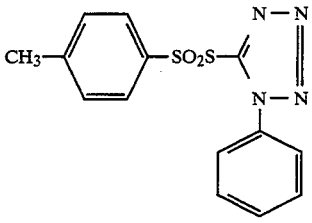
(2-11)
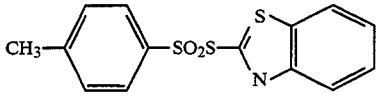
(2-12)
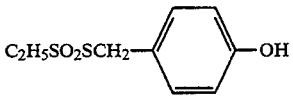
(2-13)
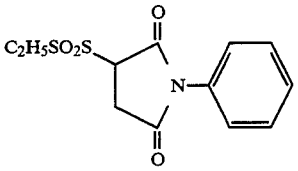

-continued (2-14)

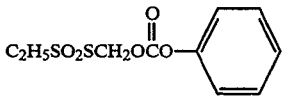

(2-15)

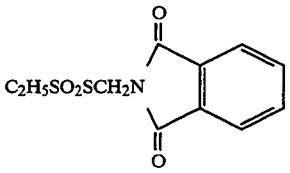

(2-16)

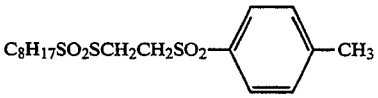

(2-17)

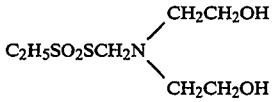

(2-18)

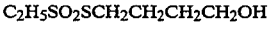

(2-19)

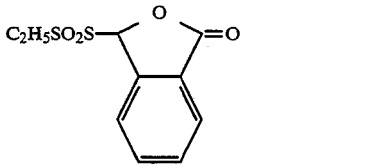

(2-20)

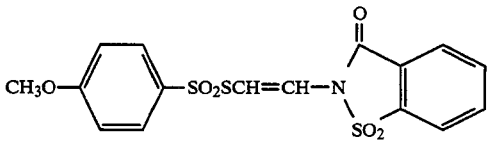

(2-21)

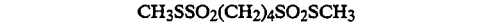

(2-22)

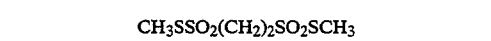

(2-23)

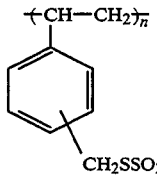

(2-24)

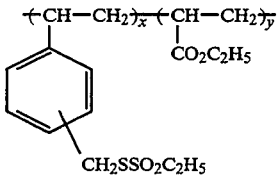

x:y = 2/1 (mole ratio)

(2-25)

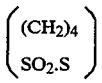

(3-1)

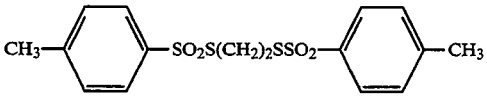

(3-2)

-continued (3-3)

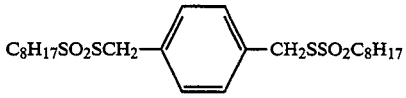

(3-4)

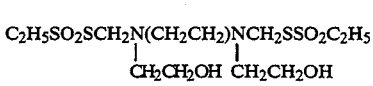

(3-5)

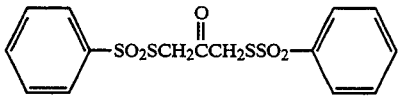

(3-6)

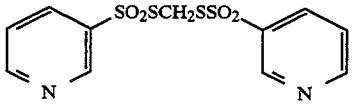

(3-7)

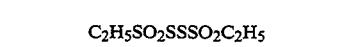

(3-8)

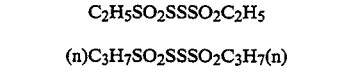

(3-9)

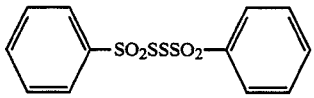

Compounds represented by Formulas (XI), (XII), and (XIII) can be readily synthesized by the methods described in or cited in JP-A-54-1019; British Patent 972,211; Journal of Organic Chemistry, vol. 53, p. 396 (1988) and Chemical Abstracts, Vol. 59, 9776e.

A compound represented by Formula (XI), (XII), or (XIII) is added in an amount of preferably $10^{-7}$ to $10^{-1}$, more preferably $10^{-6}$ to $10^{-2}$, and most preferably $10^{-5}$ to $10^{-3}$ mol/molAg per mol of a silver halide.

To add compounds represented by Formulas (XI) to (XIII) during the manufacturing process, methods commonly used in adding additives in photographic emulsions can be applied. For example, water-soluble compounds can be added in the form of aqueous solutions at appropriate densities, and compounds which are insoluble or sparingly soluble in water can be added in the from of solutions by dissolving in organic solvents, which are miscible with water and have no adverse effects on photographic properties, such as alcohols, glycols, ketones, esters, and amides.

Compounds represented by Formulas (XI), (XII), and (XIII) can be added at any timing during the manufacture; i.e., during grain formation of a silver halide emulsion, or before or after chemical sensitization. The compounds are preferably added before or during reduction sensitization, and most preferably during grain growth.

Although the compounds can be placed in a reactor vessel in advance, they are preferably added at an appropriate timing during grain formation. Alternatively, grain formation may be performed by using an aqueous solution prepared by dissolving compounds represented by Formulas (XI) to (XIII) in an aqueous solution of water-soluble silver salt or water-soluble alkali halide. It is also possible to add compounds represented by Formulas (XI) to (XIII) divisionally several times or successively over a long time period as grain formation progresses.

The most preferable compound for the present invention is a compound represented by Formula (XI).

As a means for improving color reproduction of a negative-type silver halide color photographic light-sensitive material, a method of using yellow-colored cyan couplers or magenta-colored cyan couplers is conventionally well known to those skilled in the art. Although these couplers are mainly used to correct an unnecessary absorption of color dyes, they are sometimes used to obtain a so-called masking effect in order to improve color reproduction. In either case, these couplers function to change the color densities of emulsion layers having color sensitivities different from that of an emulsion layer to which they are added. In such an arrangement, if the stability of a latent image of a layer to which colored couplers are added is poor, not only that layer but also layers whose color densities are affected by the colored couplers are influenced by the change in the latent image, and this increases the usefulness of the present invention. In addition, the methods of using yellow-colored cyan couplers are described in, e.g., EP 423,727A, EP 436,938A, and EP 435,334A. The use of these couplers also further improves color reproduction. Consequently, the degradation in photographic performance caused by the change in latent image is emphasized as described above, and this further increases the usefulness of the present invention.

Yellow-colored magenta couplers for use in the present invention are preferably represented by Formula (MI) below.

A colored-magenta coupler represented by Formula (MI) will be described below:

Formula (MI)

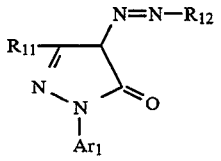

wherein $Ar_1$ represents a substituted or nonsubstituted phenyl group, $R_{11}$ represents a substituent, and $R_{12}$ represents an aromatic group or a heterocyclic group.

Details of preferable substituents will be described below.

$Ar_1$ represents a substituted or nonsubstituted phenyl group, and examples of the substituent are an alkyl group (e.g., methyl and ethyl), an alkoxy group (e.g., methoxy and ethoxy), an aryloxy group (e.g., phenyloxy), an alkoxycarbonyl group (e.g., methoxycarbonyl), an acylamino group (e.g., acetylamino), a carbamoyl group, an alkylcarbamoyl group (e.g., methylcarbamoyl and ethylcarbamoyl), a dialkylcarbamoyl group (e.g., dimethylcarbamoyl), an arylcarbamoyl group (e.g., phenylcarbamoyl), an alkylsulfonyl group (e.g., methylsulfonyl), an arylsulfonyl group (e.g., phenylsulfonyl), an alkylsulfonamido group (e.g., methanesulfonamido), an arylsulfonamido group (e.g., phenylsulfonamido, a sulfamoyl group, an alkylsulfamoyl group (e.g., ethylsulfamoyl), a dialkylsulfamoyl group (e.g., dimethylsulfamoyl), an alkylthio group (e.g., methylthio), an arylthio group (e.g., phenylthio), a cyano group, a nitro group, and a halogen atom (e.g., fluorine, chlorine, and bromine atoms). If two or more of these substituents are present, they may be identical or different.

Most preferable substituents are a halogen atom, an alkyl group, an alkoxy group, an alkoxycarbonyl group, and a cyano group.

In Formula (MI), $R_{11}$ represents a hydrogen atom, a straight-chain or branched alkyl, alkenyl, cyclic alkyl, aralkyl, or cyclic alkenyl group (these groups may have the substituents enumerated above for $Ar_1$) having 1 to 32, preferably 1 to 22 carbon atoms, an aryl group or a heterocyclic group (these groups may have the substituents enumerated above for $Ar_1$), an alkoxycarbonyl group (e.g., methoxycarbonyl, ethoxycarbonyl, and stearyloxycarbonyl), an aryloxycarbonyl group (e.g., phenoxycarbonyl and naphthoxycarbonyl), an aralkyloxycarbonyl group (e.g., benzyloxycarbonyl), an alkoxy group (e.g., methoxy, ethoxy, and heptadecyloxy), an aryloxy group (e.g., phenoxy and tolyloxy), an alkylthio group (e.g., ethylthio and dodecylthio), an arylthio group (e.g., phenylthio and α-naphthylthio), a carboxy group, an acylamino group (e.g., acetylamino, 3-[(2,4-di-tert-amylphenoxy)acetamido]benzamide), a diacylamino group, an N-alkylacylamino group (e.g., N-methylpropioneamido), an N-arylacylamino group (e.g., N-phenylacetamido), a ureido group (e.g., ureido, N-arylureido, and N-alkylureido), a urethane group, a thiourethane group, an arylamino group (e.g., phenylamino, N-methylanilino, diphenylamino, N-acetylanilino, and 2-chloro-5-tetradecaneamidoanilino), an alkylamino group (e.g., n-butylamino, methylamino, and cyclohexylamino), a cycloamino group (e.g., piperidino and pyrrolidino), a heterocyclic amino group (e.g., 4-pyridylamino and 2-benzoxazolylamino), an alkylcarbonyl group (e.g., methylcarbonyl), an arylcarbonyl group (e.g., phenylcarbonyl), a sulfonamio group (e.g., alkylsulfonamido and arylsulfonamido), a carbamoyl group (e.g., ethylcarbamoyl, dimethylcarbamoyl, N-methylphenylcarbamoyl, and N-phenylcarbamoyl), a sulfamoyl group (e.g., N-alkylsulfamoyl, N,N-dialkylsulfamoyl, N-arylsulfamoyl, N-alkyl-N-arylsulfamoyl, and N,N-diarylsulfamoyl), a cyano group, a hydroxy group, a mercapto group, a halogen atom, or a sulfo group.

In formula (MI), it is most preferable that $R_{11}$ be an anilino group, an acylamino group, or an arylureido group and $Ar_1$ be an aryl group in which at least one ortho position is substituted by an atom except for an hydrogen atom.

If $R_{12}$ represents an aromatic group in Formula (MI), this aromatic group is preferably a group of phenyl or α- or β-naphthyl. Preferable examples of substituents other than hydroxyl or carboxyl are groups of alkyl, alkenyl, cyclic alkyl, aralkyl, cyclic alkenyl, a halogen atom, alkoxy, aryloxy, acylamino, nitro, cyano, aryl, alkoxycarbonyl, aryloxycarbonyl, sulfo, sulfamoyl, carbamoyl, diacylamino, ureido, urethane, sulfonamido, a heterocyclic ring, arylsulfonyl, alkylsulfonyl, arylthio, alkylthio, dialkylamino, aniline, alkylamino, diphenylamino, N-acylanilino, sulfamoylamino, heterocyclic oxy, and acyloxy.

If $R_{12}$ represents a heterocyclic group, this heterocyclic group is a 4- to 7-membered heterocyclic group having at least one hetero atom selected from a nitrogen atom, an oxygen atom, and a sulfur atom, or a condensed heterocyclic group of it. Examples are pyridyl, quinolyl, furyl, imidazolyl, 1,2,4-triazolyl, pyrazolyl, thiadiazolyl, oxadiazolyl, and benzoimidazolyl. These groups can have the substituents enumerated above for the case wherein $R_{12}$ represents an aromatic group.

The most preferable example of $R_{12}$ is a phenyl group having at least one hydroxyl group as a substituent. This phenyl group may further have the substituents enumerated above for the case wherein $R_{12}$ represents an aromatic group as a substituent other than a hydroxyl group.

Preferable examples of the yellow-colored magenta coupler are presented below, but the present invention is not limited to these examples.

YM-1

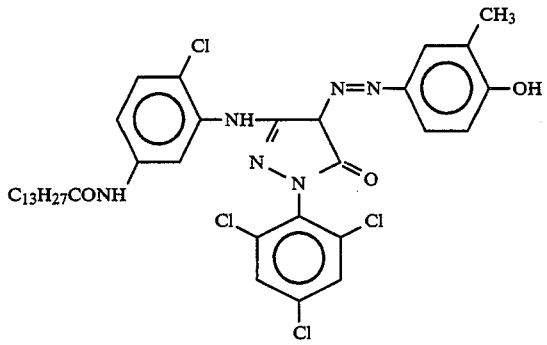

YM-2

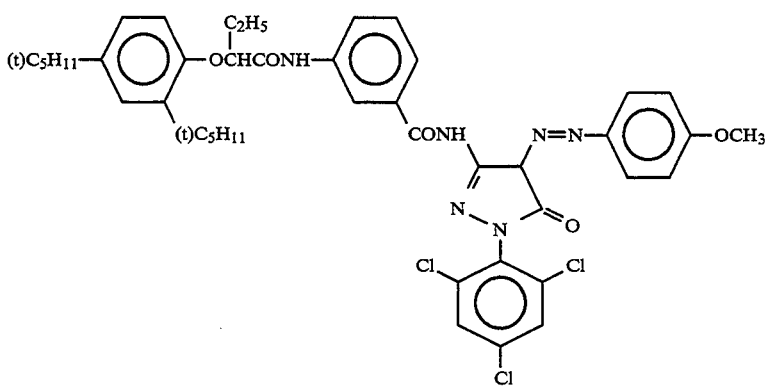

YM-3

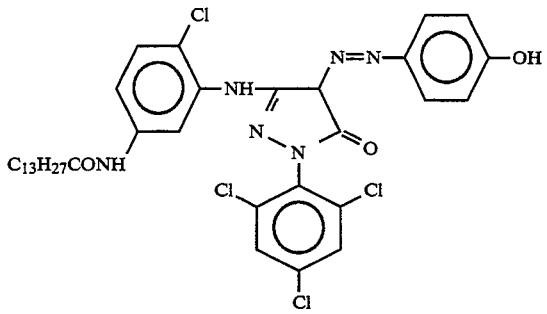

YM-4

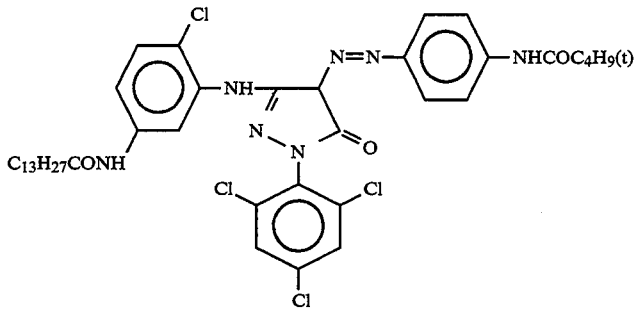

-continued
YM-5
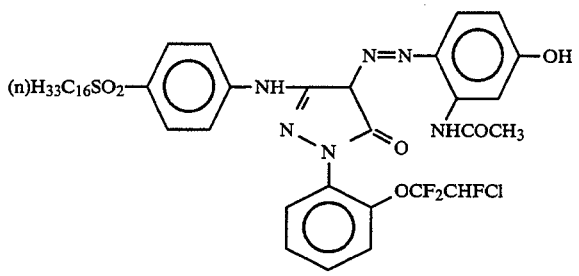
YM-6
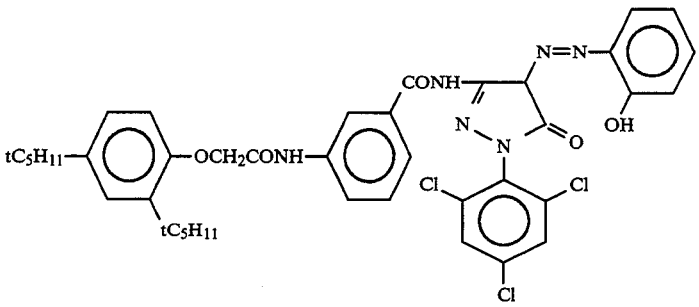
YM-7
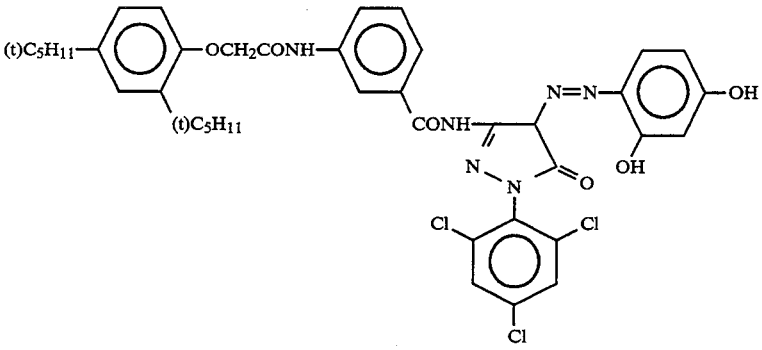
YM-8
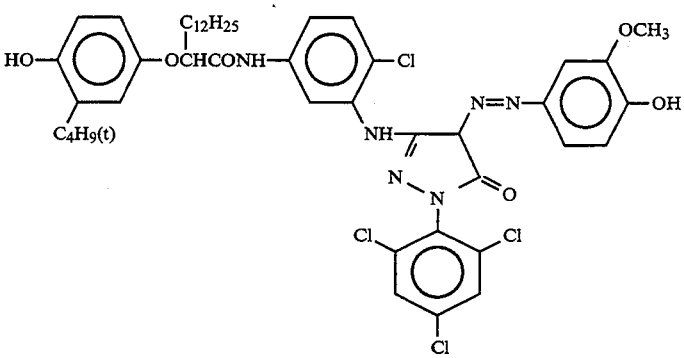
YM-9
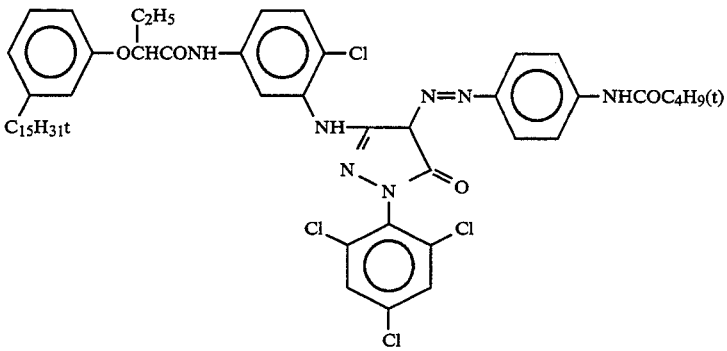

-continued
YM-10
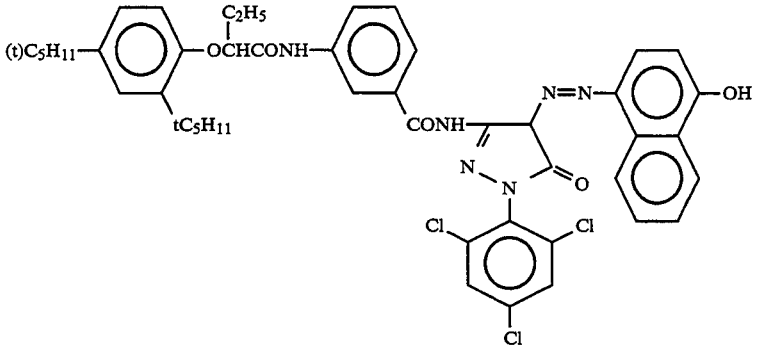
YM-11
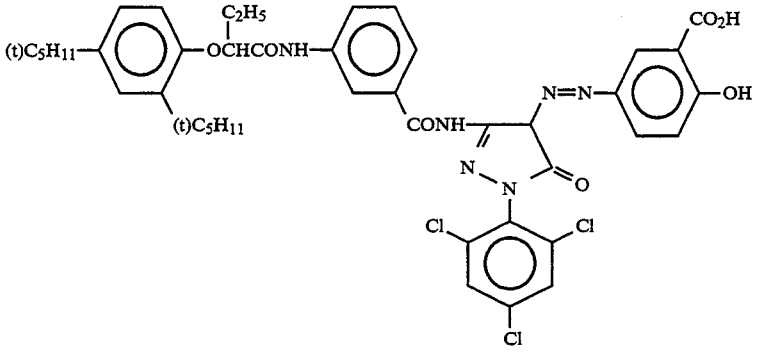
YM-12
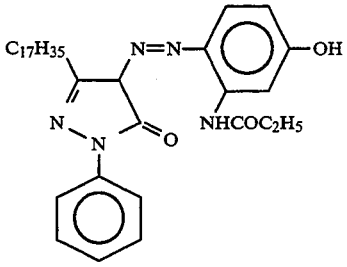
YM-13
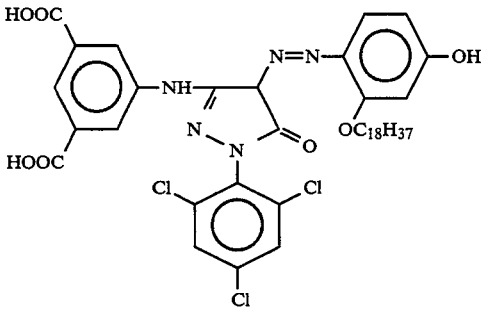
YM-14
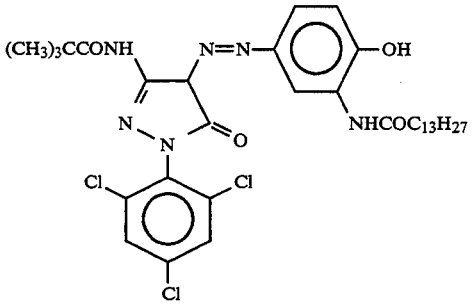

-continued
YM-15
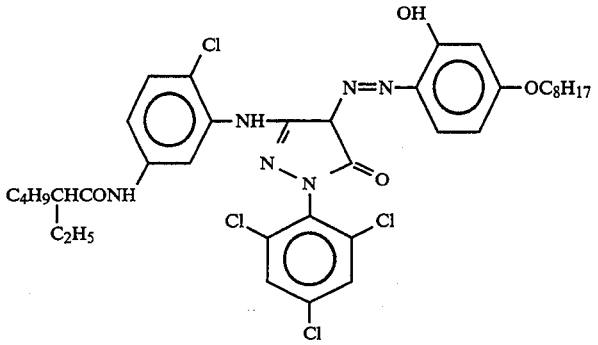
YM-16
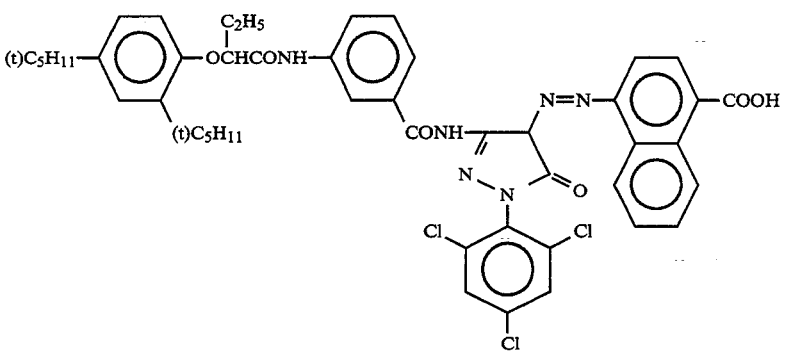
YM-17
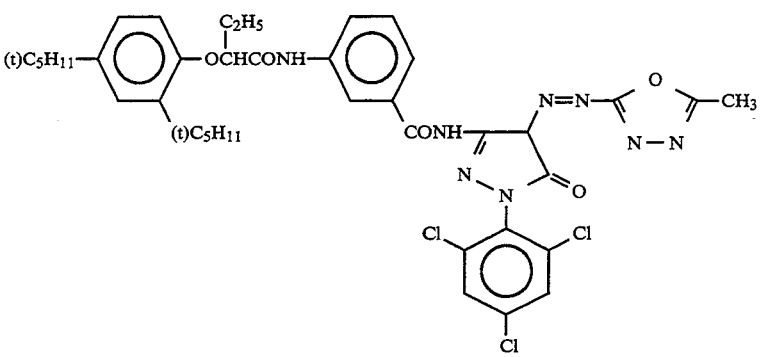
YM-18
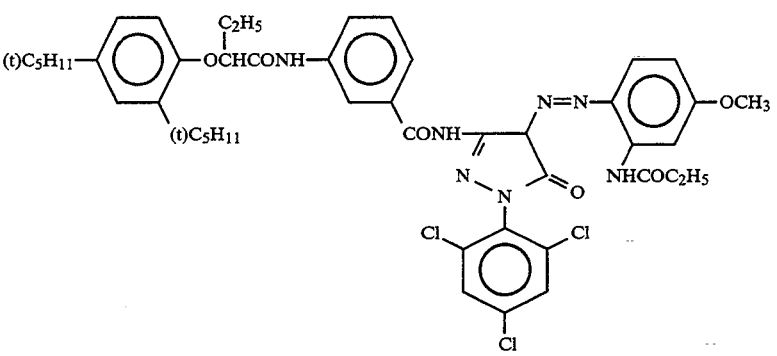

-continued

YM-19

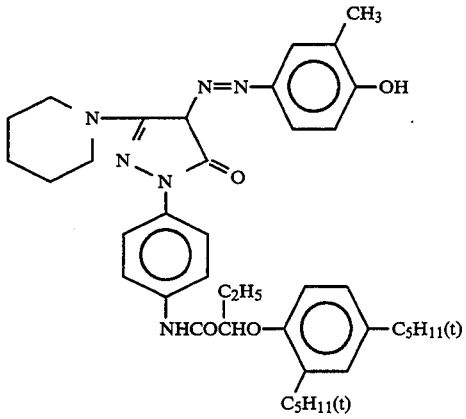

YM-20

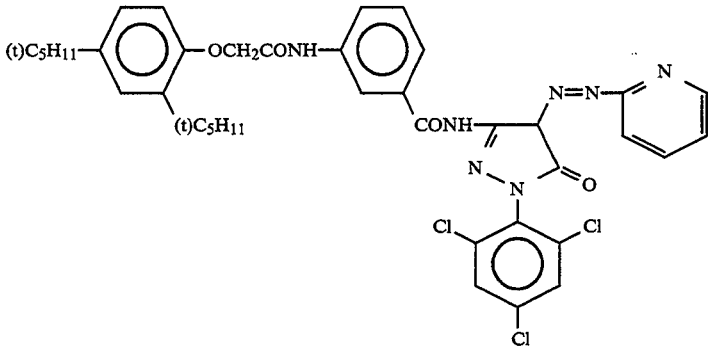

YM-21

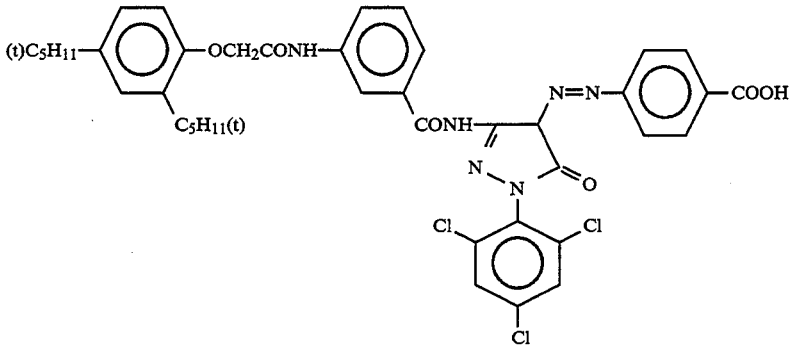

These colored couplers are described in, e.g., JP-A-61-189538.

The total addition amount of yellow-colored mazenta couplers to the light-sensitive material is preferably 0.005 to 0.40 g/m$^2$, and more preferably 0.01 to 0.02 g/m$^2$.

The yellow-colored magenta couplers of the present invention are generally used in combination with magenta couplers in green-sensitive emulsion layers in order to correct secondary absorption of the magenta couplers, but the present invention is not particularly limited to this use. Also, two or more types of the yellow-colored magenta couplers of the present invention can be used together.

As the magenta-colored cyan couplers used in the present invention, compounds represented by Formulas (CI) and (CII) below are preferably used.

Formula (CI)

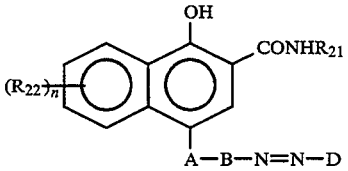

wherein $R_{21}$ represents an aromatic group or a heterocyclic group, and $R_{22}$ represents a group substitutable on a naphthol ring. A—B—N=N—D represents a coupling split-off group, A represents a divalent group which cleaves the bond with a carbon atom at the coupling active position of a coupler represented by Formula (CI) upon a reaction between the coupler and the oxidized form of a color developing agent, B represents a divalent aromatic or heterocyclic group, and D represents an aromatic group or a heterocyclic group. n represents an integer from 0 to 4.

Note that at least one of the groups represented by A, B, and D in Formula (CI) has as its substituent a sulfo group or a carboxyl group, or alkali metal salt, ammonium salt, alkylamine salt, or pyridinium salt of these groups. With this water-soluble group, the coupling split-off group represented by A—B—N=N—D flows into a developer after split off from the coupler moiety.

An example of the aromatic group represented by $R_{21}$ is a substituted or nonsubstituted aromatic group having 6 to 30 carbon atoms. An example of the heterocyclic group is a substituted or nonsubstituted heterocyclic group having 2 to 30 carbon atoms. The hetero atom contained in the heterocyclic ring is, e.g., N, O, S, or Se. The heterocyclic group is preferably an unsaturated heterocyclic ring containing nitrogen.

$R_{22}$ represents a group (including an atom; the same shall apply hereinafter) substitutable on a naphthol ring. Examples are groups of a halogen atom, hydroxy, amino, carboxyl, sulfo, cyano, an aromatic group, a heterocyclic ring, carbonamido, sulfonamido, carbamoyl, sulfamoyl, ureido, acyl, acyloxy, aliphatic oxy, aromatic oxy, aliphatic thio, aromatic thio, aliphatic sulfonyl, aromatic sulfonyl, sulfamoylamido, nitro, and imido. The number of carbon atoms contained in $R_{22}$ is 0 to 30. Two $R_{22}$'s may combine to form a ring. An example of cyclic $R_{22}$ is a dioxymethylene group. In this case, an aliphatic group means an aliphatic hydrocarbon group including alkyl, alkenyl, and alkinyl groups, which may have ordinary substituents.

Formula (CII)

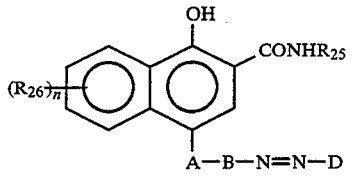

wherein $R_{25}$ represents an aliphatic group or a alicyclic group, $R_{26}$ represents a group substitutable on a naphthol ring, and n represents an integer from 0 to 4. A—B—N=N—D represents a coupling split-off group similar to that explained for Formula (CI).

Practical examples of magenta-colored cyan couplers represented by Formulas (CI) and (CII) are presented below.

CI-1

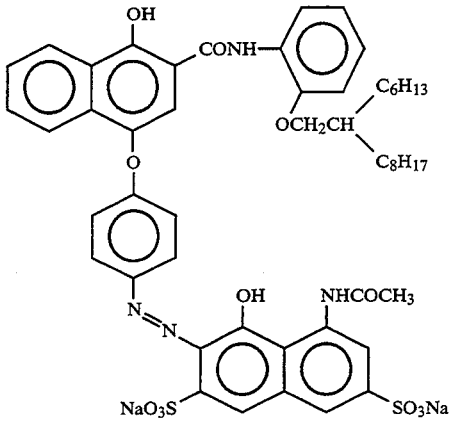

CI-2

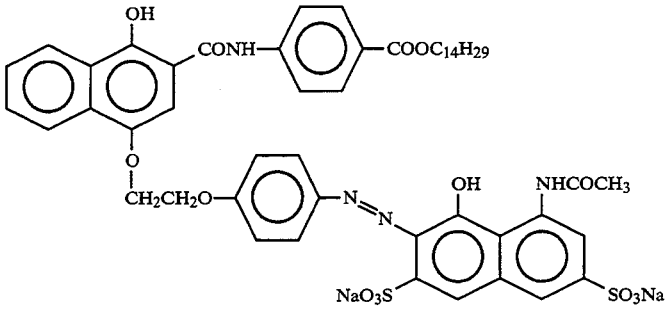

-continued
CI-3
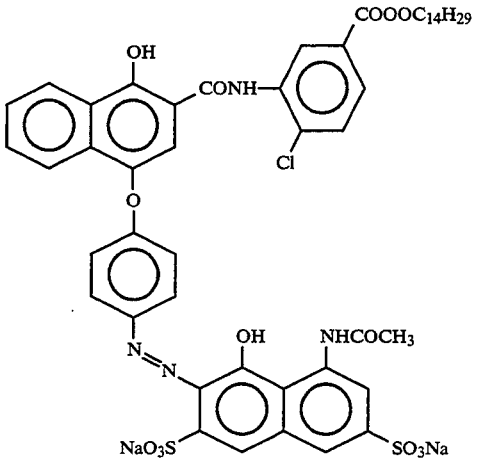
CI-4
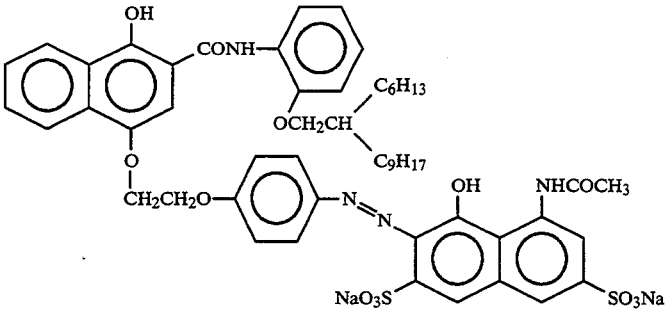
CI-5
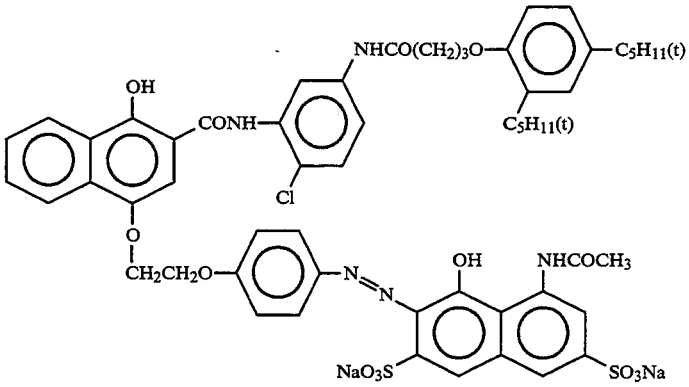
CI-6
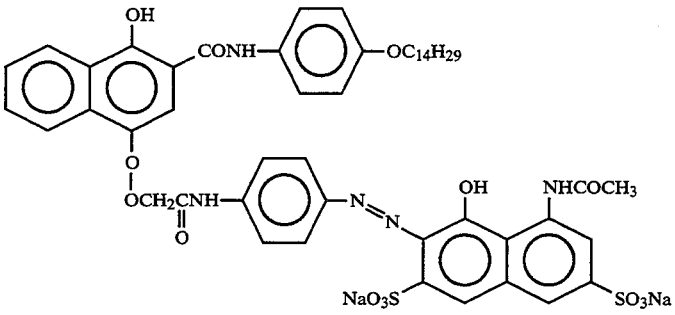

-continued
CI-7
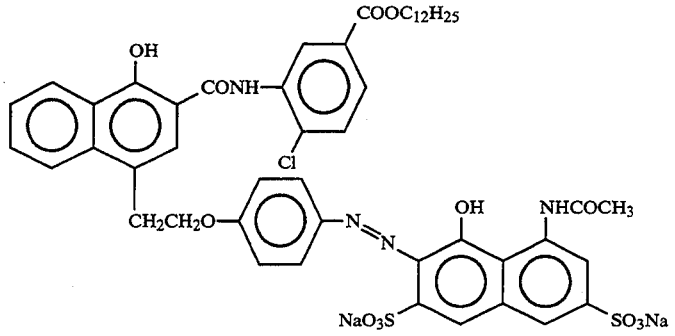
CI-8
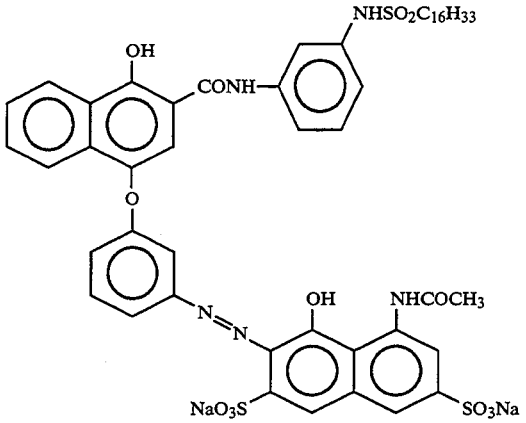
CI-9
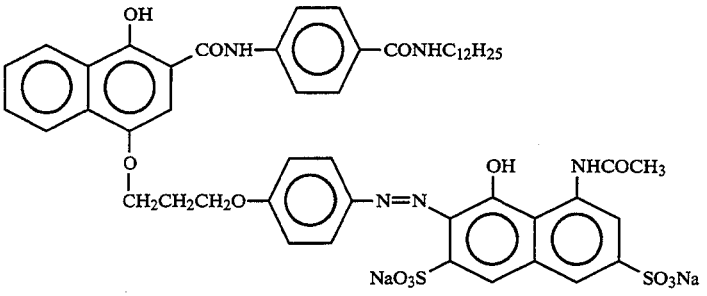
CI-10
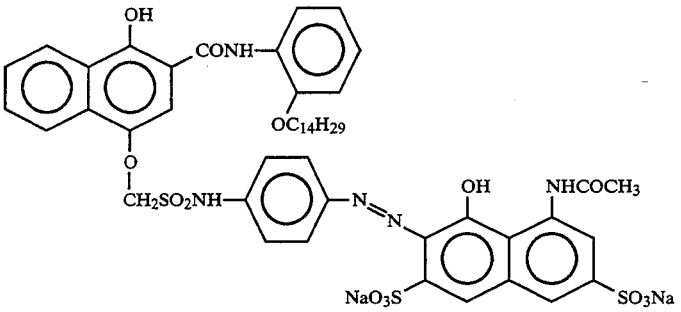

-continued
CI-11
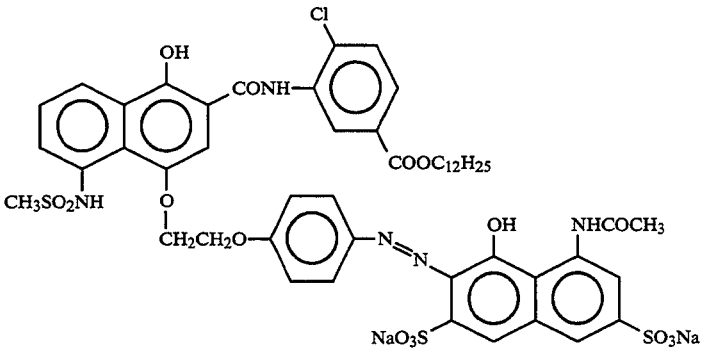
CI-12
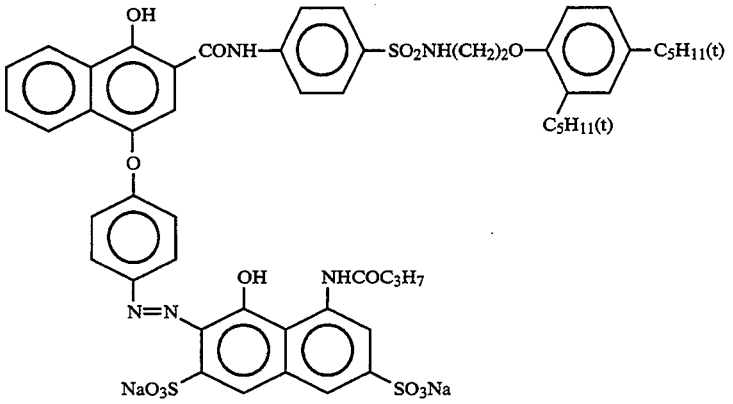
CI-13
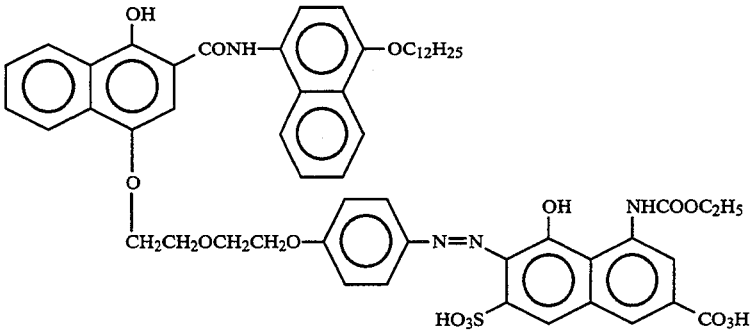
CI-14
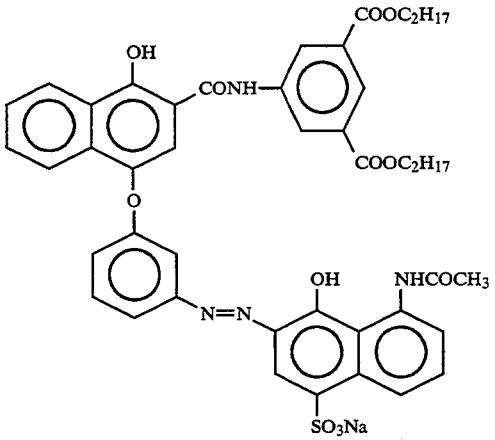

-continued
CI-15
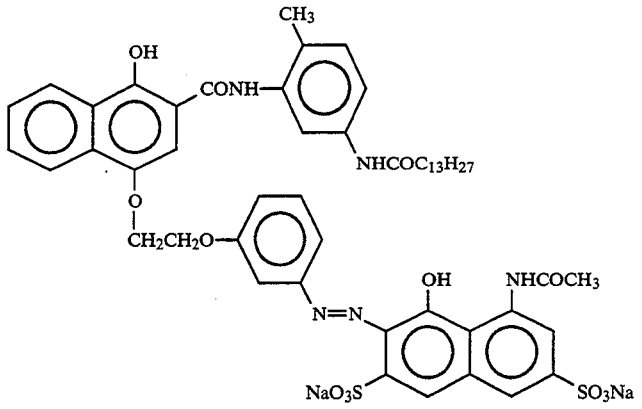
CI-16
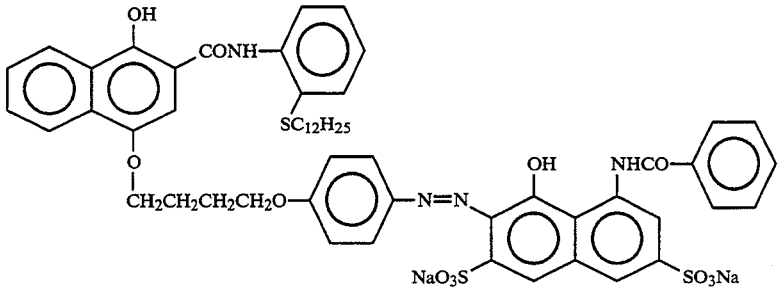
CI-17
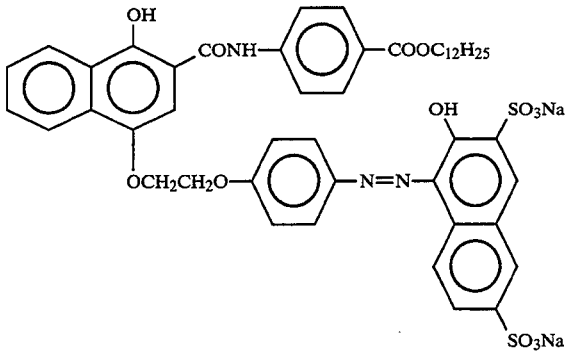
CI-18
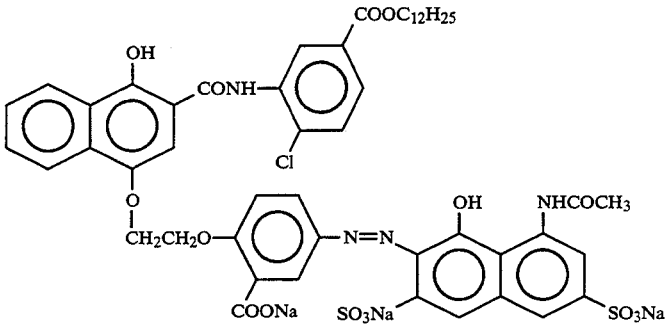

-continued
CI-19
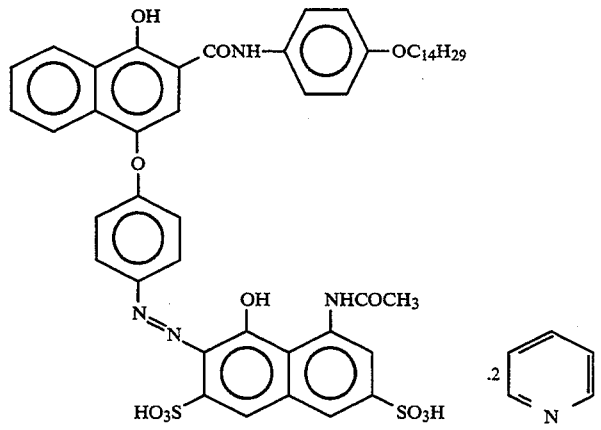
CI-20
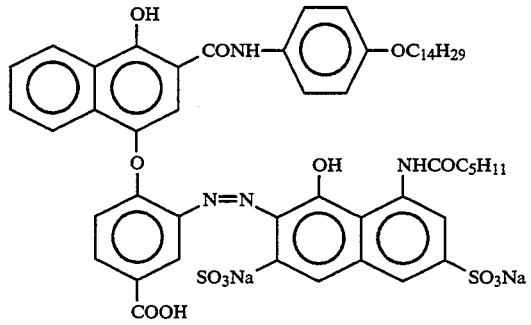
CI-21
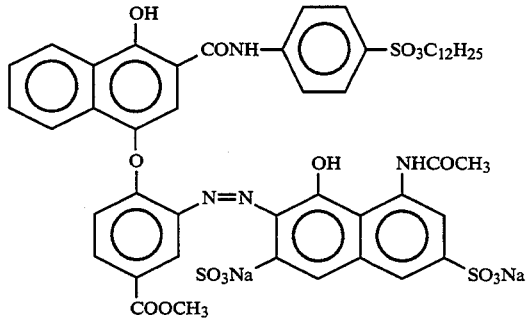
CI-22
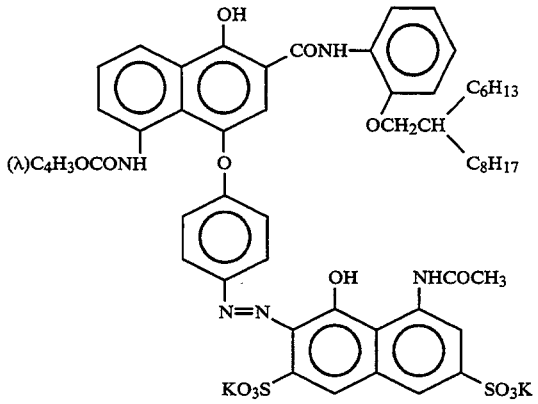

-continued
CI-23
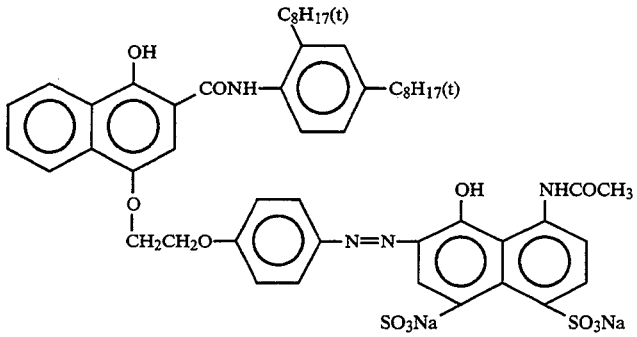
CI-24
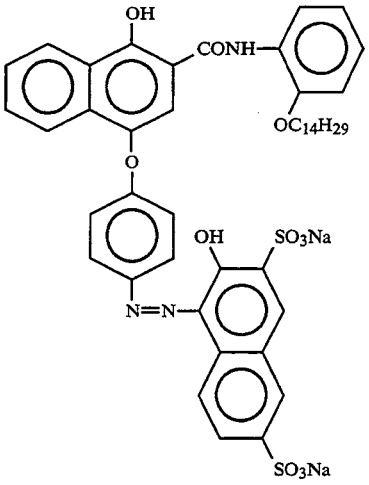
CI-25
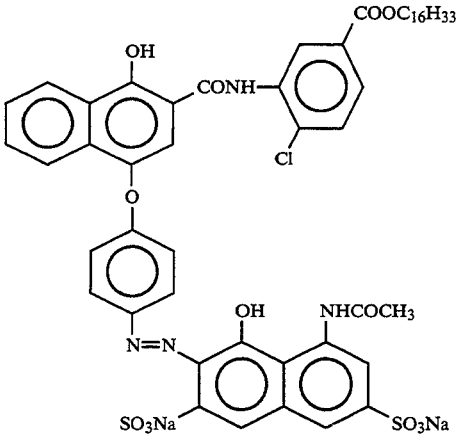
CI-26
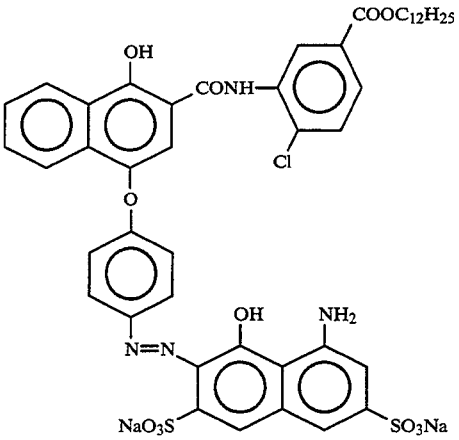

-continued
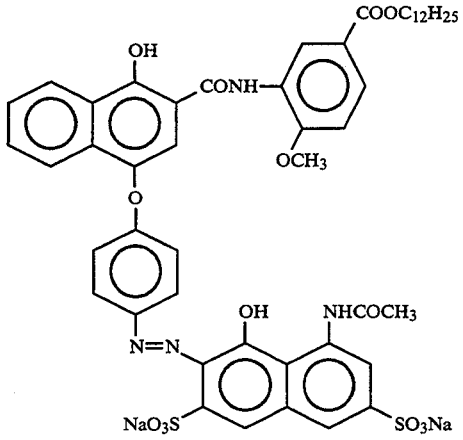
CI-27
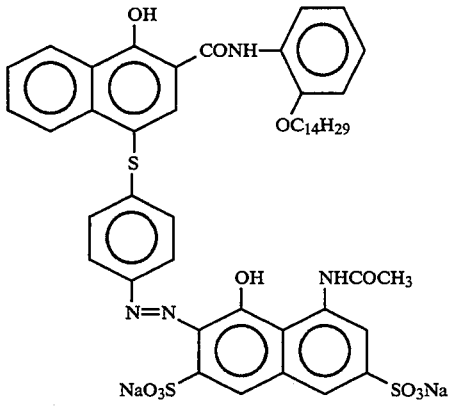
CI-28
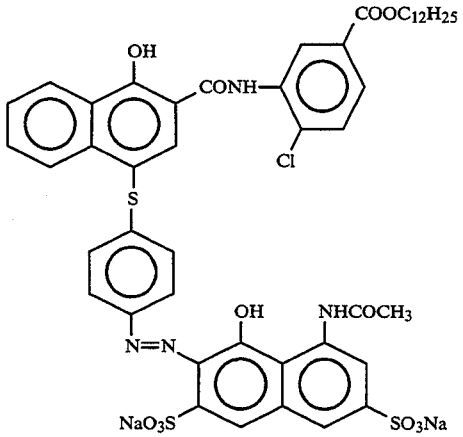
CI-29

-continued
CII-1
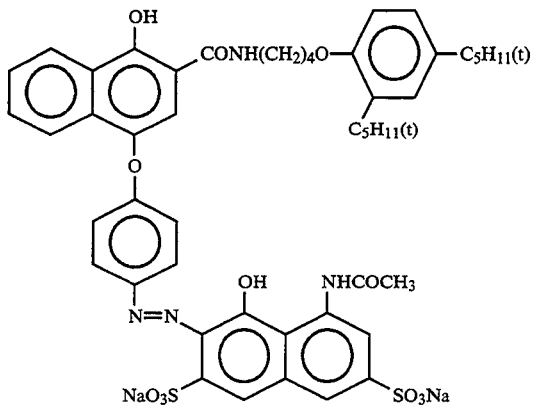
CII-2
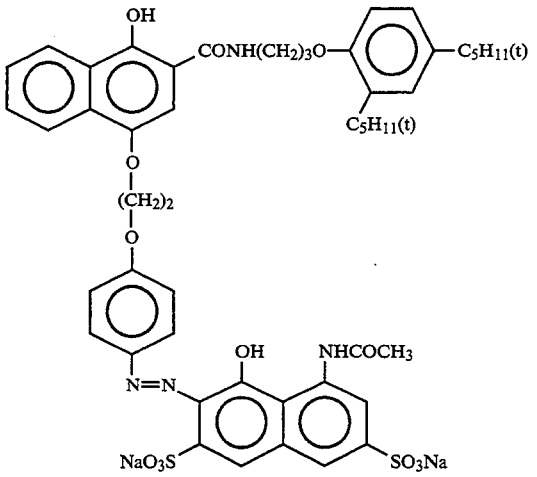
CII-3
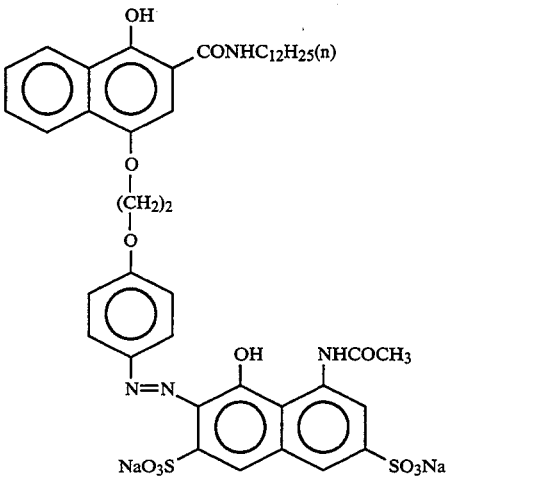

-continued
CII-4
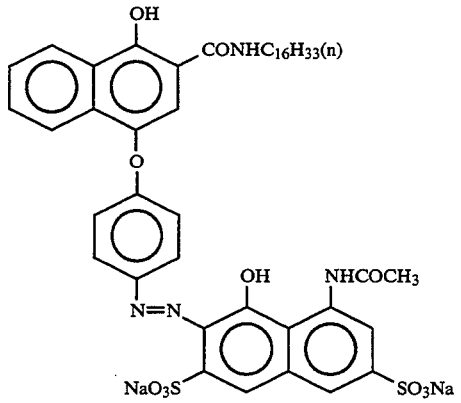
CII-5
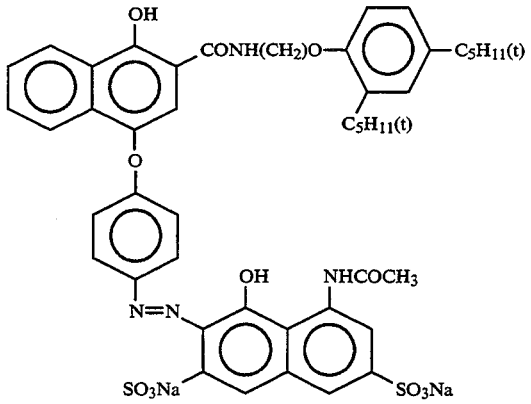
CII-6
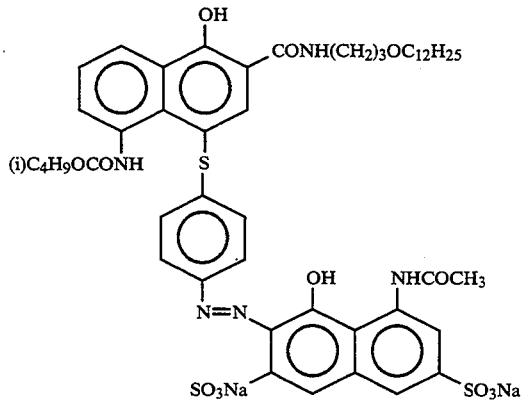
CII-7
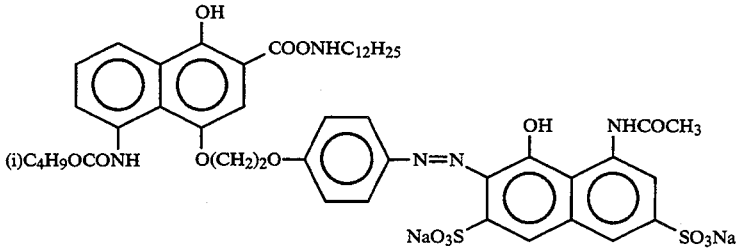

-continued
CII-8
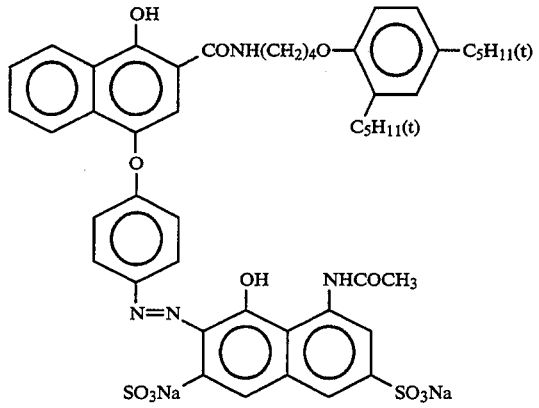
CII-9
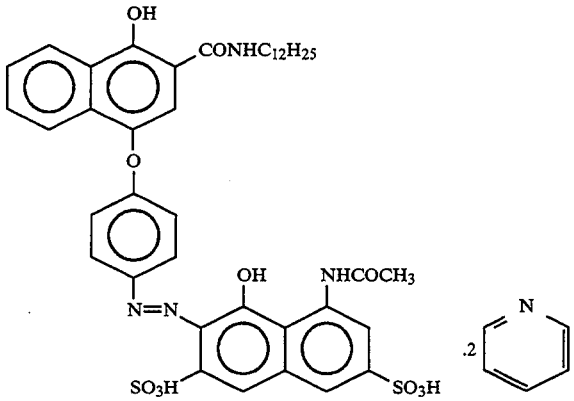
CII-10
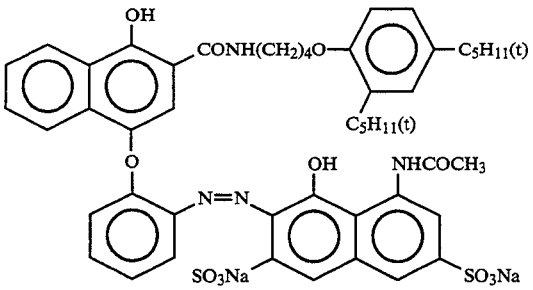
CII-11
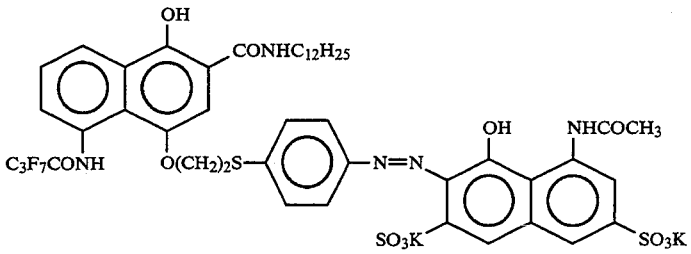

-continued

CII-12

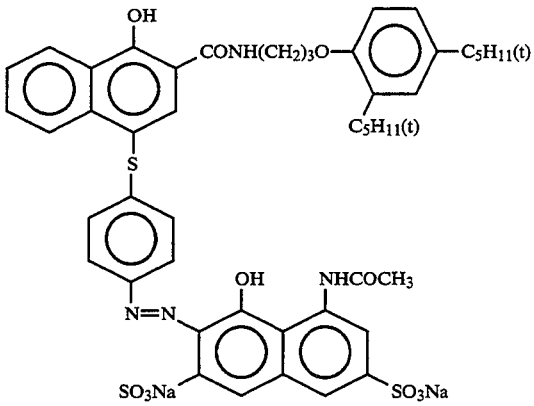

CII-13

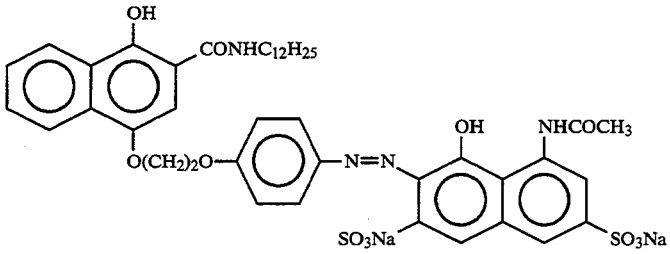

Couplers represented by Formula (CI) are described in, e.g., JP-A-63-23152, and those represented by Formulas (CII) are described in, e.g., U.S. Pat. Nos. 4,004,929, 4,138,258, and 1,146,368.

The total addition amount of mazenta-colored cyan couplers to the light-sensitive material is preferably 0.005 to 0.40 g/m$^2$, and more preferably 0.01 to 0.20 g/m$^2$.

Although these magenta-colored cyan couplers are generally used together with cyan couplers In red-sensitive emulsion layers in order to correct secondary absorption of the cyan couplers, the present invention is not particularly limited to this use. In addition, two or more types of the magenta-colored cyan couplers of the present invention can be used together.

Yellow-colored cyan couplers preferably used in the present invention will be described below.

In the present invention, the yellow-colored cyan coupler means a cyan coupler which has an absorption peak between 400 nm and 500 nm in a visible absorption region of the coupler and couples with the oxidized form of an aromatic primary amine developing agent to form a cyan dye having an absorption peak between 630 nm and 750 nm in the visible absorption region.

Of the yellow-colored cyan couplers of the present invention, it is preferable to use a cyan coupler capable of releasing, upon the coupling reaction with the oxidized form of an aromatic primary amine developing agent, a compound moiety containing a water-soluble 6-hydroxy-2-pyridone-5-ylazo group, a water-soluble pyrazolone-4-ylazo group, a water-soluble 5-aminopyrazole-4-ylazo group, a water-soluble 2-acylaminophenylazo group, or a water-soluble 2-sulfonamidophenylazo group.

The yellow-colored cyan couplers of the present invention are preferably represented by Formulas (YCI) to (YCIV) below:

Formula (YCI)

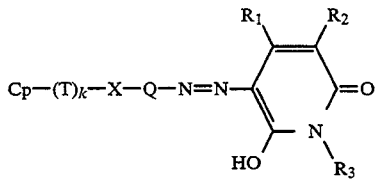

Formula (YCII)

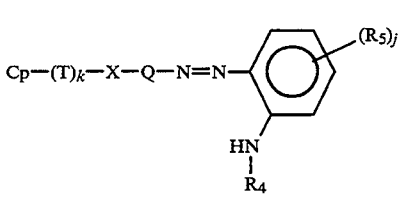

Formula (YCIII)

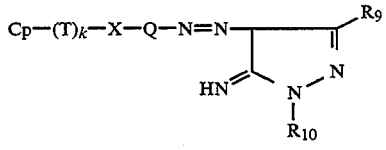

Formula (YCIV)

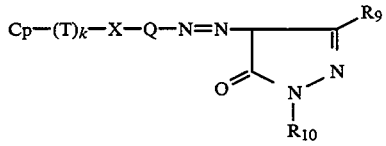

In Formulas (YCI) to (YCIV), Cp represents a cyan coupler moiety (T combines with its coupling position), T represents a timing group, k represents an integer of 0 or 1, X represents a divalent coupling group which contains N, 0, or S and combines with $(T)_k$ via N, O, or S to couple with Q, and Q represents an arylene group or a divalent heterocyclic group.

In Formula (YCI), each of $R_1$ and $R_2$ independently represents a group of a hydrogen atom, carboxyl, sulfo, cyano, alkyl, cycloalkyl, aryl, a heterocyclic ring, carbamoyl, sulfamoyl, carbonamido, sulfonamido, or alkylsulfonyl, and $R_3$ represents a group of a hydrogen atom, alkyl, cycloalkyl, aryl, or a heterocyclic ring. Note that at least one of T, X, Q, $R_1$, $R_2$, and $R_3$ contains a water-soluble group (e.g., hydroxyl, carboxyl, sulfo, amino, ammoniumyl, phosphono, phosphino, and hydroxylsulfonyloxy).

It is a common sense that the following group in Formula (YCI):

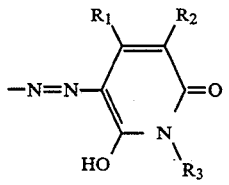

can take tautomer structures as illustrated below.

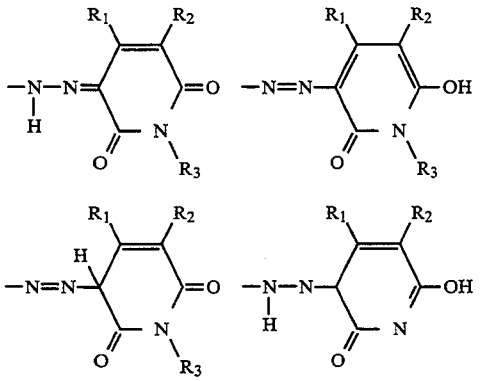

(when $R_3$ represents hydrogen atom)

For example,

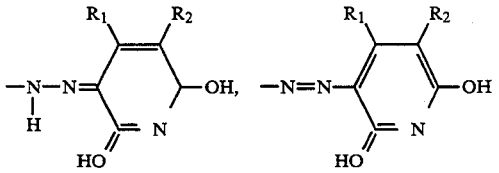

(when $R_3$ represents hydrogen atom) (when $R_3$ represents hydrogen atom)

and

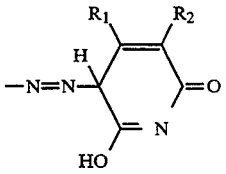

(When $R_3$ represents hydrogen atom)

Therefore, these tautomer structures are included in structures defined by Formula (YCI) of the present invention.

In Formula (YCII), $R_4$ represents acyl or sulfonyl, $R_5$ represents a substitutable group, and j represents an integer from 0 to 4. If j is an integer of 2 or more, a plurality of $R_4$'s may be identical or different. Note that at least one of T, X, Q, $R_4$, and $R_5$ contains a water-soluble group (e.g., hydroxyl, carboxyl, sulfo, phosphono, phosphino, hydroxysulfonyloxy, amino, and ammoniumyl).

In Formulas (YCIII) and (YCIV), $R_9$ represents a group of a hydrogen atom, carboxyl, sulfo, cyano, alkyl, cycloalkyl, aryl, alkoxy, cycloalkyloxy, aryloxy, a heterocyclic ring, carbamoyl, sulfamoyl, carbonamido, sulfonamido, or alkylsulfonyl, and $R_{10}$ represents a group of a hydrogen atom, alkyl, cycloalkyl, aryl, or a heterocyclic ring. Note that at least one of T, X, Q, $R_9$, and $R_{10}$ contains a water-soluble group (e.g., hydroxyl, carboxyl, sulfo, phosphono, phosphino, hydroxysulfonyloxy, amino, and ammoniumyl). Note that groups illustrated below are in the relationship of a tautomer and therefore represent the same group.

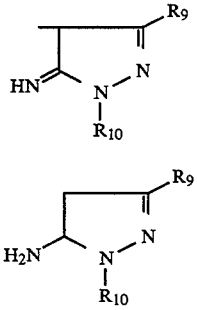

Compounds represented by Formulas (YCI) to (YCIV) will be described in more detail below.

Examples of the coupler moiety represented by Cp are known cyan coupler moieties (e.g., phenol-based and naphthol-based coupler moieties).

The timing group represented by T is a group which cleaves the bond with X after the bond with Cp is cleaved upon a coupling reaction between a coupler and the oxidized form of an aromatic primary amine developing agent. This timing group is used for various purposes such as adjustment of the coupling reactivity, stabilization of the coupler, and control of the release timing of x. Examples of the timing group are known groups represented by Formulas (T-1) to (T-7) below. In the following groups, $R_{41}$ represents an aliphatic group, an aromatic group, or a heterocyclic group, each of $R_{43}$, $R_{44}$, and $R_{45}$ represents a hydrogen atom, an aliphatic group, an aromatic group, or a heterocyclic group, and symbols * and ** combine with Cp and X, respectively, or combine with Cp and Q, respectively:

(T-1)

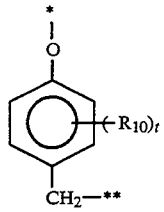

(T-2)

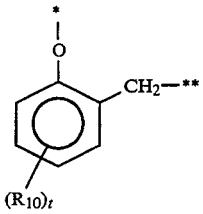

-continued (T-3)

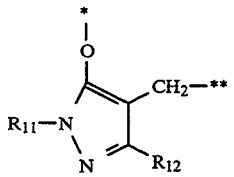

(T-4)

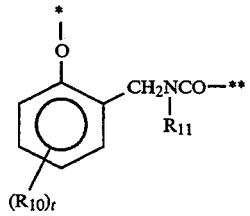

(T-5)

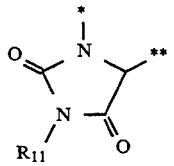

*—$OCH_2$—* (T-6)

(T-7)

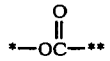

wherein $R_{10}$ represents a group substitutable on a benzene ring, $R_{11}$ has the same meanings as $R_{41}$, $R_{12}$ represents a hydrogen atom or a substituent, and t represents an integer from 0 to 4. Examples of the substituents for $R_{10}$ and $R_{12}$ are $R_{41}$, a halogen atom, $R_{43}O$—, $R_{43}S$—, $R_{43}(R_{44})NCO$—, $R_{43}OOC$—, $R_{43}SO_2$—, $R_{43}(R_{44})NSO_2$—, $R_{43}CON(R_{43})$—, $R_{41}SO_2N(R_{43})$—, —$R_{43}CO$—, $R_{41}COO$—, $R_{41}SO$—, nitro, $R_{43}(R_{44})NCON(R_{45})$—, cyano, $R_{41}OCON(R_{43})$—, $R_{43}OSO_2$—, $R_{43}(R_{44})N$—, $R_{43}(R_{44})NSO_2N(R_{45})$—, and groups shown below:

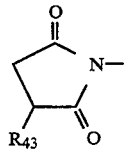

k represents an integer of 0 or 1. In general, it is preferable that k be 0, i.e., Cp combine directly with X.

X is a divalent coupling group which combines with $(T)_k$—by N, O, or S. Preferable examples of X are —O—, —S—, —OCO—, —OCOO—, —OCOS—, —OCONH—, —$SO_2$—, and —$OSO_2NH$—; heterocyclic groups which combine with Cp—(T)k— by N (e.g., groups derived from pyrrolidine, piperidine, morpholine, piperazine, pyrrole, pyrazole, imidazole, 1,2,4-triazole, benzotriazole, succlnimide, phthalimide, oxazolidine-2,4-dione, imidazolidine-2,4-dione, and 1,2,4-triazolidine-3,5-dione); and coupling groups which are composite groups of the above groups with an alkylene group (e.g., methylene, ethylene, and propylene), a cylcoalkylene group (e.g., 1,4-cyclohexylene), an arylene group (e.g., o-phenylene and p-phenylene), a divalent heterocyclic group (e.g., groups derived from pyridine and thiophene), —CO—, —$SO_2$—, —COO—, —CONH—, —$SO_2NH$—, —$SO_{20}$—, —NHCO—, —$NHSO_2$—, —NHCONH—, —$NHSO_2NH$—, and —NHCOO—. X is more preferably represented by Formula (I) below:

*—X1—$(L—X_2)_m$—** Formula (I)

wherein a symbol * represents the bonding position with $(T)_k$, a symbol ** represents the bonding position with Q, $X_1$ represents —O— or —S—, L represents an alkylene group, $X_2$ represents a single bond, —O—, —S—, —CO—, —$SO_2$—, —OCO—, —COO—, —NHCO—, —CONH—, —$SO_2NH$—, —$NHSO_2$—, —$SO_{20}$—, —$OSO_2$—, —OCOO—, —OCONH—, —NHCOO—, —NHCONH—, —$NHSO_2NH$—, —OCOS—, —SCOO—, —$OSO_2NH$—, or —NH-$SO_{20}$—, and m represents an integer from 0 to 3. The total number of carbon atoms (to be referred to as the C number hereinafter) of X is preferably 0 to 12, and more preferably 0 to 8. X is most preferably —$OCH_2CH_2O$—.

Q represents an arylene group or a divalent heterocyclic group. If Q is an arylene group, this arylene group may be a condensed ring or have a substituent (e.g., a halogen atom, hydroxyl, carboxyl, sulfo, nitro, cyano, amino, ammonium, phosphono, phosphino, alkyl, cycloalkyl, aryl, carbonamido, sulfonamido, alkoxy, aryloxy, acyl, sulfonyl, carboxyl, carbamoyl, and sulfamoyl), and its C number is preferably 6 to 15, and more preferably 6 to 10. If Q is a divalent heterocyclic group, this heterocyclic group is a 3- to 8-membered, preferably 5- to 7-membered monocyclic or condensed-ring heterocyclic group (e.g., a group derived from pyridine, thiophene, furan, pyrrole, pyrazole, imidazole, thiazole, oxazole, benzothiazole, benzoxazole, benzofuran, benzothiophene, 1,3,4-thiadiazole, indole, and quinoline) which contains at least one hetero atom selected from N, O, S, P, Se, and Te in its ring and may have a substituent (identical with the substituents when Q is an arylene group), and its C number is preferably 2 to 15, and more preferably 2 to 10. Q is most preferably 1,4-phenylene.

In the present invention, therefore, the most preferable —$(T)_k$—X—Q— is —$OCH_2CH_2$—O—(1,4-phenylene)—.

If $R_1$, $R_2$, or $R_3$ is an alkyl group, this alkyl group may be either straight-chain or branched, may contain an unsaturated bond, and may have a substituent (e.g., a halogen atom, hydroxyl, carboxyl, sulfo, phosphono, phosphino, cyano, alkoxy, aryl, alkoxycarbonyl, amino, ammoniumyl, acyl, carbonamido, sulfonamido, carbamoyl, sulfamoyl, and sulfonyl).

If $R_1$, $R_2$, or $R_3$ is a cycloalkyl group, this cycloalkyl group is a 3- to 8-membered cycloalkyl group which may have a bridge bonding, may contain an unsaturated bond, and may have a substituent (identical with the substituents when $R_1$, $R_2$, or $R_3$ is an alkyl group).

If $R_1$, $R_2$, or $R_3$ is an aryl group, this aryl group may be a condensed ring and may have a substituent (e.g., alkyl and cycloalkyl in addition to the substituents when $R_1$, $R_2$, or $R_3$ is an alkyl group).

If $R_1$, R2, or $R_3$ is a heterocyclic group, this heterocyclic group is a 3- to 8-membered (preferably 5-to 8-membered) monocyclic or condensed-ring heterocyclic group (e.g., imidazolyl, thienyl, pyrazolyl, thiazolyl, pyridyl, and quinolinyl) containing at least one hetero atom selected from N, S, O, R, Se, and Te in its ring, which may have a substituent (identical with the substituents when $R_1$, $R_2$, or $R_3$ is an aryl group).

In this case, carboxyl, sulfo, phosphino, and phosphono may include carboxylate, sulfonate, phosphihate, and phosphonate, respectively, and pairing ions at that time are, for example, $Li^+$, $Na^+$, $K^+$, and ammonium.

$R_1$ is preferably a hydrogen atom, a carboxyl group, an alkyl group having a C number of 1 to 10 (e.g., methyl, t-butyl, carbomethyl, 2-sulfomethyl, carboxymethyl, 2-carboxymethyl, 2-hydroxymethyl, benzyl, ethyl, and isopropyl), or an aryl group having a C number of 6 to 12 (e.g., phenyl, 4-methoxyphenyl, and 4-sulfophenyl), and most preferably a hydrogen atom, a methyl group, or a carboxyl group.

$R_2$ is preferably a cyano group, a carboxyl group, a carbamoyl group having a C number of 1 to 10, a sulfamoyl group having a C number of 0 to 10, a sulfo group, an alkyl group having a C number of 1 to 10 (e.g., methyl and sulfomethyl), a sulfonyl group having a C number of 1 to 10 (e.g., methylsulfonyl and phenylsulfonyl), a carbonamido group having a C number of 1 to 10 (e.g., acetamido and benzamido), or a sulfonamido group having a C number of 1 to 10 (e.g., methanesulfonamido and toluenesulfonamido), and most preferably a cyano group, a carbamoyl group, or a carboxyl group.

$R_3$ is preferably a hydrogen atom, an alkyl group having a C number of 1 to 12 (e.g., methyl, sulfomethyl, carboxymethyl, 2-sulfomethyl, 2-carboxymethyl, ethyl, n-butyl, benzyl, and 4-sulfobenzyl), or an aryl group having a C number of 6 to 15 (e.g., phenyl, 4-carboxyphenyl, 3-carboxyphenyl, 4-methoxyphenyl, 2,4-dicarboxyphenyl, 2-sulfophenyl, 3-sulfophenyl, 4-sulfophenyl, 2,4-disulfophenyl, and 2,5-disulfophenyl), and more preferably an alkyl group having a C number of 1 to 7 or an aryl group having a C number of 6 to 10.

Practical examples of $R_4$ are an acyl group represented by Formula (II) and a sulfonyl group represented by Formula (III):

$R_{11}CO—$ Formula (II)

$R_{11}SO_2—$ Formula (III)

If $R_{11}$ is an alkyl group, this alkyl group may be either straight-chain or branched, may contain an unsaturated bond, and may have a substituent (e.g., a halogen atom, hydroxyl, carboxyl, sulfo, phosphono, phosphino, cyano, alkoxy, aryl, alkoxycarbonyl, amino, ammoniumyl, acyl, carbonamido, sulfonamido, carbamoyl, sulfamoyl, and sulfonyl).

If $R_{11}$ is a cycloalkyl group, this cycloalkyl group is a 3- to 8-membered cycloalkyl group which may have a bridge bonding, an unsaturated bond, and a substituent (identical with the substituents when $R_{11}$ is an alkyl group).

If $R_{11}$ is an aryl group, this aryl group may be a condensed ring and have a substituent (e.g., alkyl and cycloalkyl in addition to the substituents when $R_{11}$ is an alkyl group).

If $R_{11}$ is a heterocyclic group, this heterocyclic group is a 3- to 8-membered (preferably 5- to 7-membered) monocyclic or condensed-ring heterocyclic group (e.g., imidazolyl, thienyl, pyrazolyl, thiazolyl, pyridyl, and quinolinyl) containing at least one hetero atom selected from N, S, O, R, Se, and Te, which may have a substituent (identical with the substituents when $R_{11}$ is an aryl group).

In this case, carboxyl, sulfo, phosphino, and phosphono may include carboxylate, sulfonate, phosphihate, and phosphonate, respectively, and pairing ions at that time are, for example, $Li^+$, $Na^+$, $K^+$, and ammonium.

$R_{11}$ is preferably an alkyl group having a C number of 1 to 10 (e.g., methyl, carboxymethyl, sulfoethyl, and cyanoethyl), a cycloalkyl group having a C number of 5 to 8 (e.g., cyclohexyl and 2-carboxycyclohexyl), or an aryl group having a C number of 6 to 10 (e.g., phenyl, 1-naphthyl, and 4-sulfophenyl), and most preferably an alkyl group having a C number of 1 to 3 or an aryl group having a C number of 6.

$R_5$ is a substitutable group, preferably an electron donor group, and most preferably $—NR_{12}R_{13}$ or $—OR_{14}$. The substitution position is preferably the 4-position. Each of $R_{12}$, $R_{13}$, and $R_{14}$ is a hydrogen atom, an alkyl group, a cycloalkyl group, an aryl group, or a heterocyclic group. A ring may be formed between $R_{12}$ and $R_{13}$, and an alicyclic ring is preferable as the nitrogen containing hetero ring formed.

If $R_9$ or $R_{10}$ is an alkyl group, this alkyl group may be either straight-chain or branched, may contain an unsaturated bond, and may have a substituent (e.g., a halogen atom, hydroxyl, carboxyl, sulfo, phosphono, phosphino, cyano, alkoxy, aryl, alkoxycarbonyl, amino, ammoniumyl, acyl, carbonamido, sulfonamido, carbamoyl, sulfamoyl, and sulfonyl).

If $R_9$ or $R_{10}$ is a cycloalkyl group, this cycloalkyl group is a 3- to 8-membered cycloalkyl group which may have a bridge bonding, an unsaturated bond, and a substituent (identical with the substituents when $R_9$ or $R_{10}$ is an alkyl group).

If $R_9$ or $R_{10}$ is an aryl group, this aryl group may be a condensed ring and have a substituent (e.g., alkyl and cycloalkyl in addition to the substituents when $R_9$ or $R_{10}$ is an alkyl group).

If $R_9$ or $R_{10}$ is a heterocyclic group, this heterocyclic group is a 3- to 8-membered (preferably 5- to 7-membered) monocyclic or condensed-ring heterocyclic group (e.g., imidazolyl, thienyl, pyrazolyl, thiazolyl, pyridyl, and quinolinyl) containing at least one hetero atom selected from N, S, O, P, Se, or Te in its ring, which may have a substituent (identical with the substituents when $R_9$ or $R_{10}$ is an aryl group).

In this case, carboxyl, sulfo, phosphino, and phosphono may include carboxylate, sulfonate, phosphihate, and phosphonate, respectively, and pairing ions at that time are, for example, $Li^+$, $Na^+$, $K^+$, and ammonium.

$R_9$ is preferably a cyano group, a carboxyl group, a carbamoyl group having a C number of 1 to 10, an alkoxycarbonyl group having a C number of 2 to 10, an aryloxycarbonyl group having a C number of 7 to 11, a sulfamoyl group having a C number of 0 to 10, a sulfo group, an alkyl group having a C number of 1 to 10 (e.g., methyl, carboxymethyl, and sulfomethyl), a sulfonyl group having a C number of 1 to 10 (e.g., methylsulfonyl and phenylsulfonyl), a carbonamido group having a C number of 1 to 10 (e.g., acetamido and benzamido), a sulfonamido group having a C number of 1 to 10 (e.g., methanesulfonamido and toluenesulfonamido), an alkyloxy group (e.g., methoxy and ethoxy), or an aryloxy group (e.g., phenoxy), and most preferably a cyano group, a carbamoyl group, an alkoxycarbonyl group, or a carboxyl group.

$R_{10}$ is preferably a hydrogen atom, an alkyl group having a C number of I to 12 (e.g., methyl, sulfomethyl, carboxymethyl, ethyl, 2-sulfoethyl, 2-carboxyethyl, 3-sulfopropyl, 3-carboxypropyl, 5-sulfopentyl, 5-carboxypentyl, and 4-sulfobenzyl), or an aryl group having a C number of 6 to 15 (e.g., phenyl, 4-carboxyphenyl, 3-carboxyphenyl, 2,4-dicarboxyphenyl, 4-sulfophenyl, 3-sulfophenyl, 2,5-disulfophenyl, and 2,4-disulfophenyl), and more preferably an alkyl group having a C number of 1 to 7 or an aryl group having a C number of 6 to 10.

Practical examples of the yellow-colored cyan coupler of the present invention are presented below, but the present invention is not limited to these examples.

(YC-1)

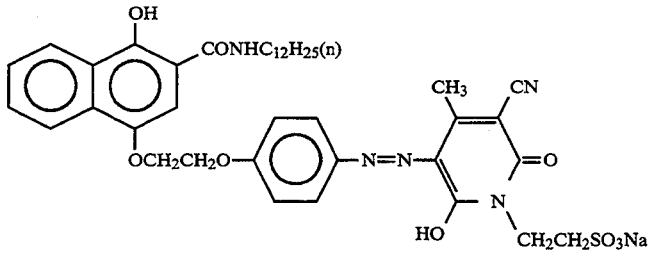

(YC-2)

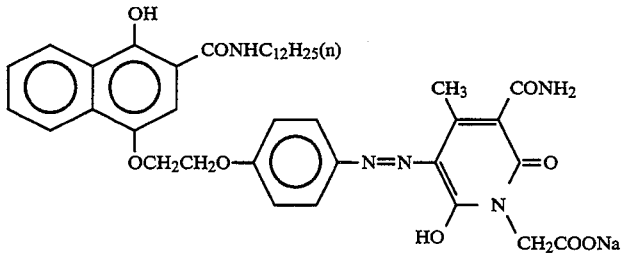

(YC-3)

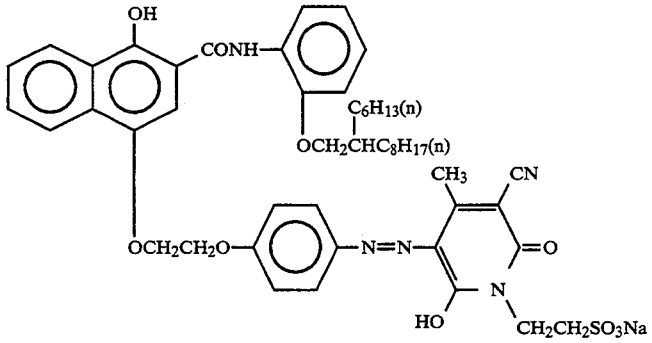

(YC-4)

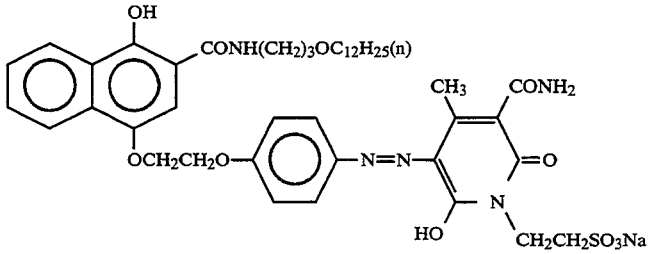

(YC-5)

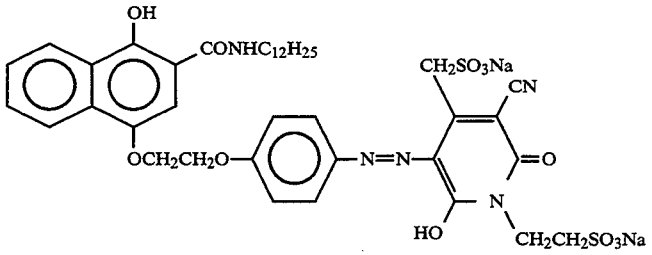

-continued
(YC-6)
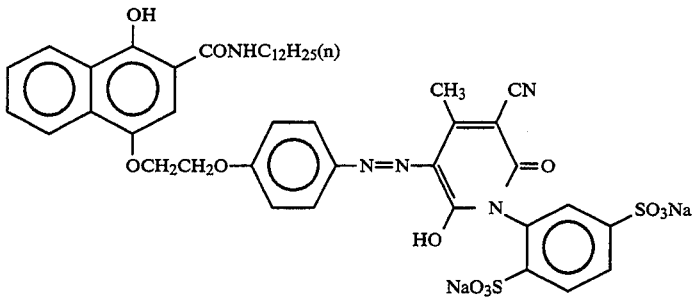
(YC-7)
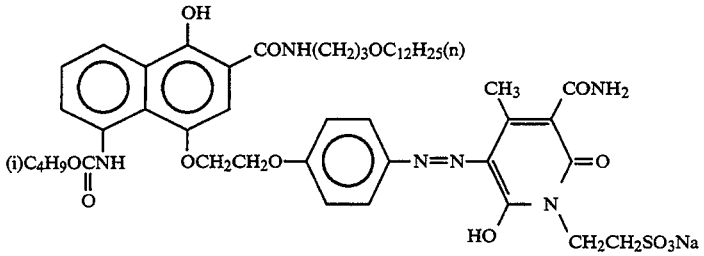
(YC-8)
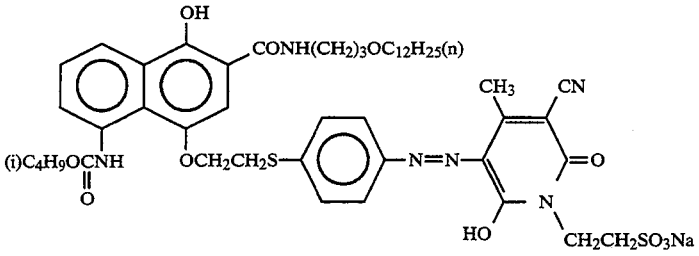
(YC-9)
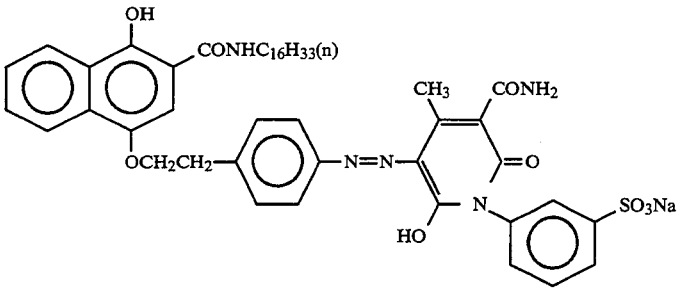
(YC-10)
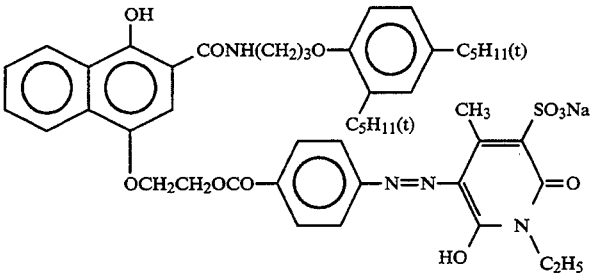

-continued
(YC-11)
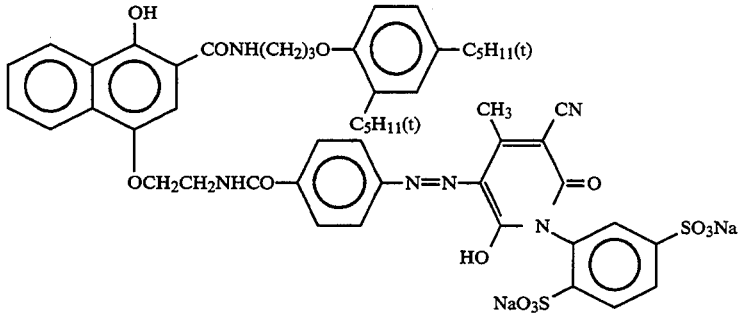
(YC-12)
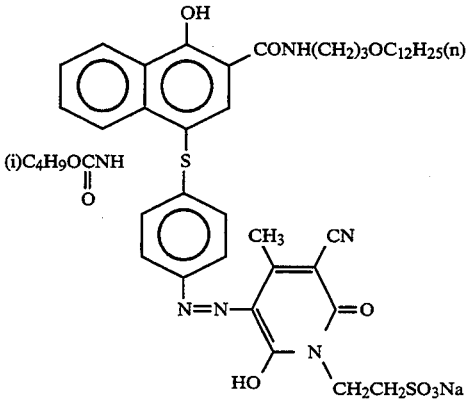
(YC-13)
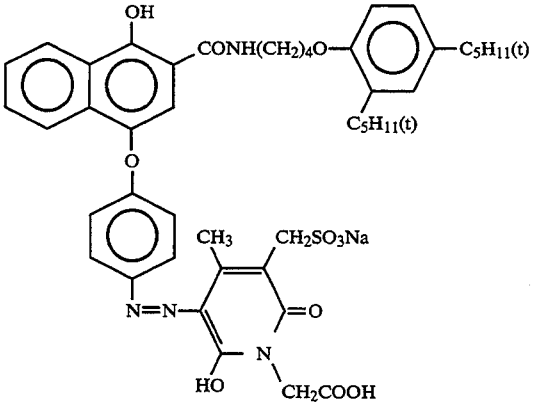
(YC-14)
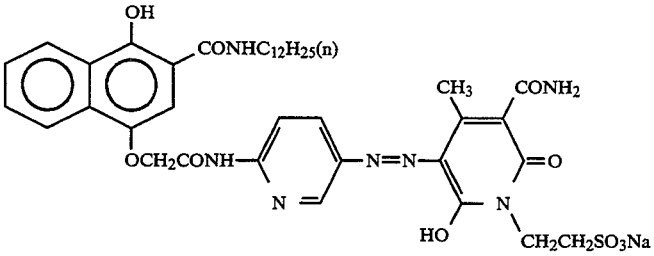
(YC-15)
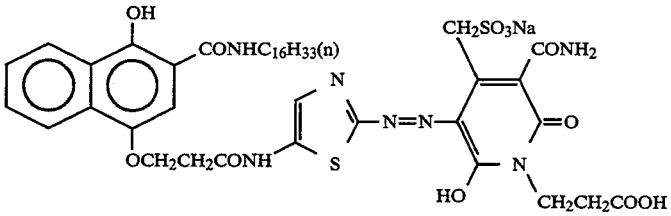

-continued
(YC-16)
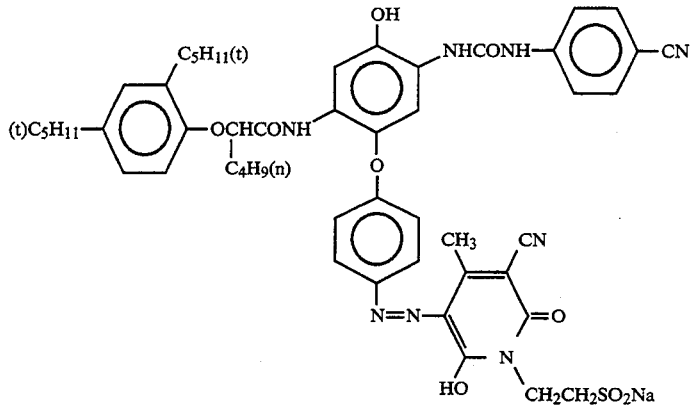
(YC-17)
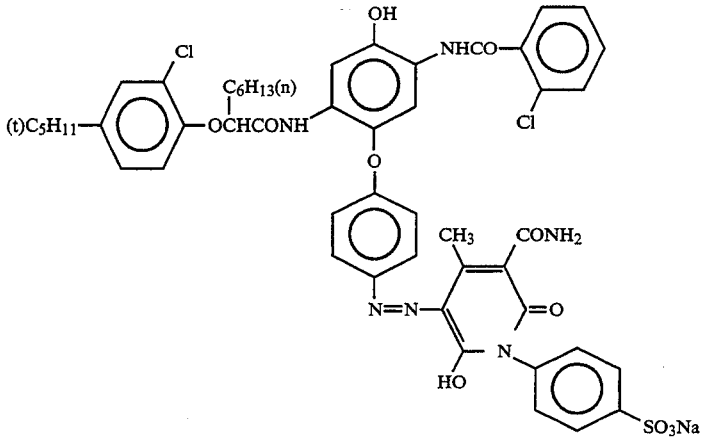
(YC-18)
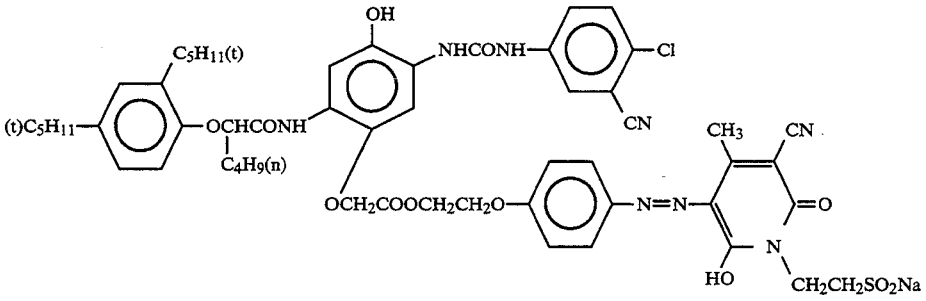
(YC-19)
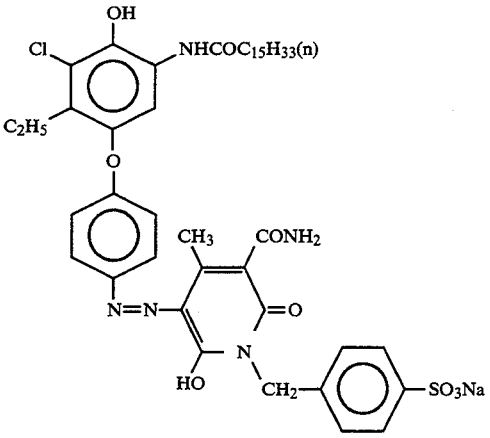

-continued
(YC-20)
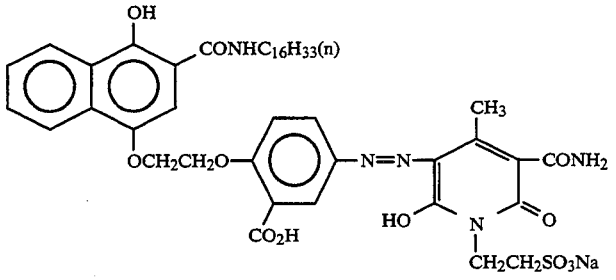
(YC-21)
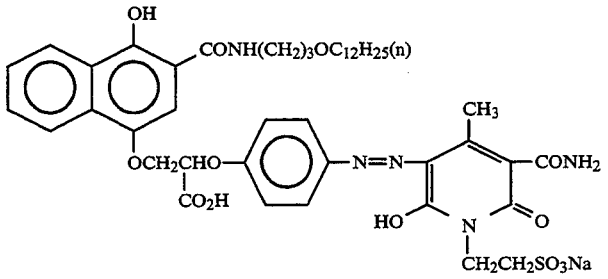
(YC-22)
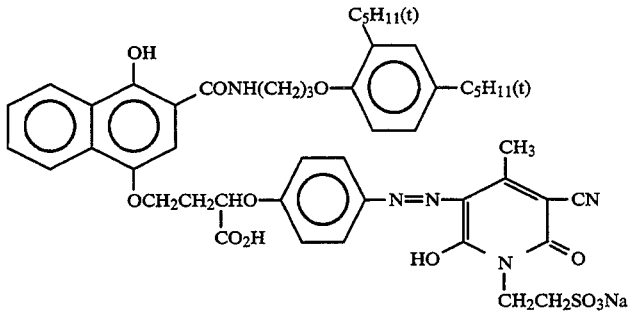
(YC-23)
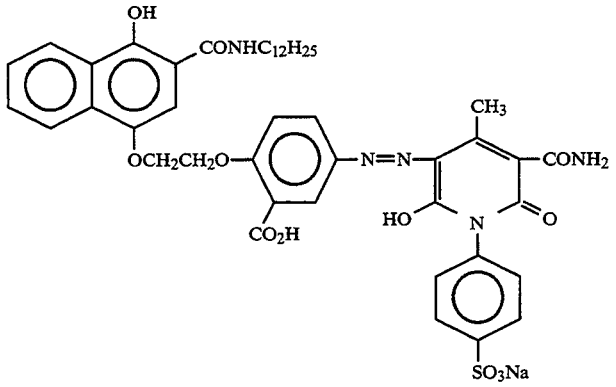
(YC-24)
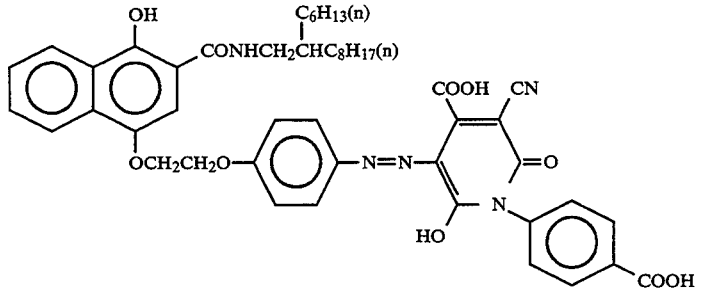

-continued
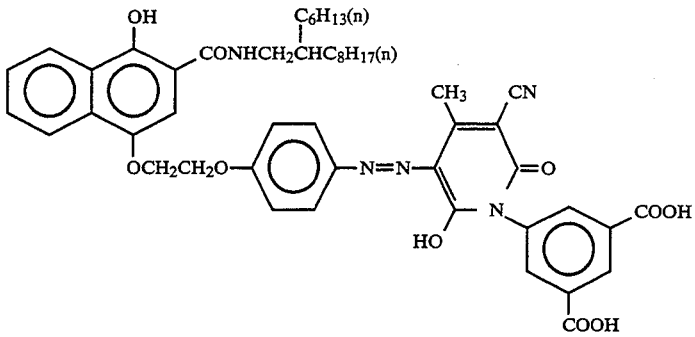
(YC-25)
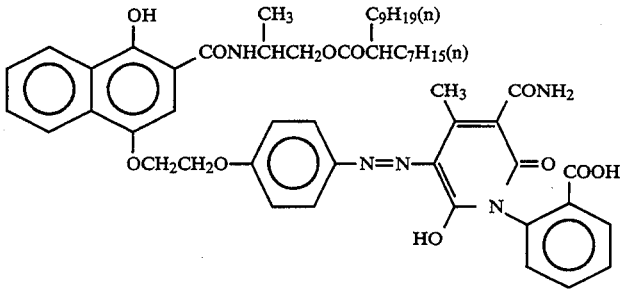
(YC-26)
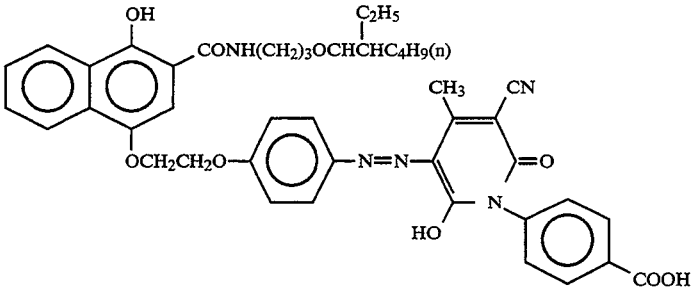
(YC-27)
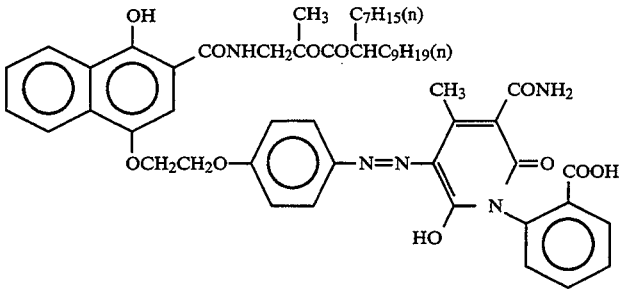
(YC-28)
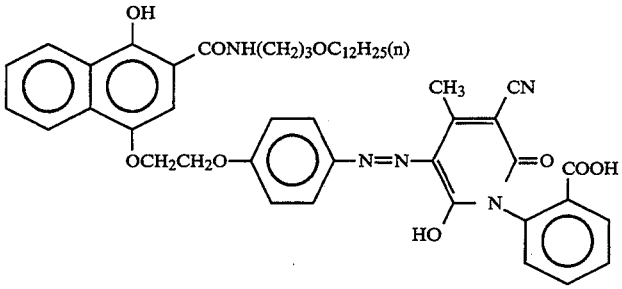
(YC-29)

-continued
(YC-30)
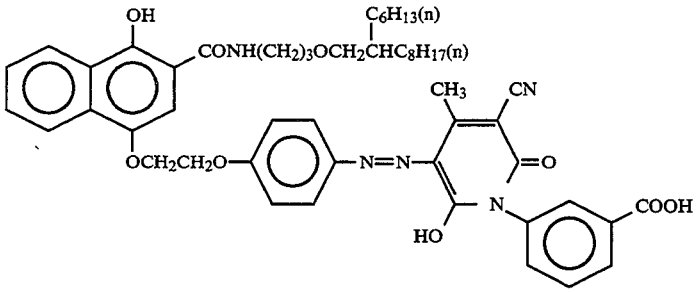
(YC-31)
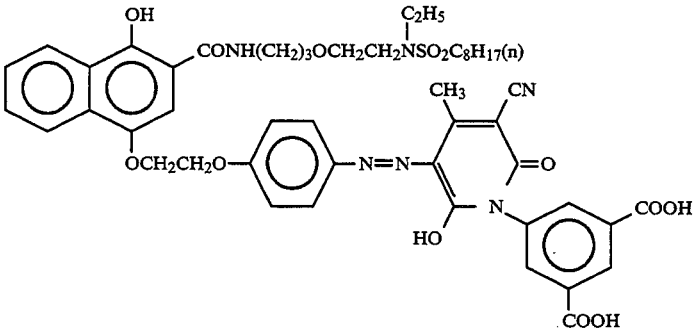
(YC-32)
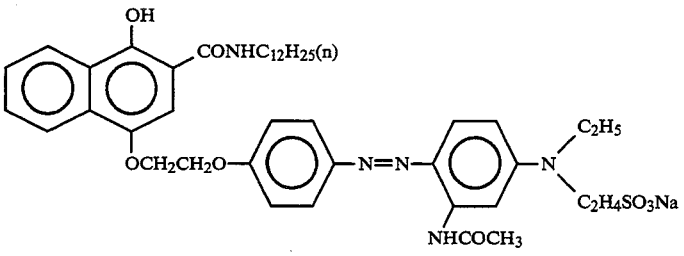
(YC-33)
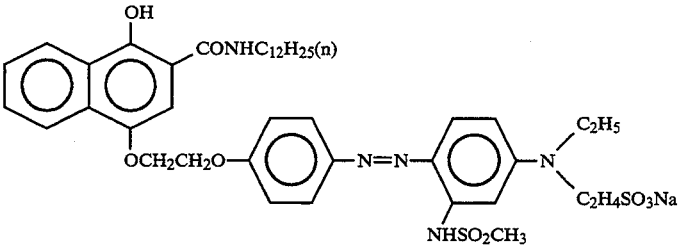
(YC-34)
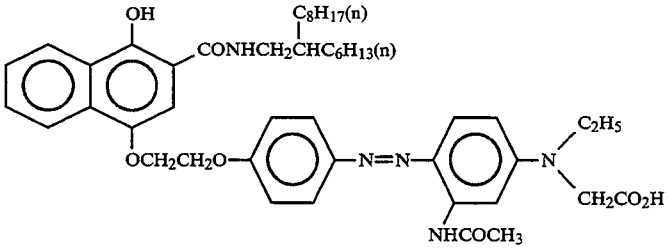
(YC-35)
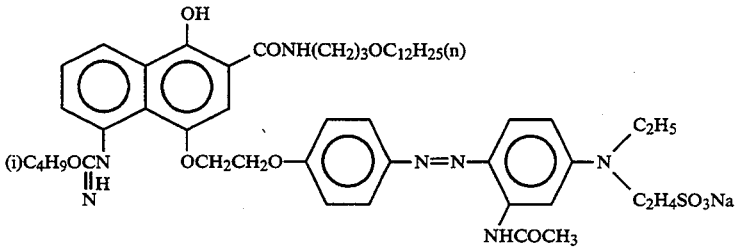

-continued
(YC-36)
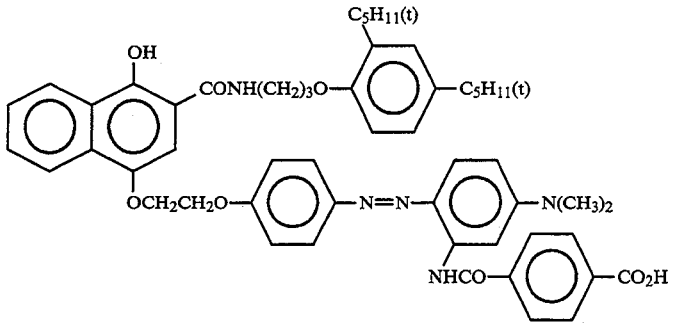
(YC-37)
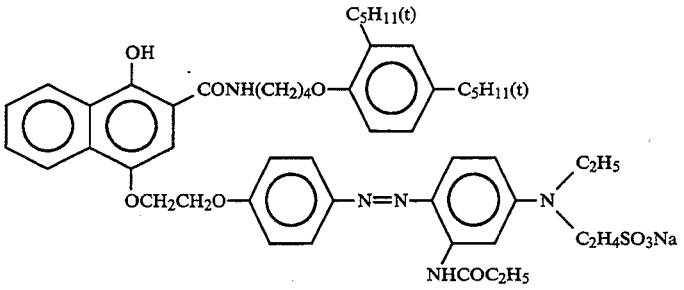
(YC-38)
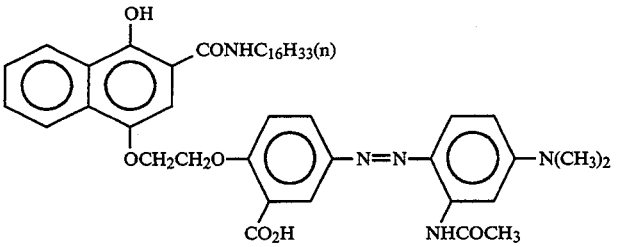
(YC-39)
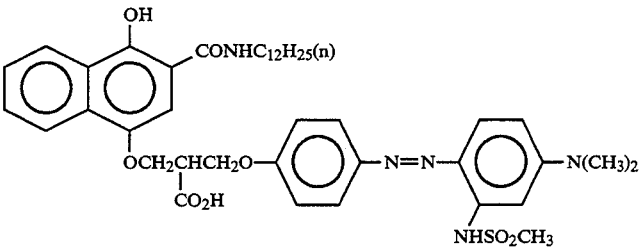
(YC-40)
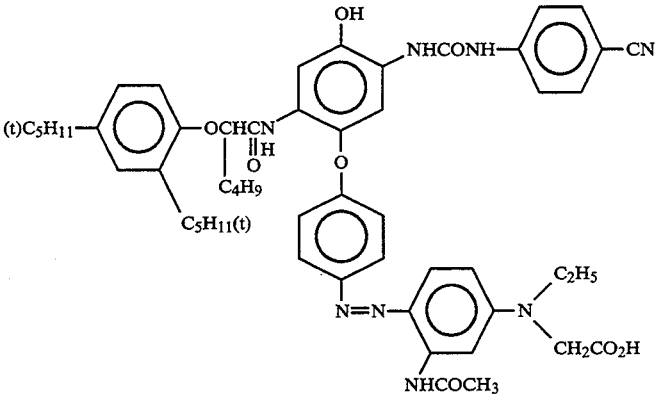

-continued
(YC-41)
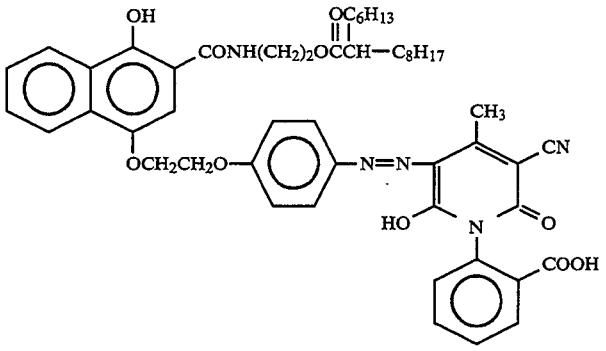
(YC-42)
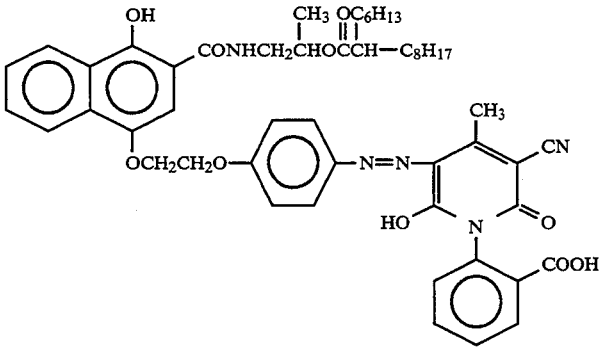
(YC-43)
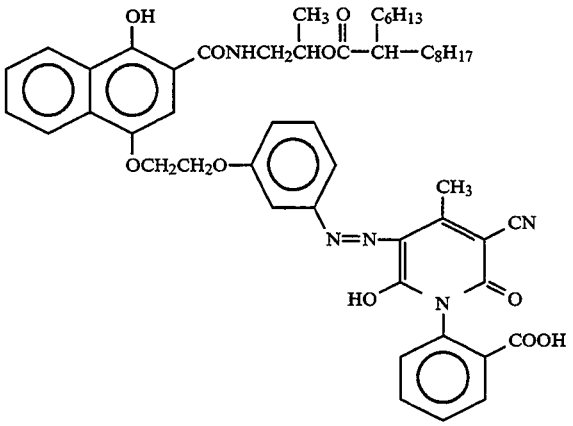
(YC-44)
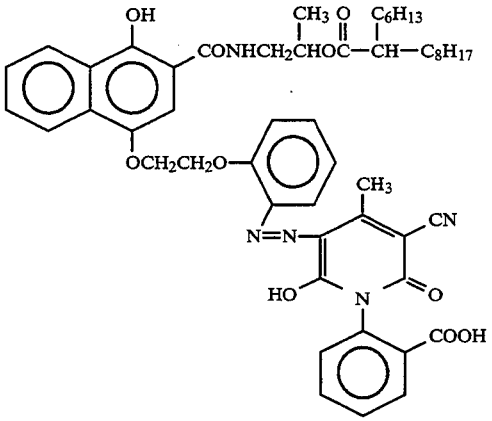

-continued
(YC-45)
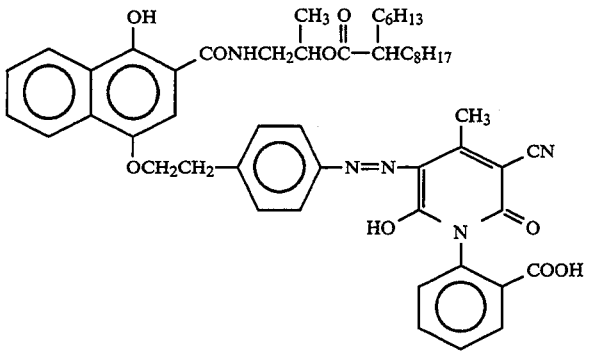
(YC-46)
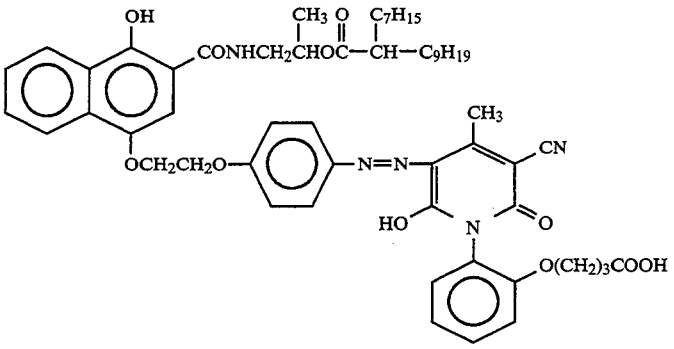
(YC-47)
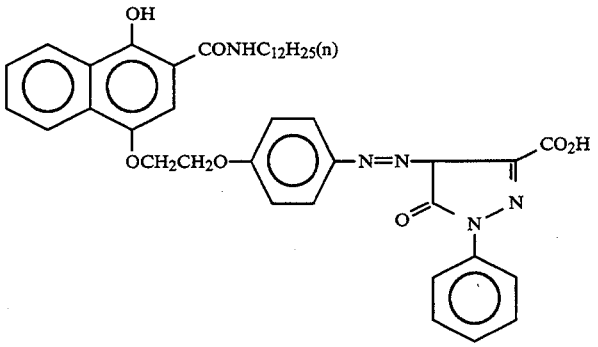
(YC-48)
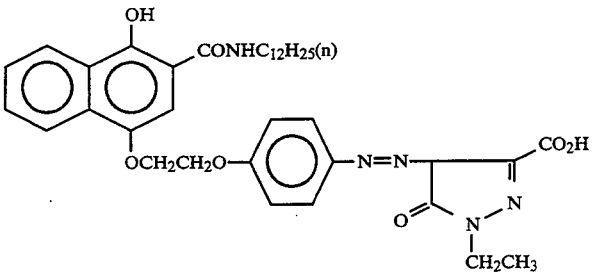

-continued
(YC-49)
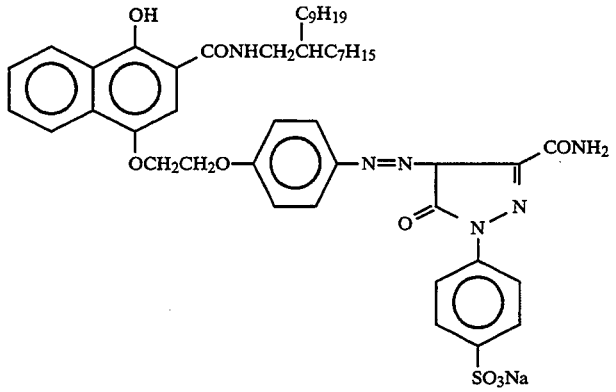
(YC-50)
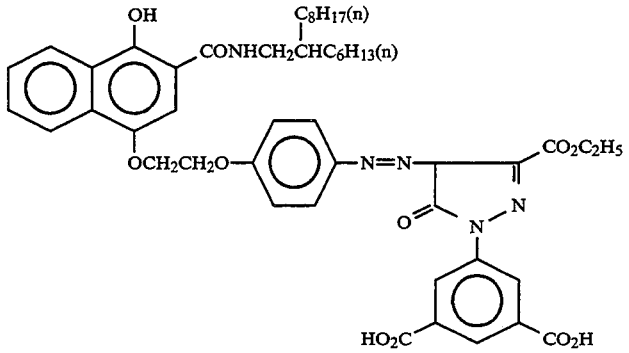
(YC-51)
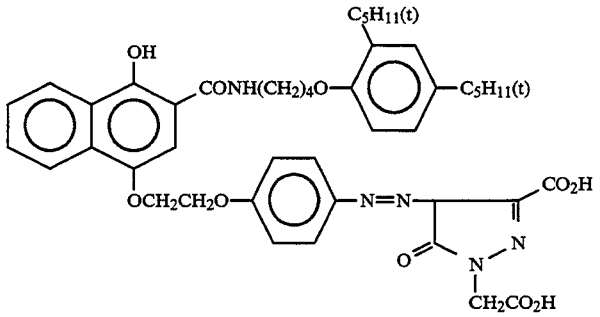
(YC-52)
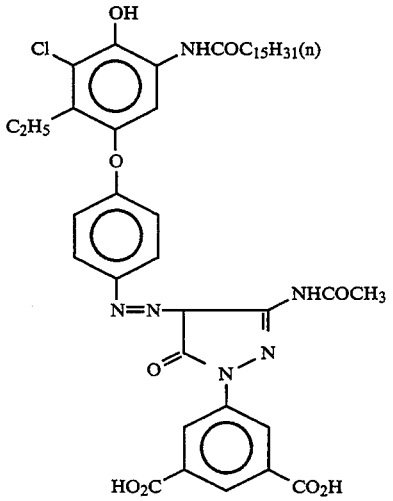

-continued (YC-53)

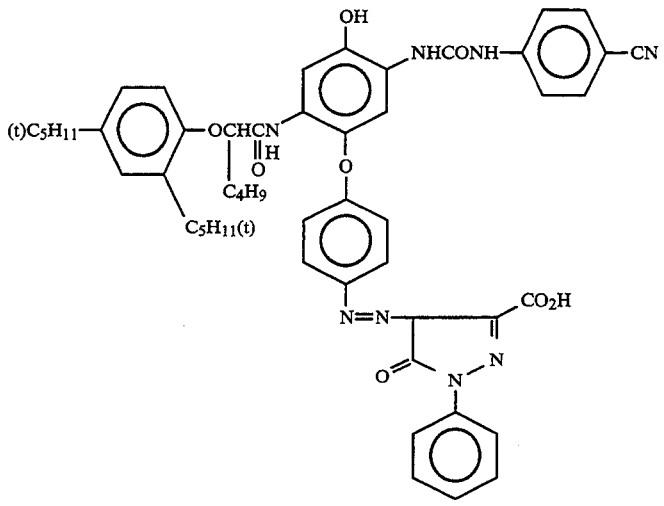

(YC-54)

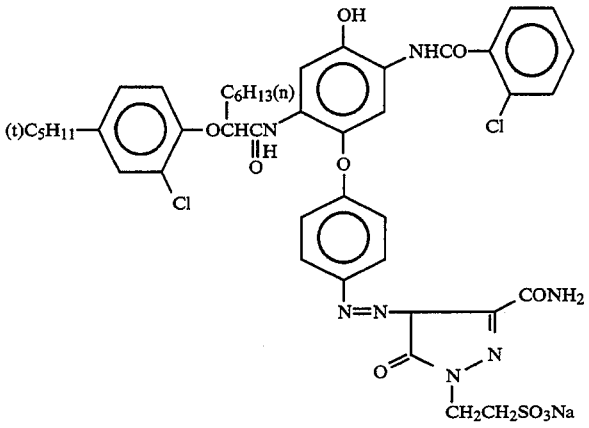

(YC-55)

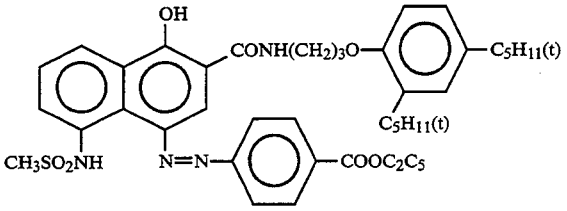

A yellow-colored coupler represented by Formula (CI) of the present invention can be generally synthesized by a diazo-coupling reaction between 6-hydroxy-2-pyridones and aromatic diazonium salt or heterocyclic group diazonium salt, which contains a coupler structure.

The former, i.e., 6-hydroxy-2-pyridones can be synthesized by the methods described in, e.g., Krinsberg ed., "Heterocyclic Compound—Pyridine and Its Derivatives—Vol. 3" (published by Inter Science, 1962); J. Am. Chem. Soc., 1943, vol. 65, p. 449; J. Chem. Tech. Biotechnol., 1986, Vol. 36, p. 410; Tetrahedron, 1966, Vol. 22, p. 445; and JP-B-61-52827, West German Patents 2,162,612, 2,349,709, and 2,902,486, and U.S. Pat. No. 3,763,170.

The latter, i.e., diazonium salt can be synthesized by the methods described in, e.g., U.S. Pat. Nos. 4,004,929 and 4,138,258, JP-A-61-72244, and JP-A-61-273543. The diazo-coupling reaction between 6-hydroxy-2-pyridones and diazonium salt can be performed in a solvent, such as methanol, ethanol, methylcellosolve, acetic acid, N,N-dimethylformamide, N,N-dimethylacetamide, tetrahydrofuran, dioxane, or water, or in a solvent mixture of these solvents. In this case, it is possible to use, as a base, sodium acetate, potassium acetate, sodium carbonate, potassium carbonate, sodium bicarbonate, sodium hydroxide, potassium hydroxide, pyridine, triethylamine, tetramethylurea, or tetramethylguanidine. The reaction temperature is normally −78° C. to 60° C., and preferably −20° C. to 30° C.

Synthesis examples of the yellow-colored couplers of the present invention will be described below.

Synthesis Example 1

Synthesis of examplified coupler (YC-1)

The synthesis route of this example is presented below.

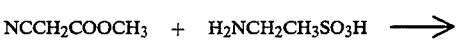

-continued

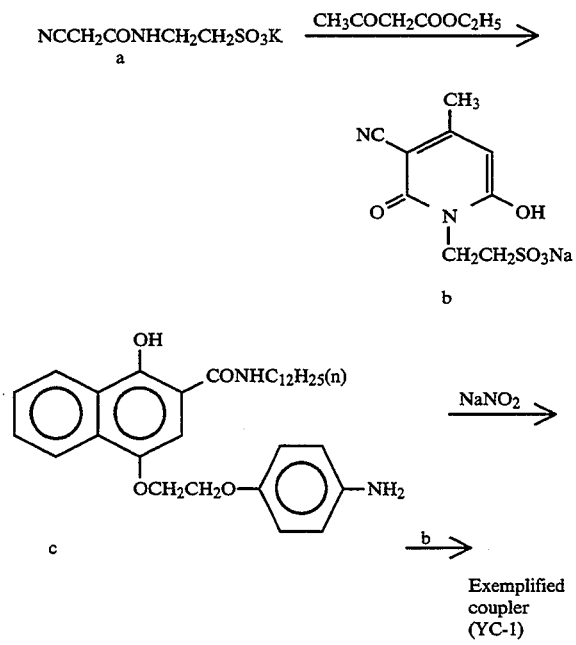

Synthesis of compound a 500 ml of methanol were added to 125.2 g of taurine and 66 g of potassium hydroxide, the mixture was heated with stirring, and 110 g of methyl cyanoacetate were dropped in the resultant solution over about one hour. The mixture was heated under reflux for five hours and left to stand overnight. The precipitated crystals were filtered out, washed with ethanol, and dried to obtain 202.6 g of crystals of a compound a.

Synthesis of compound b 11.5 ml of water were added to 11.5 g of the compound a and 3.5 g of potassium carbonate, 7.8 g of ethyl acetoacetate were dropped in the mixture heated with stirring on a steal bath, and the resultant solution was stirred for seven hours. After naturally cooled, the solution was added with 9.2 ml of concentrated hydrochloric acid, and the mixture was stirred. The precipitated crystals were filtered out, washed with methanol, and dried to obtain 10.4 g of crystals of a compound b.

Synthesis of examplified coupler (YC-1)

10.1 g of a compound c synthesized by the method described in U.S. Pat. No. 4,138,258 were dissolved in 60 ml of N,N-dimethylformamide and 60 ml of methylcellosolve, and 4.3 ml of concentrated hydrochloric acid were added to the solution under ice cooling. 5 ml of an aqueous solution containing 1.84 g of sodium sulfite were dropped in the resultant solution to prepare a diazonium solution. Subsequently, 60 ml of methylcellosolve and 20 ml of water were added to 7.8 g of the compound b and 8.2 g of sodium acetate, and the above diazonium solution was dropped in the mixture stirred under ice cooling. The resultant solution was stirred for one hour after the dropping and further stirred at room temperature for two hours. The precipitated crystals were filtered out, washed with water, and dried. The resultant crystals were dispersed in 500 ml of methanol, and the dispersion was heated under reflux for one hour and naturally cooled. The crystals were filtered out, washed with methanol, and dried to obtain 13.6 g of red crystals of an examplified coupler (YC-1) of interest. The melting point of this compound was 269 to 272° C. (decomposed), and its structure was confirmed by $^1$HNMR spectrum, mass spectrum, and elemental analysis. Note that the maximum absorption wavelength and the molecular absorptivity coefficient of this compound in methanol were 457.7 nm and 41,300, respectively, showing good spectral absorption characteristics as a yellow-colored coupler.

Synthesis Example 2

Synthesis of example compound (YC-3)

The synthesis route of this example is presented below.

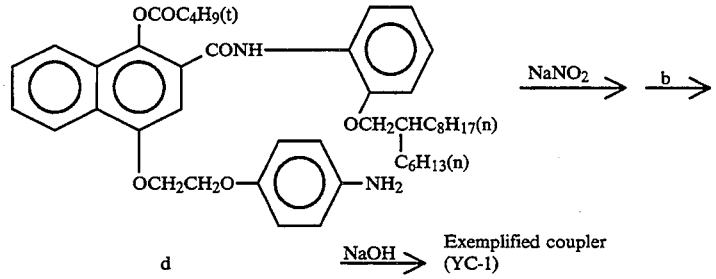

19.2 g of a compound d synthesized by the method described in JP-A-62-85242 were dissolved in 75 ml of N,N-dimethylformamide and 75 ml of methylcellosolve, and 5.6 ml of concentrated hydrochloric acid were added to the solution stirred under ice cooling. Subsequently, 5 ml of an aqueous solution containing 2.5 g of sodium sulfite were dropped in the resultant solution. The mixture was stirred for one hour after the dropping and further stirred at room temperature for one hour to prepare a diazonium solution.

75 ml of methylcellosolve and 26 ml of water were added to 10.1 g of the compound d and 10.7 g of sodium acetate, and the above diazonium solution was dropped in the mixture stirred under ice cooling. The resultant solution was stirred for one hour after the dropping and further stirred at room temperature for two hours, and the precipitated crystals were filtered out. The crystals were dispersed in 200 ml of methanol, 10 ml of an aqueous solution containing 2.2 g of sodium hydroxide was dropped in the dispersion, and the mixture was stirred for three hours. The resultant solution was neutralized by concentrated hydrochloric acid, and the precipitated crystals were washed with water and then with methanol, and dried. The obtained coarse crystals were purified by hot methanol as in the synthesis example 1 to obtain 14.8 g of an examplified coupler (YC-3) of interest. The melting point of this compound was 246 to 251° C. (decomposed), and its structure was confirmed by $^1$HNMR spectrum, mass spectrum, and elemental analysis. Note that the maximum absorption wavelength and the molecular absorptivity coefficient of this compound in methanol were 457.6 nm and 42,700, respectively, indicating good spectral absorption characteristics as a yellow-colored coupler.

Synthesis Example 3

Synthesis of examplified coupler (YC-30)

The synthesis route of this example is presented below.

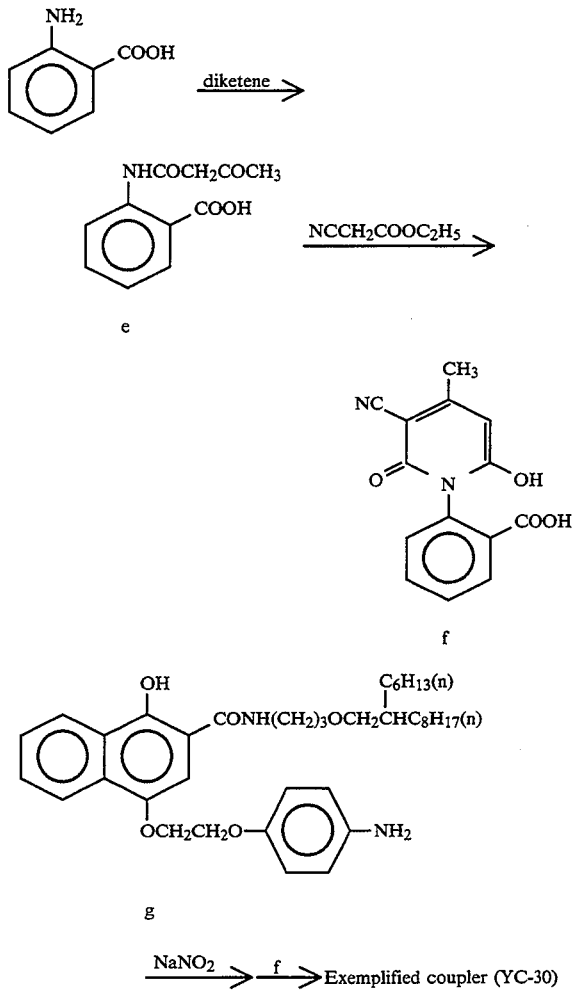

Synthesis of compound e 137.1 g of anthranilic acid were added to 600 ml of acetonitrlle, the mixture was heated with stirring, and 92.5 g of diketene were dropped in the resultant solution over about one hour. The mixture was heated under reflux for one hour and cooled to room temperature. The precipitated crystals were filtered out, washed with acetonitrile, and dried to obtain 200.5 g of crystals of a compound e.

Synthesis of compound f 199.1 g of the compound e, 89.2 g of ethyl cyanoacetate, and 344 g of 28% sodium methoxide were added to 0.9 l of methanol, and the mixture was reacted in an autoclave at 120° C. for eight hours. After left to stand overnight, the reaction mixture was concentrated under reduced pressure and added with 700 ml of water, and the resultant solution was acidified by adding 230 ml of concentrated hydrochloric acid. The precipitated crystals were filtered out, and the obtained coarse crystals were washed under heating by using a solvent mixture of ethyl acetate and acetonitrile, thereby obtaining 152 g of a compound f.

Synthesis of examplified coupler (YC-30)

13.0 g of a compound g synthesized in accordance with the synthesizing method described in U.S. Pat. No. 4,138,258 were dissolved in 40 ml of N,N-dimethylformamide, and 4.5 ml of concentrated hydrochloric acid were added to the solution under ice cooling. 5 ml of an aqueous solution containing 1.48 g of sodium nitrite were dropped in the resultant solution to prepare a diazonium solution. Subsequently, 20 ml of N,N-dimethylformamide and 15 ml of water were added to 6.0 g of the compound f and 8 g of sodium acetate, and the above diazonium solution was dropped in the mixture stirred under ice cooling. After the dropping, the resultant solution was further stirred at room temperature for 30 minutes. The solution was acidified by hydrochloric acid and extracted by ethyl acetate, and the extract was washed with water. The resultant substance was concentrated under reduced pressure, and the concentrate was recrystallized using a solvent mixture of ethyl acetate and methanol, thereby obtaining 13 g of yellow crystals of an examplified coupler (YC-30). The melting point of this coupler (YC-30) was 154° to 156° C., and its structure was confirmed by $^1$HNMR spectrum, mass spectrum, and elemental analysis. Note that the maximum absorption wavelength and the molecular absorptivity coefficient of this compound in methanol were 458.2 nm and 42,800, respectively, exhibiting good spectral absorption characteristics as a yellow-colored coupler.

Synthesis Example 4

Synthesis of examplified coupler (YC-42)

The synthesis route of this example is presented below.

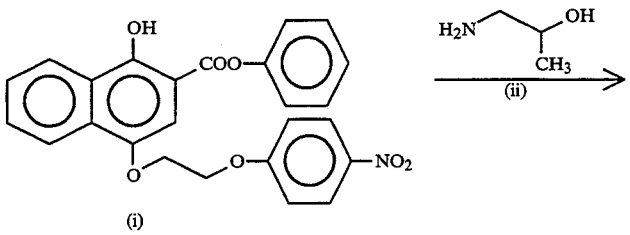

-continued

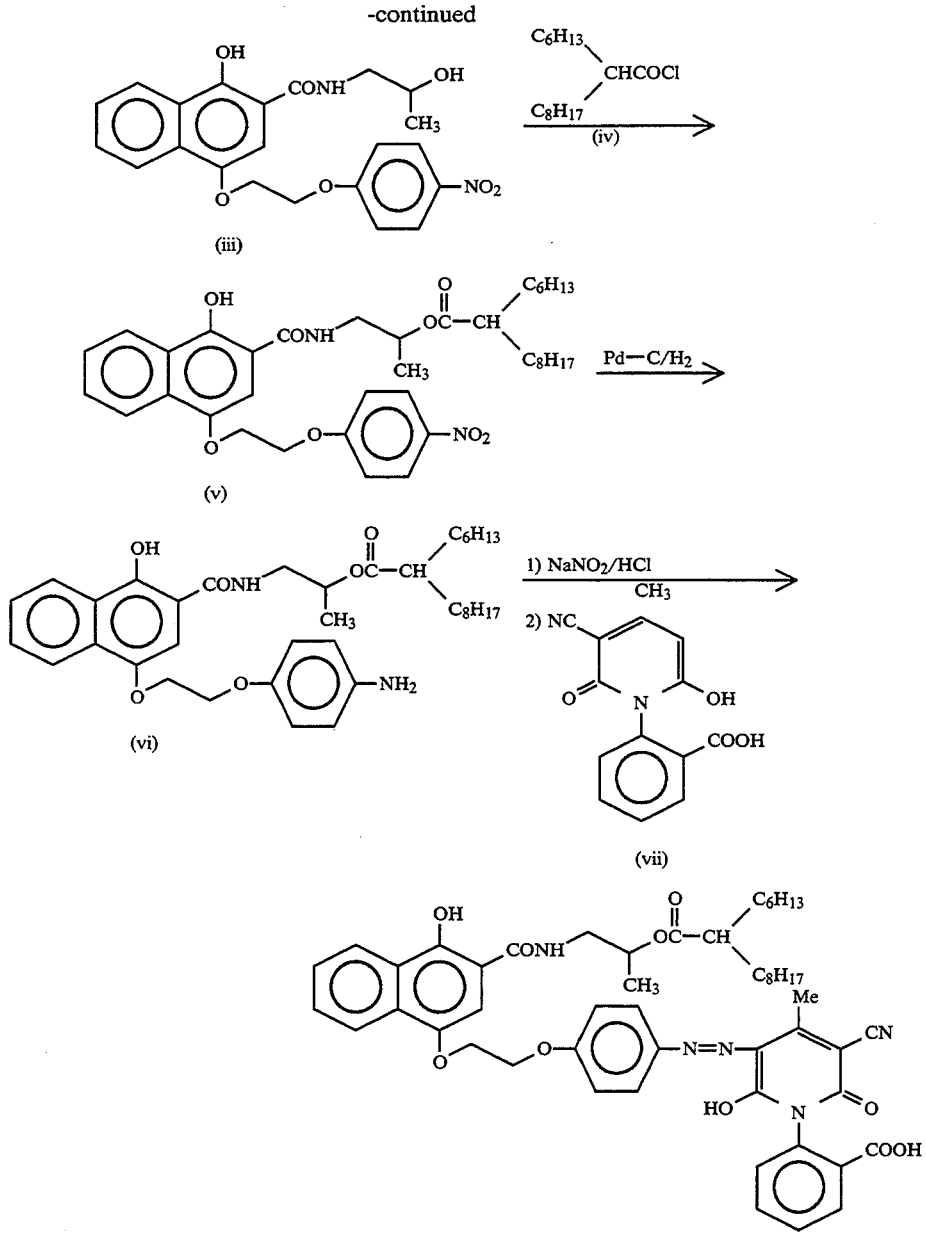

Exemplified coupler YC-42

(1) Synthesis of compound (iii)

445.5 g of a phenyl ester compound (i) and 90.1 g of isopropanolamine (ii) were dissolved in 600 ml of acetonitrile, and the solution was heated under reflux for two hours. The resultant solution was cooled by water, and the precipitated crystals were filtered out and dried to obtain 342 g of a compound (iii).

mp. 162°-165° C.

(2) Synthesis of compound (v)

341 g of the hydroxyl compound (iii) and 231 g of 2-hexyldecanoyl chloride (iv) were dissolved in 880 ml of acetonitrile, and the solution was heated under reflux for two hours. The resultant solution was cooled by water, and the precipitated crystals were filtered out and dried to obtain 437 g of a compound (v).

mp. 97°-100° C.

(3) Synthesis of compound (vi)

370 g of the nitro compound (v), 6 g of a 10% Pd-C catalyst, and 1 l of ethyl acetate were placed in an autoclave and hydrogenated at 50° C. for three hours. After the reduction was finished, the catalyst was filtered away, and the filtrate was concentrated under reduced pressure. The obtained residue was crystallized by n-hexane, and the precipitated crystals were filtered out and dried to obtain 327 g of an amine material (vi).

mp. 95°-97° C.

(4) Synthesis of examplified coupler YC-42

20.8 g of the amine material (vi) were dissolved in 60 l of dimethylformamide, and 7.6 ml of concentrated hydrochloric acid were added to the solution under water cooling. In addition, an aqueous solution of 2.7 g of soda nitrite and 10 ml of water was dropped in the resultant solution over 20 minutes, and the mixture was stirred for 30 minutes to prepare a diazo solution.

Meanwhile, 9.7 g of pyridone (vii) and 13 g of soda acetate were added to a solution mixture of 30 ml of water and 30 ml of dimethylformamide and dissolved under heating. Thereafter, the resultant solution was cooled by water, and the above diazo solution was slowly added to the solution with stirring at 10° C. or lower. The mixture was further stirred for 15 minutes and extracted by ethyl acetate, and the extract was washed with water three times. The organic layer was concentrated under reduced pressure, and the residue was crystallized by methanol ethyl acetate. The precipitated crystals were filtered out and dried to obtain 21.2 g of an examplified coupler YC-42.

mp. 117°-119° C.

Yellow-colored cyan couplers represented by Formulas (YCII) to (YCIV) can be synthesized by, e.g., the methods described in JP-B-58-6939 and JP-A-1-197563, and the methods described in the patents cited above as a method of synthesizing a coupler represented by Formula (YCI).

In the present invention, yellow-colored cyan couplers represented by Formulas (YCI) and (YCII) are more preferably used, and that represented by Formula (YCI) is most preferably used.

The total addition amount of yellow-colored cyan couplers to the light-sensitive material is 0.005 to 0.30 $g/m^2$, preferably 0.02 to 0.20 $g/m^2$, and more preferably 0.03 to 0.15 $g/m^2$.

The yellow-colored cyan coupler is preferably added to a light-sensitive silver halide emulsion layer or the adjacent layer to a silver halide emulsion layer. More preferably, the yellow-colored cyan coupler is added to a red-sensitive emulsion layer.

The yellow-colored cyan couplers of the present invention can be added in the same manner as conventional couplers as will be described later.

In the light-sensitive material of the present invention, at least one of blue-, green-, and red-sensitive negative silver halide emulsion layers need only be formed on a support, and the number and order of the silver halide emulsion layers and non-light-sensitive layers are not particularly limited. A typical example is a silver halide photographic light-sensitive material having, on its support, at least one light-sensitive layer constituted by a plurality of silver halide emulsion layers which are sensitive to essentially the same color but have different sensitivities. This light-sensitive layer is a unit sensitive layer which is sensitive to one of blue light, green light, and red light. In a multilayered silver halide color photographic light-sensitive material, such unit light-sensitive layers are generally arranged in an order of red-, green-, and blue-sensitive layers from a support. However, according to the intended use, this arrangement order may be reversed, or light-sensitive layers sensitive to the same color may sandwich another light-sensitive layer sensitive to a different color.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is commonly used.

As a plurality of silver halide emulsion layers constituting each unit light-sensitive layer, a two-layered structure of high- and low-sensitivity emulsion layers can be preferably used as described in west German Patent 1,121,470 or British Patent 923,045. In this case, layers are preferably arranged such that the sensitivity is sequentially decreased toward a support, and a non-light-sensitive layer may be formed between the respective silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-speed emulsion layer/high-speed emulsion layer/low-sensitivity emulsion layer from the farthest side from a support in a layer sensitive to one color as described in JP-A-59-202464.

In addition, an order of high-speed emulsion layer/-low-speed emulsion layer/medium-speed emulsion layer or low-speed emulsion layer/medium-speed emulsion layer/high-speed emulsion layer may be adopted.

When the number of layers is four or more, the layer arrangement can be changed as described above.

As described above, various layer types and arrangements can be selected according to the intended use of the light-sensitive material.

A preferable silver halide contained in photographic emulsion layers of the photographic light-sensitive material of the present invention is silver bromoiodide, silver iodochloride, or silver bromochloroiodide containing about 30 mol % or less of silver iodide. The most preferable silver halide is silver bromoiodide or silver bromochloroiodide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having crystal defects such as twin planes, or composite shapes thereof.

A silver halide may consist of fine grains having a grain size of about 0.2 μm or less or large grains having a projected area diameter of about 10 μm, and an emulsion may be either a polydisperse or monodisperse emulsion.

A silver halide photographic emulsion which can be used in the light-sensitive material of the present invention can be prepared by methods described in, for example, "I. Emulsion preparation and types," Research Disclosure (RD) No. 17,643 (December, 1978), pp. 22 and 23, RD No. 18,716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394 and British Patent 1,413,748 are also preferred.

A crystal structure may be uniform, may have different halogen compositions in the interior and the surface layer thereof, or may be a layered structure. Alternatively, a silver halide having a different composition may be bonded by an epitaxial junction or a compound except for a silver halide such as silver rhodanide or zinc oxide may be bonded. A mixture of grains having various types of crystal shapes may be used.

The above emulsion may be any of a surface latent image type emulsion which mainly forms a latent image on the surface of a grain, an internal latent image type emulsion which forms a latent image in the interior a grain, and an emulsion of another type which has latent images on the surface and in the interior of a grain. In this case, the internal latent image type emulsion may be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably 5 to 20 nm.

A silver halide emulsion is normally subjected to physical ripening, chemical ripening, and spectral sensitization steps before it is used. Additives for use in these steps are described in Research Disclosure Nos. 17,643, 18,716, and 307,105, and they are summarized in a table to be presented later.

In the light-sensitive material of the present invention, it is possible to simultaneously use, in a single layer, two or more types of emulsions different in at least one of characteristics of a light-sensitive silver halide emulsion, i.e., a grain size, a grain size distribution, a halogen composition, a grain shape, and a sensitivity.

In the present invention, it is preferable to use a non-light-sensitive fine grain silver halide. The non-light-sensitive fine grain silver halide preferably consists of silver halide grains which are not exposed during imagewise exposure for obtaining a dye image and are not essentially developed during development. These silver halide grains are preferably not fogged in advance.

In the fine grain silver halide, the content of silver bromide is 0 to 100 mol %, and silver chloride and/or silver iodide may be contained if necessary. The fine grain silver halide preferably contains 0.5 to 10 mol % of silver iodide.

The average grain size (average value of an circle-equivalent diameter of a projected area) of the fine grain silver halide is preferably 0.01 to 0.5 μm, and more preferably 0.02 to 2 μm.

The fine grain salver halide can be prepared following the same procedures as for a common light-sensitive silver halide. In this case, the surface of each silver halide grain need not be chemically sensitized nor spectrally sensitized. However, before the silver halide grains are added to a coating solution, it is preferable to add a well-known stabilizer such as a triazole-based compound, an azaindene-based compound, a benzothiazolium-based compound, a mercapto-based compound, or a zinc compound. Colloidal silver can be preferably added to this fine grain silver halide grain-containing layer.

The silver coating amount of the light-sensitive material of the present invention is preferably 8.0 g/m$^2$ or less, more preferably 6.0 g/m$^2$ or less, and most preferably 4.5 g/m$^2$ or less. Well-known photographic additives usable in the present invention are also described in the three Research Disclosures described above, and they are summarized in the following table.

| Additives | RD17643 Dec. 1978 | RD18716 Nov. 1979 | RD307105 Nov. 1978 |
|---|---|---|---|
| 1. Chemical sensitizers | page 23 | page 648, right column | page 866 |
| 2. Sensitivity increasing agents | | do | |
| 3. Spectral sensitizers super sensitizers | pages 23–24 | page 648, right column to page 649, right column | pages 866–868 |
| 4. Brighteners | page 24 | | page 868 |
| 5. Antifoggants stabilizers | pages 24–25 | page 649, right column | pages 868–870 |
| 6. Light absorbent, filter dye, ultra-violet absorbents | pages 25–26 | page 649, right column to page 650, left column | page 873 |
| 7. Stain preventing agents | page 25, right column | page 650, left to right columns | page 872 |
| 8. Dye image stabilizer | page 25 | page 650, left column | page 872 |
| 9. Hardening agents | page 26 | page 651, left column | pages 874–875 |
| 10. Binder | page 26 | do | page 873–874 |
| 11. Plasticizers, lubricants | page 27 | page 650, right column | page 876 |
| 12. Coating aids, surface active agent | pages 26–27 | do | pages 875–876 |
| 13. Antistatic agents | page 27 | do | pages 876–877 |
| 14. Matting agent | | | page 878–879 |

In order to prevent deterioration in photographic properties caused by formaldehyde gas, the light-sensitive material is preferably added with a compound described in U.S. Pat. Nos. 4,411,987 or 4,435,503, which can react with formaldehyde to fix it.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains a compound described in JP-A-1-106052, which releases a fogging agent, a development accelerator, a silver halide solvent, or a precursor of any of them regardless of a developed amount of silver produced by development.

The light-sensitive material of the present invention preferably contains dyes dispersed by methods described in WO 04794/88 and JP-A-1-502912, or dyes described in EP 317,308A, U.S. Pat. No. 4,420,555, and JP-A-1-259358.

Preferable examples of yellow couplers usable in the present invention are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Preferable examples of magenta couplers are various pyrazolone-based magenta couplers and pyrazoloazole-based magenta couplers. Most preferable examples of the pyrazolone-based magenta coupler are described in, e.g., U.S. Pat. Nos. 4,310,619 and 4,351,897, EP 73,636, U.S. Pat. Nos. 3,061,432 and 3,725,067, JP-A-60-35730, JP-A-55-118034, and JP-A-60-185951, U.S. Pat. No. 4,556,630, and WO No. 88/04795.

An example of a pyrazoloazole-based magenta coupler preferably used in the present invention is a magenta coupler represented by Formula (M) below:

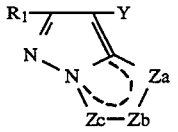

Formula (M)

wherein $R_1$ represents a hydrogen atom or a substituent, Y represents a hydrogen atom or a split-off group, and each of Za, Zb, and Zc represents methine, substituted methine, =N—, or —NI—. One of the Za—Zb bond and the Zb—Zc bond is a double bond, while the other is a single bond. If the Zb—Zc bond is a carbon-carbon double bond, this bond may be part of an aromatic ring.

It may form a dimer or a polymer of a higher order in $R_1$ or Y. If Za, Zb, or Zc is substituted methine, this substituted methine may form a dimer or a polymer of a higher order.

A pyrazoloazole-based coupler represented by Formula (M) is a known coupler. Of pyrazoloazole-based couplers, imidazo[1,2-b]pyrazoles described in U.S. Pat. No. 4,500,630 are preferable, and pyrazolo[1,5-b][1,2,4]triazoles described in U.S. Pat. No. 4,540,654 are most preferable because an amount of yellow secondary absorption of a color dye is small and fastness to light is good.

It is also preferable to use a pyrazolotriazole coupler as described in JP-A-61-65245, in which a branched alkyl group is bonded directly to the 2-, 3-, or 6-position of a pyrazolotriazole ring; a pyrazoloazole coupler described in JP-A-61-65246, which contains a sulfonamido group in its molecule; a pyrazoloazole coupler described in JP-A-61-147254, which contains an alkoxyphenylsulfonamido ballast group; and a pyrazolotriazole coupler described in EP 226,849 and 294,785, which contains a 6-position alkoxy or aryloxy group.

Practical examples of a coupler represented by Formula (M) are presented below.

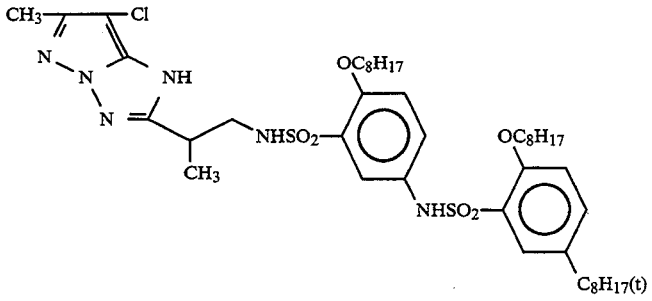

M-1

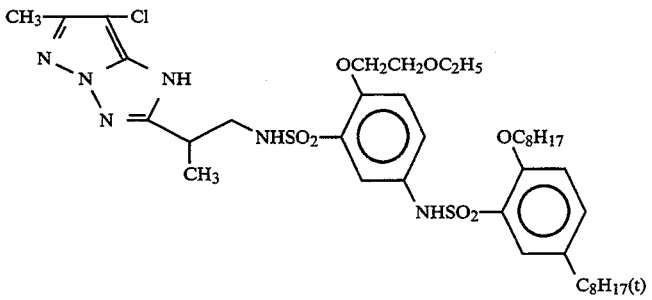

M-2

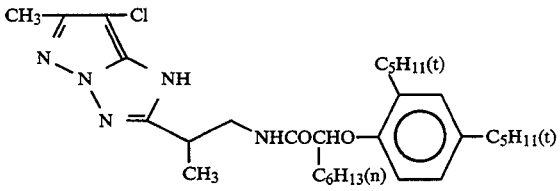

M-3

-continued
M-4
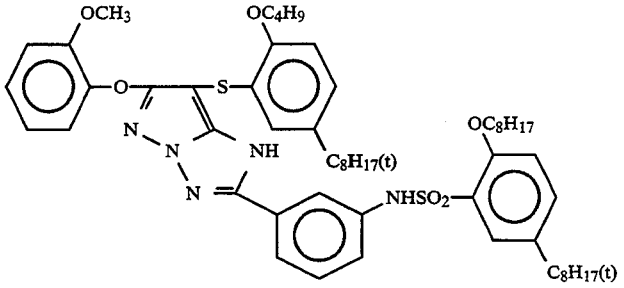
M-5
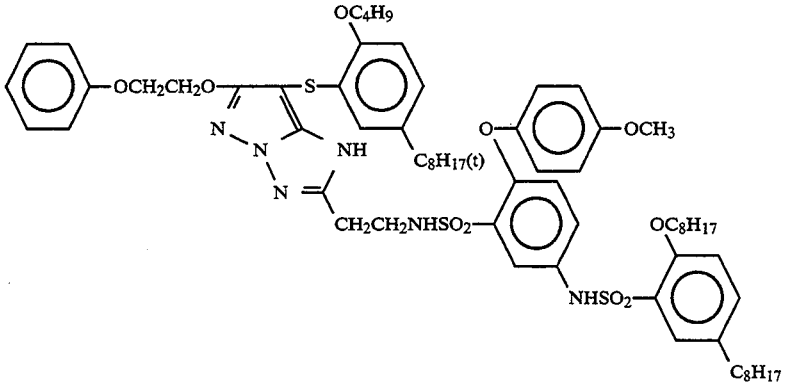
M-6
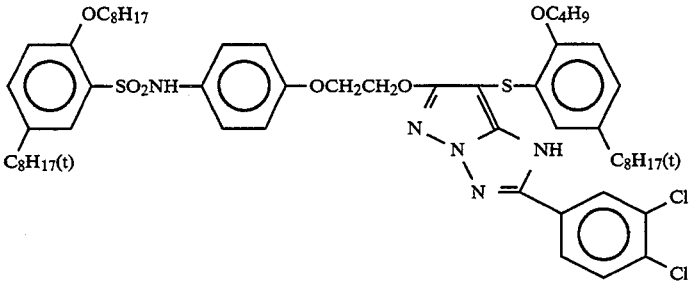
M-7
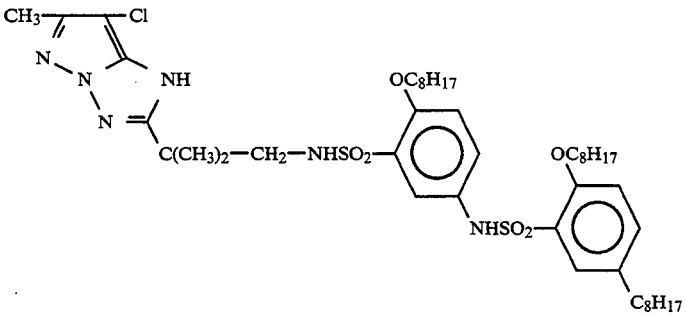
M-8
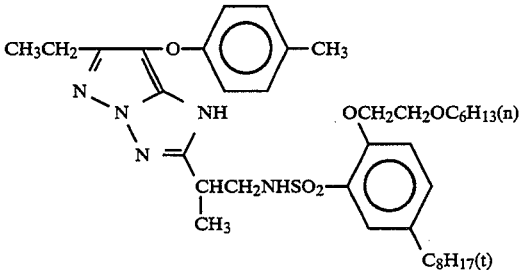

-continued
M-9
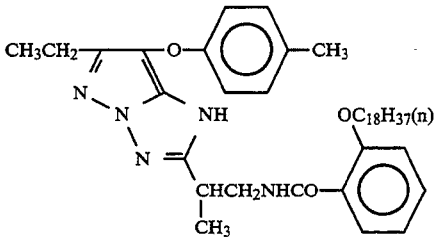
M-10
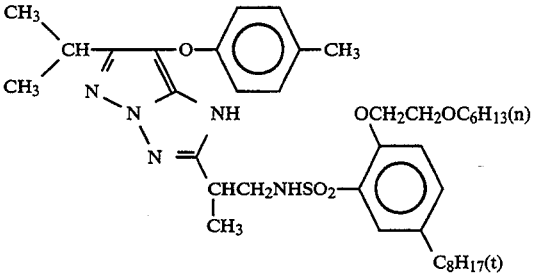
M-11
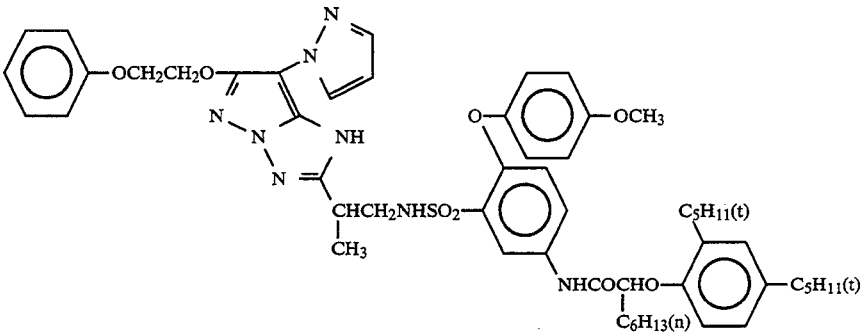
M-12
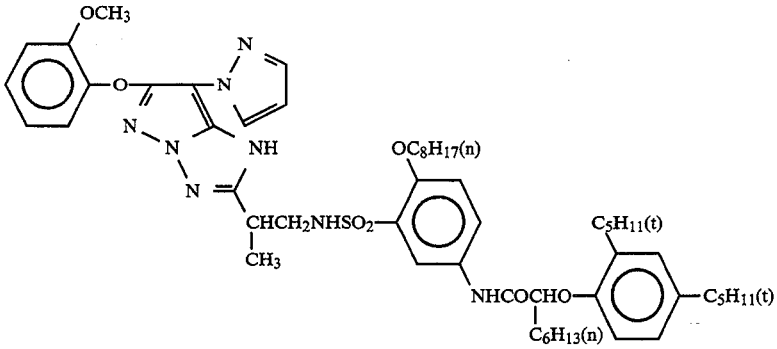
M-13
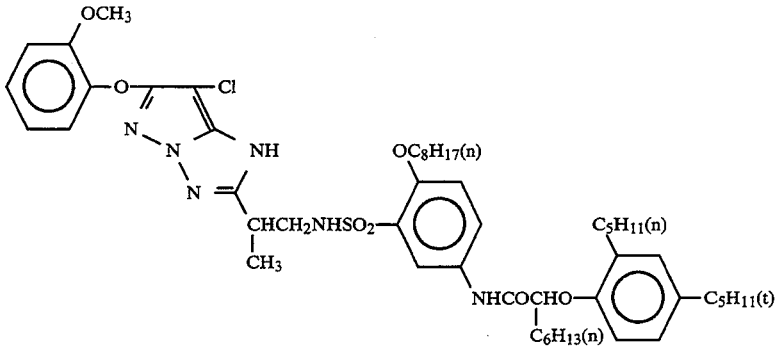

-continued
M-14
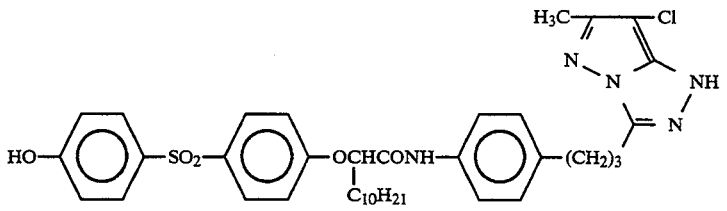
M-15
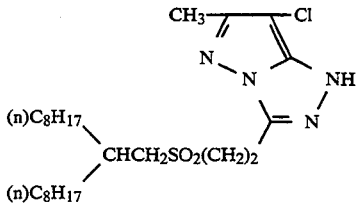
M-16
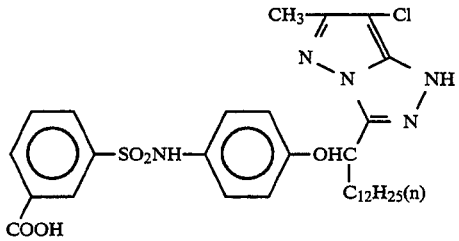
M-17
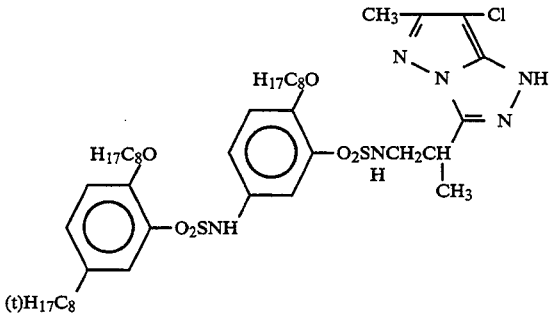
M-18
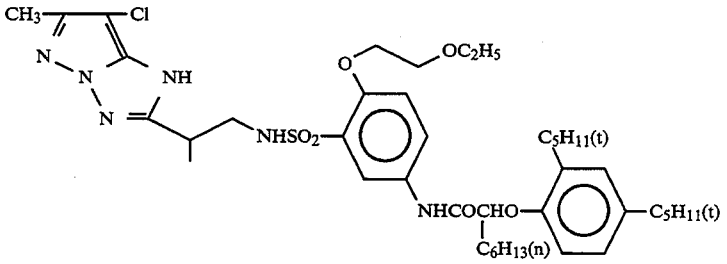
M-19
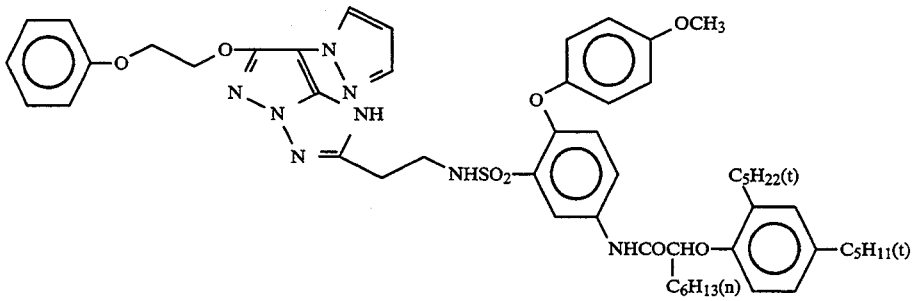
Examples of a cyan coupler are phenolic and naphtholic couplers, and preferably, those described e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Patent Application (OLS) No. 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

Of these couplers, a ureido-based cyan coupler represented by Formula (C-a) and a 5-amidonaphthol-based cyan coupler represented by Formula (C-b) are most preferable:

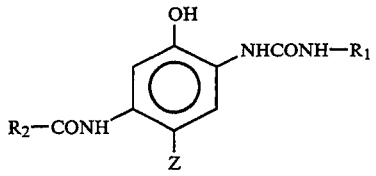

Formula (C-a)

wherein $R_1$ represents a substituted or nonsubstituted aryl group, $R_2$ represents a substituted or nonsubstituted alkyl, aryl, cycloalkyl, or heterocyclic group, and Z represents a hydrogen atom or a coupling split-off group.

Practical examples of a cyan coupler represented by Formula (C-a) are given below, but the present invention is not limited to these examples.

C-1

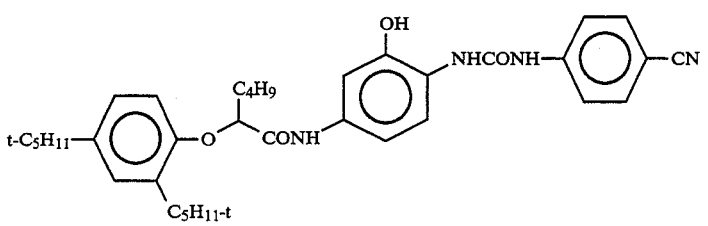

C-2

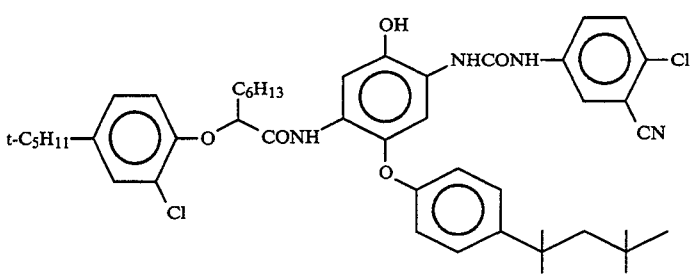

C-3

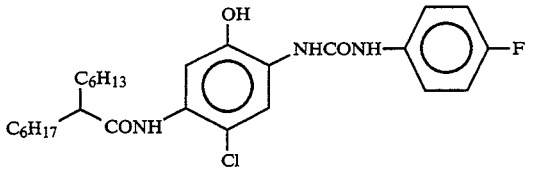

C-4

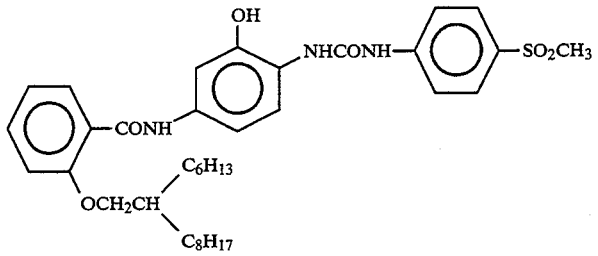

C-5

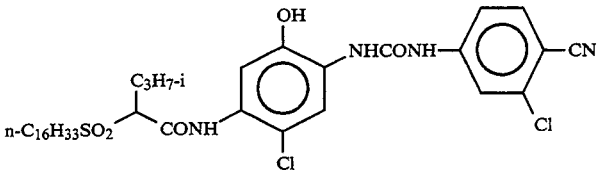

-continued
C-6
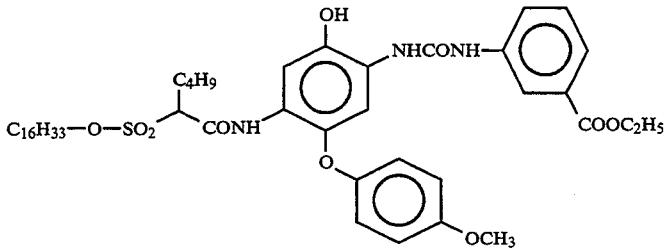
C-7
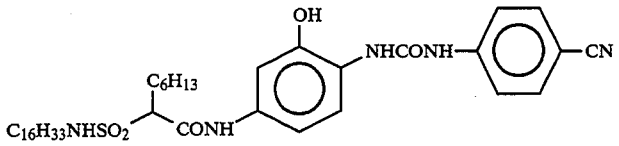
C-11
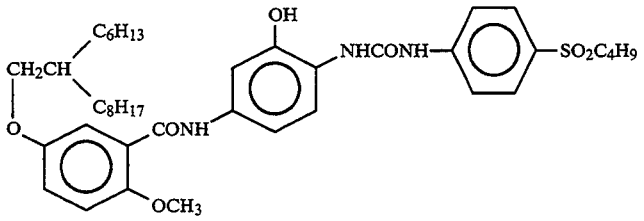
C-12
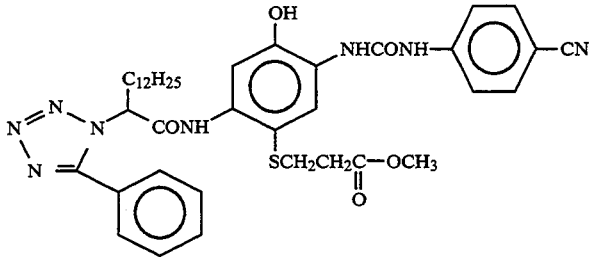
C-13
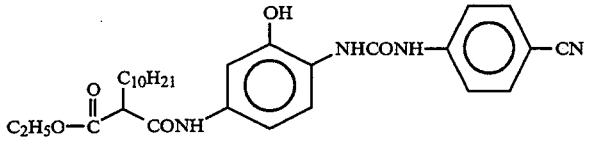
C-14
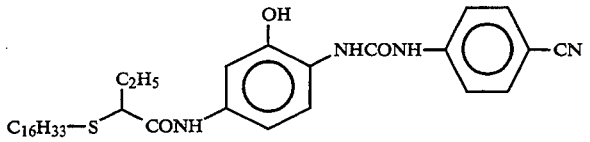
C-15
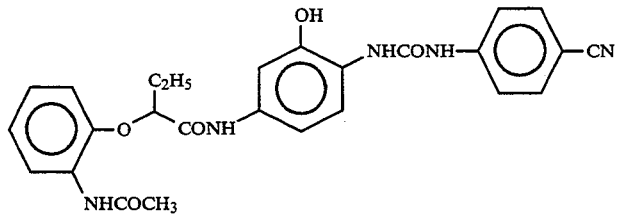

-continued

C-16

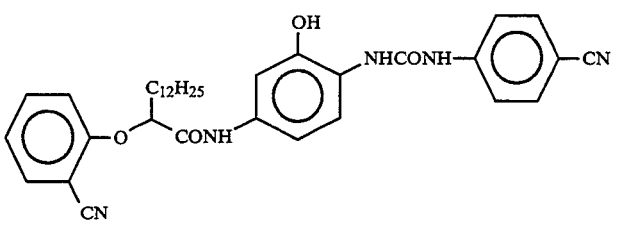

Formula (C-b)

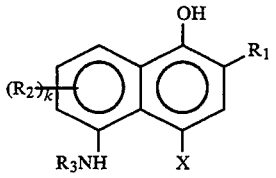

In Formula (C-b), $R_1$ represents $—CONR_4R_5$ or $—SO_2NR_4R_5$, $R_2$ represents a group substitutable on a naphthalene ring, k represents an integer from 0 to 3, and $R_3$ represents a group of alkyl, aralkyl, acyl, alkoxycarbonyl, alkylaminocarbonyl, or alkylsulfonyl. These groups may be further substituted by, e.g., a halogen atom or an alkoxy group. X represents a hydrogen atom or a group which can split off upon a coupling reaction with the oxidized form of an aromatic primary amine developing agent. Note that $R_4$ and $R_5$ may be identical or different and each independently represents a hydrogen atom, an alkyl group, an aryl group, or a heterocyclic group.

If k is the plural number, a plurality of $R_2$'s may be identical or different or may combine to form a ring. $R_2$ and $R_3$ or $R_3$ and X may combine to form a ring.

In addition, it may form dimers or polymers of a higher order which bond each other via a divalent group or a group of a higher valency in $R_1$, $R_2$, $R_3$, or X.

Practical examples of a coupler represented by Formula (C-b) are presented below, but the present invention is not limited to these examples.

C-17

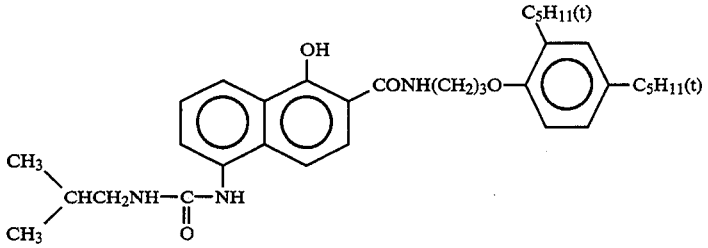

C-18

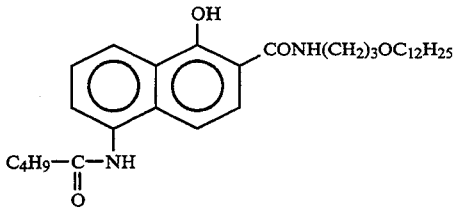

C-19

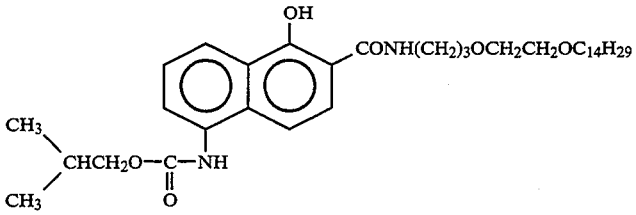

C-20

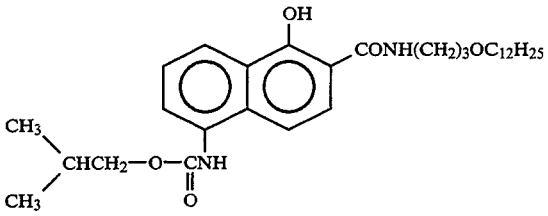

-continued

C-21

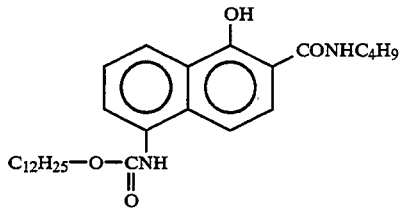

C-22

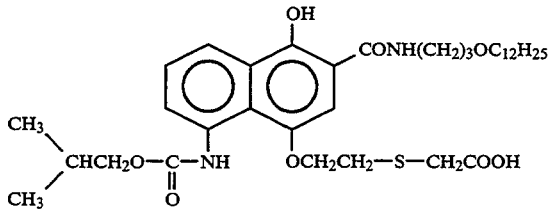

C-23

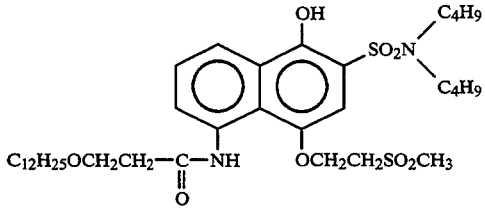

C-24

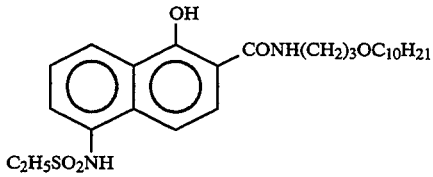

Typical examples of a polymerized dye-forming coupler are described in U.S. Pat. Nos. 3,451,820, 4,080,221, 4,367,288, 4,409,320, and 4,576,910, British Patent 2,102,173, and EP 341,188A.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Preferable examples of a colored coupler for correcting additional, undesirable absorption of a colored dye are those described in Research Disclosure No. 17643, VII-G and No. 307105, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may De preferably used.

Couplers releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler for imagewise releasing a nucleating agent or a development accelerator are described in British Patents 2,097,140 and 2,131,188, JP-A-59-157638, and JP-A-59-170840. It is also preferable to use compounds described in JP-A-60-107029, JP-A-60-252340, JP-A-1-44940, and JP-A-1-45687, which release, e.g., a fogging agent, a development accelerator, or a silver halide solvent upon a redox reaction with the oxidized form of a developing agent.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; bleaching accelerator releasing couplers described in, e.g., RD. Nos. 11,449 and 24,241 and JP-A-61-201247; a ligand releasing coupler described in, e.g., U.S. Pat. No. 4,553,477; a coupler which releases a leuco dye described in JP-A-63-75747; and a coupler which releases a fluorescent dye described in U.S. Pat. No. 4,774,181.

Various types of antiseptic agents or mildewproofing agents are preferably added to the color light-sensitive material of the present invention. Examples of the antiseptic agent and the mildewproofing agent are phenethyl alcohol and those described in JP-A-63-257747, JP-A-62-272248, and JP-A-1-80941, such as 1,2-benzisothiazoline-3-one, n-butyl-p-hydroxybenzoate, phenol, 4-chloro-3,5-dimethylphenol, 2-phenoxyethanol, and 2-(4-thiazolyl)benzimidazole.

The present invention can be applied to various color light-sensitive materials. Representative examples of the material are color negative films for general purposes or movies.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the total film thickness of all hydrophilic colloid layers on the side having emulsion layers is preferably 28 μm or less, more preferably 23 μm or less, particularly preferably 18 μm or less, and most preferably 16 μm or less. The film swell speed $T_{\frac{1}{2}}$ can be measured in accordance with a known method in this field of art. For example, the film swell speed $T_{\frac{1}{2}}$ can be measured by using a swell meter described in Photogr. Sci Eng., A. Green et al., Vol. 19, No. 2, pp. 124 to 129. Assuming that 90% of a maximum swell film thickness reached by performing a treatment by using a color developing agent at 30° C. for 3 min. and 15 sec. is defined as a saturated film thickness, $T_{\frac{1}{2}}$ is defined as a time required to reach ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness—film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, page 615, the left to right columns, and RD No. 307105, pp. 880 and 881.

A color developer used in development of the light-sensitive material of the present invention is preferably an aqueous alkaline solution containing an aromatic primary amine-based color developing agent as its major constituent. As this color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino—N-ethyl—N-β-hydroxyethylaniline, 3-methyl-4-amino—N-ethyl—N-βmethanesulfonamidoethylani line, 3-methyl-4-amino—N-ethyl—N-β-methoxyethylaniline, and sulfates, hydrochlorides and p-toluenesulfonates thereof. Of these compounds, 3-methyl-4-amino—N-ethyl—N-β-hydroxyethylaniline sulfate is most preferred. These compounds can be used in a combination of two or more types of them in accordance with the intended use.

In general, the color developer contains a pH buffering agent such as a carbonate, a borate, or a phosphate of an alkali metal, and a development restrainer or an antifoggant such as a bromide, an iodide, benzimidazoles, benzothiazoles, or a mercapto compound. If necessary, the color developer may also contain preservatives such as hydroxylamine, diethylhydroxylamine, a sulfite, hydrazines such as N,N-biscarboxymethylhydrazine, phenylsemicarbazides, triethanolamine, and catechol sulfonic acids; organic solvents such as ethylene glycol and diethylene glycol; development accelerators such as benzyl alcohol, polyethylene glycol, a quaternary ammonium salt, and amines; dye forming couplers; competing couplers; auxiliary developing agents such as 1-phenyl-3-pyrazolidone; viscosity imparting agents; and chelating agents such as aminopolycarboxylic acid, aminopolyphosphonic acid, alkylphosphonic acid, and phosphonocarboxylic acid. Representative examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., dihydroxybenzenes such as hydroquinone, 3-pyrazolidones such as 1-phenyl-3-pyrazolidone, and aminophenols such as N-methyl-p-aminophenol can be used singly or in a combination of two or more types of them.

The pH of the color and black-and-white developers is generally 9 to 12. Although the quantity of replenisher of these developers depends on a color photographic light-sensitive material to be processed, it is generally 3 liters or less per $m^2$ of the light-sensitive material. The quantity of replenisher can be decreased to be 500 ml or less by decreasing a bromide ion concentration in the replenisher. In order to decrease the quantity of replenisher, a contact area of a processing tank with air is preferably decreased to prevent evaporation and oxidation of the replenisher upon contact with air.

A contact area of a photographic processing solution with air in a processing tank can be represented by an aperture defined below:

$$\text{Aperture} = \frac{\text{contact area (cm}^2\text{) of processing solution with air}}{\text{volume (cm}^3\text{) of processing solution}}$$

The above aperture is preferably 0.1 or less, and more preferably, 0.001 to 0.05. In order to reduce the aperture, a shielding member such as a floating cover may be provided on the liquid surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, a quantity of replenisher can be reduced by using a means of suppressing storage of bromide ions in the developing solution.

A color development time is normally two to five minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, according to the intended use. Examples of the bleaching agent are a compound of a multivalent metal such as iron(III), peroxides, quinones, and a nitro compound. Typical examples of the bleaching agent are organic complex salts of iron(III), e.g., complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid; and complex salts of citric acid, tartaric acid, and malic acid. Of these compounds, iron(III) complex salts of aminopolycarboxylic acids such as iron(III) complex salts of ethylenediaminetetraacetic acid and 1,3-diaminopropanetetraacetic acid are preferred because they can increase a processing speed and prevent an environmental contamination. The iron(III) complex salt of aminopolycarboxylic acid is particularly useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-baths, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-104232, JP-A-53-124424, JP-A-53-141623, JP-A-53-28426, and Research Disclosure No. 17,129 (July, 1978); a thiazolidine derivative described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds descried in west German Patents 966,410 and 2,748,430; a polyamine compound described in JP-B-45-8836; compounds described in JP-A-49-40943, JP-A-49-59644, JP-A-53-94927, JP-A-54-35727, JP-A-55-26506, and JP-A-58-163940; and a bromide ion. Of these compounds, the compound having a mercapto group or a disulfide group is preferable since the compound has a large accelerating effect. In particular, the compounds described in U.S. Pat. No. 3,893,858, West German Patent 1,290,812, and JP-A-53-95630 are preferred. The compound described in U.S. Pat. No. 4,552,834 is also preferable. These bleaching accelerators may be added to the light-sensitive material. These bleaching accelerators are useful especially in bleach-fixing a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, for example, acetic acid, propionic acid, and hydroxyacetic acid.

Examples of the fixing agent are thiosulfate, a thiocyanate, a thioether-based compound, thioureas, and a large amount of an iodide. Of these compounds, a thiosulfate, especially, ammonium thiosulfate can be used in the widest range of applications. In addition, a combination of a thiosulfate and a thiocyanate, a thioether-based compound, or a thiourea is preferably used. As a preservative of the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mols/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no poor desilvering occurs. A preferable time is one to three minutes, and more preferably, one to two minutes. A processing temperature is 25° C. to 50° C., and preferably, 35° C. to 45° C. within the preferable temperature range, a desilvering speed is increased, and generation of a stain after the processing can be effectively prevented.

In the desilvering step, stirring is preferably as strong as possible. Examples of a method of strengthening the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyor means described in JP-A-60-191257, JP-A-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect significantly shortens especially a processing time in each processing step and reduces a processing solution replenishing amount.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the intended use of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955).

According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. It is also possible to use a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, EiseigtJutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing the photographic light-sensitive material of the present invention is 4 to 9, and preferably, 5 to 8. The water temperature and the washing time can vary in accordance with the properties and the intended use of the light-sensitive material. Commonly, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. An example is a stabilizing bath containing a dye stabilizing agent and a surface-active agent to be used as a final bath of the photographic color light-sensitive material. Examples of the dye stabilizing agent are aldehydes such as formalin and glutaraldehyde, an N-methylol compound, hexamethylenetetramine, and an aldehyde sulfurous acid adduct.

Various chelating agents or antifungal agents can also be added to the stabilizing bath.

An overflow solution produced upon washing and/or replenishment of the stabilizing solution can be reused in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify the processing and increase the processing speed. For this purpose, various types of precursors of color developing agents can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical compounds are described in, e.g., JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to thermal development light-sensitive materials described in, e.g., U.S. Pat. No. 4,500,626, JP-A-60-133449, JP-A-59-218443, JP-A-61-238056, and EP 210,660A2.

EXAMPLES

The present invention will be described in more detail below by way of its examples, but the present invention is not limited to these examples.

EXAMPLE 1

A sample 1 was made by coating emulsion and protective layers in amounts described below on a triacetylcellulose film support having a subbing layer.

| | |
|---|---|
| <Emulsion layer> | |
| Emulsion An emulsion (emulsion I) in which an average sphere-equivalent diameter is 0.8 μm, 90% or more of the projected area of all grains are occupied by tabular grains, an average aspect ratio is 6, and a silver iodide content is 4 mol %. | (silver $1.85 \times 10^{-2}$ mol/m$^2$) |
| Sensitizing dye S-2 | ($6 \times 10^{-4}$ mol with respect to silver) |
| Coupler | ($1.54 \times 10^{-3}$ mol/m$^2$) |

-continued

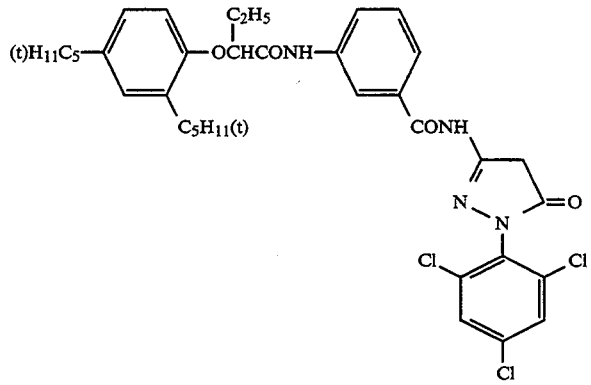

| | |
|---|---|
| Tricresylphosphate | (1.10 g/m$^2$) |
| Gelatin | (2.30 g/m$^2$) |
| <Protective layer> | |
| Sodium 2,4-dichlorotriazine-6-hydroxy-S-triazine | (0.08 g/m$^2$) |
| Gelatin | (1.80 g/m$^2$) |

Samples 2 to 13 were made following the same procedures as for the sample 1 except that the emulsion layer of each of the samples was also added with a compound for releasing a development inhibitor or a precursor of a development inhibitor or a compound which cleaves after reacting with the oxidizing form of a color developing agent, the cleaved compound of which in turn reacts with another molecule of the oxidized form of a color developing agent to cleave a development inhibitor, and a compound represented by Formula (A) or (B) as shown in Table 1.

TABLE 1

| Sample No. | Remarks | DIR compound | Compound represented by Formula (A) or (B) |
|---|---|---|---|
| 1 | Comparative example | — | — |
| 2 | Comparative example | — | (A-18), $1 \times 10^{-2}$ mol with respect to silver |
| 3 | Comparative example | D-5 $7.7 \times 10^{-5}$ mol/m$^2$ | — |
| 4 | Comparative example | D-9 $7.2 \times 10^{-5}$ mol/m$^2$ | — |
| 5 | Present invention | D-5 $7.7 \times 10^{-5}$ mol/m$^2$ | (A-18), $1 \times 10^{-2}$ mol with respect to silver |
| 6 | Present invention | D-9 $7.2 \times 10^{-5}$ mol/m$^2$ | (A-18), $1 \times 10^{-2}$ mol with respect to silver |
| 7 | Present invention | D-5 $7.7 \times 10^{-5}$ mol/m$^2$ | (A-7), $1 \times 10^{-2}$ mol with respect to silver |
| 8 | Present invention | D-5 $7.7 \times 10^{-5}$ mol/m$^2$ | (A-15), $1 \times 10^{-2}$ mol with respect to silver |
| 9 | Present invention | D-5 $7.7 \times 10^{-5}$ mol/m$^2$ | (A-50), $1 \times 10^{-2}$ mol with respect to silver |
| 10 | Present invention | D-5 $7.7 \times 10^{-5}$ mol/m$^2$ | (B-1), $1 \times 10^{-2}$ mol with respect to silver |
| 11 | Present invention | D-5 $7.7 \times 10^{-5}$ mol/m$^2$ | (B-3), $1 \times 10^{-2}$ mol with respect to silver |
| 12 | Present invention | D-5 $7.7 \times 10^{-5}$ mol/m$^2$ | (B-10), $1 \times 10^{-2}$ mol with respect to silver |
| 13 | Present invention | D-5 $7.7 \times 10^{-5}$ mol/m$^2$ | (B-30) $1 \times 10^{-2}$ mol with respect to silver |

These samples were subjected to sensitometry exposure and the color development described below.

The density of each developed sample was measured through a green filter.

The development was performed at 38° C. under the following conditions.

| | |
|---|---|
| 1. Color development | 1 min. 45 sec. |
| 2. Bleaching | 6 min. 30 sec. |
| 3. Washing | 3 min. 15 sec. |
| 4. Fixing | 6 min. 30 sec. |
| 5. Washing | 3 min. 15 sec. |
| 6. Stabilization | 3 min. 15 sec. |

The compositions of processing solutions used in the individual steps were as follows.

| <Color developing solution> | |
|---|---|
| Sodium nitrilotriacetate | 1.4 g |
| Sodium sulfite | 4.0 g |
| Sodium carbonate | 30.0 g |
| Potassium bromide | 1.4 g |
| Hydroxylamine sulfate | 2.4 g |
| 4-(N-ethyl-N-β-hydroxyethylamino)- | 4.5 g |

-continued

| <Color developing solution> | |
|---|---|
| 2-methyl-aniline sulfate | |
| Water to make | 1 l |

| <Bleaching solution> | |
|---|---|
| Ferric sodium ethylenediamine-tetraacetate trihydrate | 100.0 g |
| Disodium ethylenediaminetetraacetate | 10.0 g |
| 3-mercapto-1,2,4-triazole | 0.08 g |
| Ammonium bromide | 140.0 g |
| Ammonium nitrate | 30.0 g |
| Ammonia water (27%) | 6.5 ml |
| Water to make | 1 l |
| pH | 6.0 |

| <Fixing solution> | |
|---|---|
| Disodium ethylenediaminetetraacetate | 0.5 g |
| Ammonium sulfite | 20.0 g |
| Aqueous ammonium thiosulfate solution (700 g/l) | 290.0 ml |
| Water to make | 1 l |
| pH | 6.7 |

| <Stabilizing solution> | |
|---|---|
| Sodium p-toluenesulfinate | 0.03 g |
| Polyoxyethylene-p-monononyl phenylether (average polymerization degree = 10) | 0.2 g |
| Disodium ethylenediaminetetraacetate | 0.05 g |
| 1,2,4-triazole | 1.3 g |
| 1,4-bis(1,2,4-triazole-1-ylmethyl) piperazine | 0.75 g |
| Water to make | 1 l |
| pH | 8.5 |

Note that the exposure was performed by conventional wedge exposure for 1/100 sec.

Note also that as the light source, an SC-50 filter (available from Fuji Photo Film Co., Ltd.) adjusted to have a color temperature of 4,800° K. by using a filter was used.

In the following description, measurement values concerning "fog" and "sensitivity" have the following respective meanings.

Fog: The fog is the minimum optical density on a characteristic curve. The larger the value, the worse the condition.

Sensitivity: The sensitivity is the reciprocal of an exposure value (antilogarithm) at which an optical density of minimum optical density +0.2 is given on a characteristic curve; the sensitivity is herein represented as a relative value assuming that the sensitivity of the sample 1 is 100. The larger the value, the higher and more preferable the sensitivity.

The following processing was performed to evaluate latent image stability. That is, after wedge-exposed in the same manner as described above, the individual samples were aged in an atmosphere at a temperature of 50° C. and a relative humidity of 30% for seven days and then subjected to the color development as described above. The obtained data were compared with those obtained when development was performed immediately after exposure. The obtained fog difference was taken to be a representative value of fog with time, and the obtained sensitivity difference was taken to be a representative value of latensification and latent image fading.

These results are summarized in Table 2.

TABLE 2

| Sample No. | Remarks | Properties immediately after coating: Fog | Properties immediately after coating: Sensitivity | Changes due to storage of latent image: Increase in fog | Changes due to storage of latent image: Change in sensitivity |
|---|---|---|---|---|---|
| 1 | Comparative example | 0.15 | 100 | 0.12 | +2 |
| 2 | Comparative example | 0.15 | 101 | 0.10 | −2 |
| 3 | Comparative example | 0.10 | 71 | 0.09 | +55 |
| 4 | Comparative example | 0.11 | 68 | 0.09 | +45 |
| 5 | Present invention | 0.10 | 71 | 0.05 | +2 |
| 6 | Present invention | 0.10 | 67 | 0.05 | +4 |
| 7 | Present invention | 0.11 | 73 | 0.07 | +3 |
| 8 | Present invention | 0.10 | 72 | 0.05 | +2 |
| 9 | Present invention | 0.10 | 71 | 0.05 | +3 |
| 10 | Present invention | 0.09 | 73 | 0.06 | +1 |
| 11 | Present invention | 0.08 | 65 | 0.05 | +3 |
| 12 | Present invention | 0.10 | 70 | 0.06 | +2 |
| 13 | Present invention | 0.07 | 61 | 0.05 | +1 |

The effects of the present invention are apparent from Table 2. That is, as can be seen by comparing the comparative sample 1 with the comparative samples 3 and 4, the addition of DIR compounds D-5 and D-9 facilitated latensification during latent image storage. The difference between the samples 1 and 2 not containing DIR compounds was small even when a compound represented by Formula (A) or (B) of the present invention was added. However, the comparison between the sample 3 containing the DIR compound and the samples 5 and 7 to 13 of the present invention or the comparison between the sample 4 and the sample 6 of the present invention reveals that the latensification preventing effect obtained by a compound represented by Formula (A) or (B) of the present invention was remarkable in the presence of the DIR compounds. It was also found that an increase in fog during storage was suppressed.

In addition, it is apparent by comparing the sample 13 using B-30 with the samples 5 and 7 to 12 using other compounds that the sensitivity was slightly decreased when the compound B-30 which reacts with the oxidized form of a color developing agent; that is, it is more preferable to use A-7, A-15, A-18, A-50, B-1, and B-10, each of which does not substantially react with the oxidized form of a color developing agent.

EXAMPLE 2

Samples 201 to 226 were made following the same procedures as for the sample No. 5 in Example 1 except that the emulsion, the sensitizing dye, and a compound represented by Formula (A) or (B) of the present invention were changed as shown in Table 3.

TABLE 3

| Sample No. | Remarks | Emulsion | Sensitizing dye | Compound represented by Formula (A) or (B) |
|---|---|---|---|---|
| 201 | Present invention | II | S-2 (with respect to silver) $4 \times 10^{-4}$ mol | (A-18) (with respect to silver) $1 \times 10^{-2}$ mol |
| 202 | Present invention | " | S-2 $6 \times 10^{-4}$ mol | (A-18) (with respect to silver) $1 \times 10^{-2}$ mol |
| 203 | Present invention | " | S-2 $8 \times 10^{-4}$ mol | (A-18) (with respect to silver) $1 \times 10^{-2}$ mol |
| 204 | Present invention | III | S-2 $4 \times 10^{-4}$ mol | (A-18) (with respect to silver $1 \times 10^{-2}$ mol |
| 205 | Present invention | " | S-2 $6 \times 10^{-4}$ mol | (A-18) (with respect to silver $1 \times 10^{-2}$ mol |
| 206 | Present invention | " | S-2 $8 \times 10^{-4}$ mol | (A-18) (with respect to silver) $1 \times 10^{-2}$ mol |
| 207 | Present invention | I | S-2 $4 \times 10^{-4}$ mol | (A-18) (with respect to silver) $1 \times 10^{-2}$ mol |
| 208 | Present invention | " | S-2 $6 \times 10^{-4}$ mol | (A-18) (with respect to silver) $1 \times 10^{-2}$ mol |
| 209 | Present invention | " | S-2 $8 \times 10^{-4}$ mol | (A-18) (with respect to silver) $1 \times 10^{-2}$ mol |
| 210 | Present invention | IV | S-2 $4 \times 10^{-4}$ mol | (A-18) (with respect to silver) $1 \times 10^{-2}$ mol |
| 211 | Present invention | " | S-2 $6 \times 10^{-4}$ mol | (A-18) (with respect to silver) $1 \times 10^{-2}$ mol |
| 212 | Present invention | " | S-2 $8 \times 10^{-4}$ mol | (A-18) (with respect to silver) $1 \times 10^{-2}$ mol |
| 213 | Comparative example | II | S-2 (with respect to silver) $4 \times 10^{-4}$ mol | — |
| 214 | Comparative example | " | S-2 $6 \times 10^{-4}$ mol | — |
| 215 | Comparative example | " | S-2 $8 \times 10^{-4}$ mol | — |
| 216 | Comparative example | III | S-2 $4 \times 10^{-4}$ mol | — |
| 217 | Comparative example | " | S-2 $6 \times 10^{-4}$ mol | — |
| 218 | Comparative example | " | S-2 $8 \times 10^{-4}$ mol | — |
| 219 | Comparative example | I | S-2 $4 \times 10^{-4}$ mol | — |
| 220 | Comparative example | " | S-2 $6 \times 10^{-4}$ mol | — |
| 221 | Comparative example | " | S-2 $8 \times 10^{-4}$ mol | — |
| 222 | Comparative example | IV | S-2 $4 \times 10^{-4}$ mol | — |
| 223 | Comparative example | " | S-2 $6 \times 10^{-4}$ mol | — |
| 224 | Comparative example | " | S-2 $8 \times 10^{-4}$ mol | — |
| 225 | Comparative example | " | S-2 $6 \times 10^{-4}$ mol | — |
| 226 | Present invention | " | S-2 $6 \times 10^{-4}$ mol | A-18 $1 \times 10^{-2}$ mol |

The emulsions used were as follows.

Emulsion I: An emulsion identical with the emulsion I used in Example 1.

Emulsion II: An emulsion identical with the emulsion I except that an aspect ratio was 2.5.

Emulsion III: An emulsion identical with the emulsion I except that an aspect ratio was 4.0.

Emulsion IV: An emulsion identical with the emulsion I except that an aspect ratio was 12.

Emulsion V: An emulsion identical with the emulsion I except that reduction sensitization was performed inside grains and the grain surface was oxidized.

These samples were processed following the same procedures as in Example 1. The results are summarized in Table 4. Note that the sensitivity is represented by a relative value assuming that the sensitivity of the sample 201 is 100.

TABLE 4

| Sample No. | Remarks | Properties immediately after coating: Fog | Sensitivity | Changes due to storage of latent image: Increase in fog | Change in sensitivity |
|---|---|---|---|---|---|
| 201 | Present invention | 0.15 | 100 | 0.10 | +3 |
| 202 | Present invention | 0.12 | 90 | 0.04 | −1 |
| 203 | Present invention | 0.07 | 60 | 0.03 | −3 |
| 204 | Present invention | 0.15 | 105 | 0.08 | +1 |
| 205 | Present invention | 0.13 | 120 | 0.05 | +3 |
| 206 | Present invention | 0.09 | 110 | 0.04 | −1 |
| 207 | Present invention | 0.14 | 120 | 0.07 | ±0 |
| 208 | Present invention | 0.10 | 140 | 0.05 | +2 |
| 209 | Present invention | 0.08 | 142 | 0.04 | +5 |
| 210 | Present invention | 0.13 | 105 | 0.07 | −1 |
| 211 | Present invention | 0.14 | 122 | 0.05 | +3 |
| 212 | Present invention | 0.16 | 150 | 0.04 | +8 |
| 213 | Comparative example | 0.16 | 100 | 0.15 | +40 |
| 214 | Comparative example | 0.12 | 91 | 0.11 | +50 |
| 215 | Comparative example | 0.08 | 61 | 0.03 | +45 |
| 216 | Comparative example | 0.15 | 104 | 0.13 | +38 |
| 217 | Comparative example | 0.12 | 119 | 0.10 | +52 |
| 218 | Comparative example | 0.09 | 109 | 0.08 | +65 |
| 219 | Comparative example | 0.14 | 120 | 0.12 | +35 |
| 220 | Comparative example | 0.11 | 139 | 0.07 | +55 |
| 221 | Comparative example | 0.09 | 143 | 0.07 | +75 |
| 222 | Comparative example | 0.13 | 104 | 0.12 | +30 |
| 223 | Comparative example | 0.15 | 121 | 0.08 | +58 |
| 224 | Comparative example | 0.17 | 148 | 0.08 | +90 |
| 225 | Comparative example | 0.13 | 180 | 0.15 | +95 |
| 226 | present invention | 0.13 | 180 | 0.06 | +10 |

Table 4 reveals that the tabular emulsion with an aspect ratio of 3 or more was preferable because its sensitivity was increased when the amount of the sensitizing dye was increased, but its latensification was degraded accordingly, and that the use of the compound A-18 of the present invention improved the degraded latent image performance.

As can also be seen by comparing the samples 220, 208, 225, and 226 that the reduction-sensitized emulsion was preferable because of its high sensitivity but also had undesirable side effects of increases in latensification and fog during storage, and that the compound A-18 of the present invention was able to remove these side effects.

EXAMPLE 3

Layers having the compositions presented below were coated on a subbed triacetylcellulose film support to make a multilayered color light-sensitive material, a sample 301.

Compositions of light-sensitive layers

The main materials used in the individual layers are classified as follows.

ExC: Cyan coupler
UV: Ultraviolet absorbent
ExM: Magenta coupler
HBS: High-boiling organic solvent
ExY: Yellow coupler
H: Gelatin hardener
ExS: Sensitizing dye The number corresponding to each component indicates the coating amount in units of g/m$^2$. The coating amount of a silver halide is represented by the amount of silver. The coating amount of each sensitizing dye is represented in units of mols per mol of a silver halide in the same layer.

| (Sample 301) | |
|---|---|
| 1st layer (Antihalation layer) | |
| Black colloidal silver | silver 0.18 |
| Gelatin | 1.40 |
| YM-2 (compound of the present invention) | 0.18 |
| ExF-1 | $2.0 \times 10^{-3}$ |
| 2nd layer (Interlayer) | |
| Emulsion G | silver 0.065 |
| 2,5-di-t-pentadecylhydroquinone | 0.18 |
| CII-3 (compound of the present invention) | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| 3rd layer (Low-speed red-sensitive emulsion layer) | |
| Emulsion A | silver 0.25 |
| Emulsion B | silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-4 | 0.17 |
| UV-1 | 0.070 |
| UV-2 | 0.050 |
| UV-3 | 0.070 |
| HBS-1 | 0.060 |
| Gelatin | 0.87 |
| 4th layer (Medium-speed red-sensitive emulsion layer) | |
| Emulsion D | silver 0.80 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.20 |
| CII-3 (compound of the present invention) | 0.050 |
| ExC-4 | 0.20 |
| YC-26 (compound of the present invention) | 0.050 |
| UV-1 | 0.070 |
| UV-2 | 0.050 |
| UV-3 | 0.070 |
| Gelatin | 1.30 |
| 5th layer (High-speed red-sensitive emulsion layer) | |
| Emulsion E | silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.097 |
| CII-3 (compound of the present invention) | 0.010 |
| ExC-3 | 0.065 |
| ExC-6 | 0.020 |
| HBS-1 | 0.22 |
| HBS-2 | 0.10 |
| Gelatin | 1.63 |
| 6th layer (Interlayer) | |
| Cpd-1 | 0.040 |
| HBS-1 | 0.020 |

-continued (Sample 301)

| | |
|---|---|
| Gelatin | 0.80 |
| 7th layer (Low-speed green-sensitive emulsion layer) | |
| Emulsion C | silver 0.30 |
| ExS-4 | $2.6 \times 10^{-5}$ |
| ExS-5 | $1.8 \times 10^{-4}$ |
| ExS-6 | $6.9 \times 10^{-4}$ |
| YM-1 (compound of the present invention) | 0.021 |
| ExM-2 | 0.26 |
| YM-9 (compound of the present invention) | 0.030 |
| HBS-1 | 0.10 |
| HBS-3 | 0.010 |
| Gelatin | 0.63 |
| 8th layer (Medium-speed green-sensitive emulsion layer) | |
| Emulsion D | silver 0.55 |
| ExS-4 | $2.2 \times 10^{-5}$ |
| ExS-5 | $1.5 \times 10^{-4}$ |
| ExS-6 | $5.8 \times 10^{-4}$ |
| ExM-2 | 0.094 |
| YM-9 (compound of the present invention) | 0.026 |
| HBS-1 | 0.16 |
| HBS-3 | $8.0 \times 10^{-3}$ |
| Gelatin | 0.50 |
| 9th layer (High-speed green-sensitive emulsion layer) | |
| Emulsion E | silver 1.55 |
| ExS-4 | $4.6 \times 10^{-5}$ |
| ExS-5 | $1.0 \times 10^{-4}$ |
| ExS-6 | $3.9 \times 10^{-4}$ |
| ExC-1 | 0.015 |
| YM-1 (compound of the present invention) | 0.013 |
| ExM-4 | 0.065 |
| ExM-5 | 0.019 |
| HBS-1 | 0.25 |
| HBS-2 | 0.10 |
| Gelatin | 1.54 |
| 10th layer (Yellow filter layer) | |
| Yellow colloidal silver | silver 0.035 |
| Cpd-1 | 0.080 |
| HBS-1 | 0.030 |
| Gelatin | 0.95 |
| 11th layer (Low-speed blue-sensitive emulsion layer) | |
| Emulsion C | silver 0.18 |
| ExS-7 | $8.6 \times 10^{-4}$ |
| ExY-2 | 0.72 |
| HBS-1 | 0.28 |
| Gelatin | 1.10 |
| 12th layer (Medium-speed blue-sensitive emulsion layer) | |
| Emulsion D | silver 0.40 |
| ExS-7 | $7.4 \times 10^{-4}$ |
| ExY-2 | 0.15 |
| HBS-1 | 0.050 |

-continued (Sample 301)

| | |
|---|---|
| Gelatin | 0.78 |
| 13th layer (High-speed blue-sensitive emulsion layer) | |
| Emulsion F | silver 0.70 |
| ExS-7 | $2.8 \times 10^{-4}$ |
| ExY-2 | 0.20 |
| HBS-1 | 0.070 |
| Gelatin | 0.69 |
| 14th layer (1st protective layer) | |
| Emulsion G | silver 0.020 |
| UV-4 | 0.11 |
| UV-5 | 0.17 |
| HBS-1 | $5.0 \times 10^{-2}$ |
| Gelatin 1.00 | |
| 15th layer (2nd protective layer) | |
| H-1 | 0.40 |
| B-1 (diameter 1.7 fm) | $5.0 \times 10^{-2}$ |
| B-2 (diameter 1.7 fm) | 0.10 |
| B-3 | 0.10 |
| S-1 | 0.20 |
| Gelatin | 1.20 |

In addition to the above components, to improve storage stability, processability, a resistance to pressure, antiseptic and mildewproofing properties, antistatic properties, and coating properties, the individual layers contained w-1 to W-3, B-4 to B-6, F-1 to F-17, iron salt, lead salt, gold salt, platinum salt, iridium salt, and rhodium salt.

TABLE 5

| Emulsion | Average AgI content (%) | Average grain size (μm) | variation coefficient (%) according to grain size | Diameter/ thickness ratio | Silver amount ratio [core/intermediate/ shell] (AgI content) | Grain structure/shape |
|---|---|---|---|---|---|---|
| Emulsion A | 4.0 | 0.45 | 27 | 1 | [1/3] (13/1) | Double-structure octahedral grain |
| Emulsion B | 8.9 | 0.70 | 14 | 1 | [3/7] (25/2) | Double-structure octahedral grain |
| Emulsion C | 2.0 | 0.55 | 25 | 7 | — | Uniform-structure octahedral grain |
| Emulsion D | 9.0 | 0.65 | 25 | 6 | [12/59/29] (0/11/8) | Triple-structure octahedral grain |
| Emulsion E | 9.0 | 0.85 | 23 | 5 | [8/59/33] (0/11/8) | Triple-structure octahedral grain |
| Emulsion F | 14.5 | 1.25 | 25 | 3 | [37/63] (34/3) | Double-structure octahedral grain |
| Emulsion G | 1.0 | 0.07 | 15 | 1 | — | Uniform-structure octahedral grain |

In Table 5, (1) The emulsions A to F were subjected to reduction sensitization during grain preparation by using thiourea dioxide and thiosulfonic acid in accordance with the embodiments in JP-A-2-191938.

(2) The emulsions A to F were subjected to gold sensitization, sulfur sensitization, and selenium sensitization in the presence of the spectral sensitizing dyes described in the individual light-sensitive layers and sodium thiocyanate in accordance with the embodiments in JP-A-3-237450.

(3) The preparation of tabular grains was performed by using low-molecular weight gelatin in accordance with the embodiments in JP-A-1-158426.

(4) Dislocation lines as described in JP-A-3-237450 were observed in tabular grains and regular crystal grains having a grain structure when a high-voltage electron microscope was used.

ExC-1
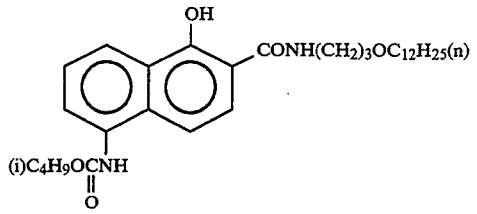
ExC-3
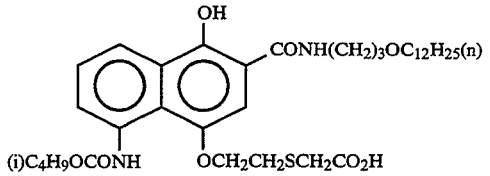
ExC-4
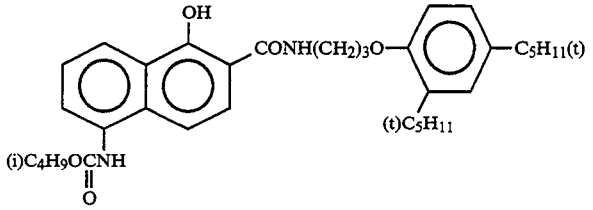
ExC-6
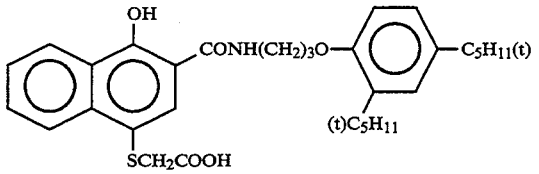
ExM-2
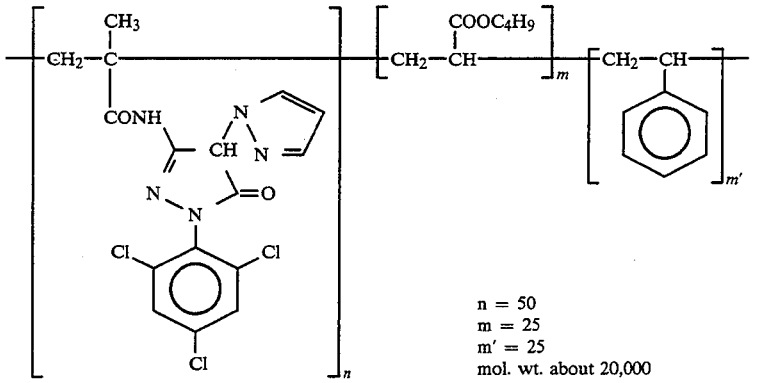
ExM-4
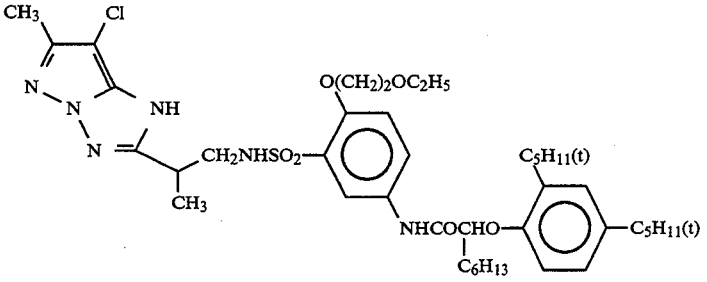

-continued
ExM-5
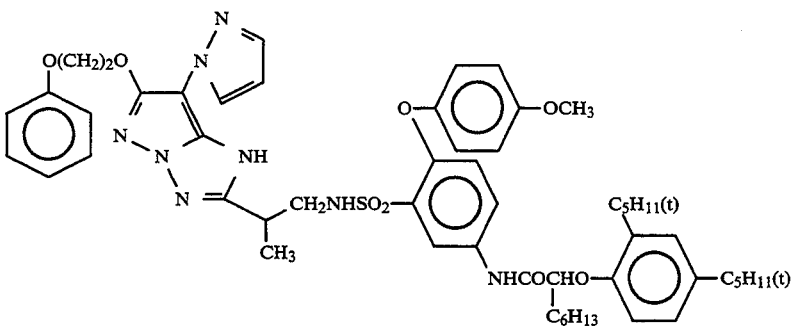
ExY-2
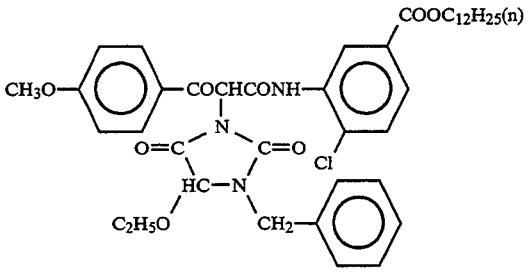
ExF-1
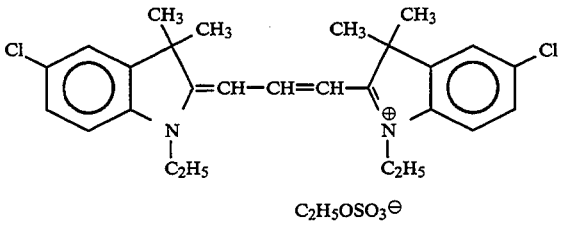
Cpd-1
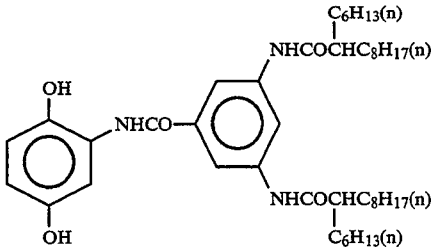
UV-1
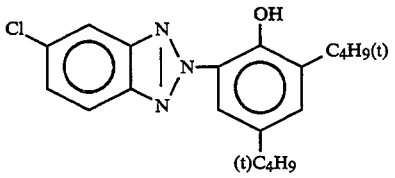
UV-2
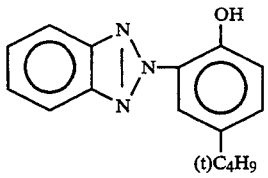
UV-3
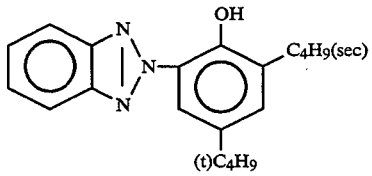

-continued
UV-4
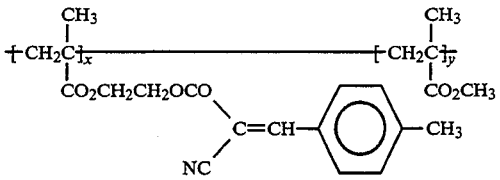
x:y = 70:30 (wt %)
UV-5
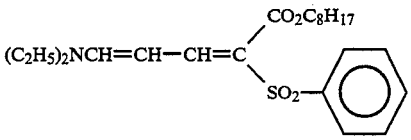
tricresylphosphate HBS-1
di-n-butylphtalate HBS-2
HBS-3
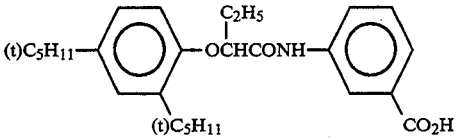
ExS-1
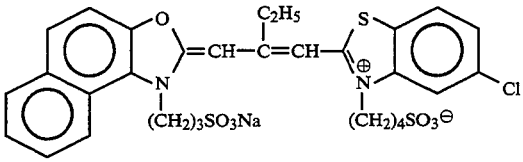
ExS-2
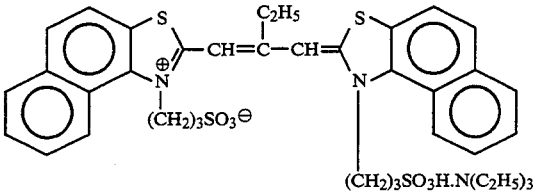
ExS-3
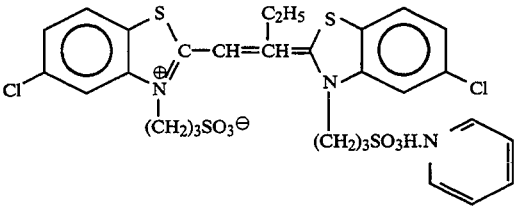
ExS-4
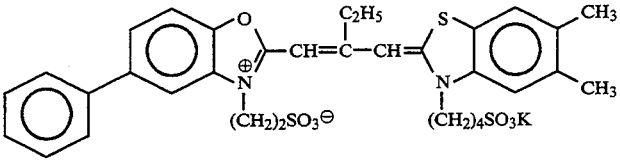
ExS-5
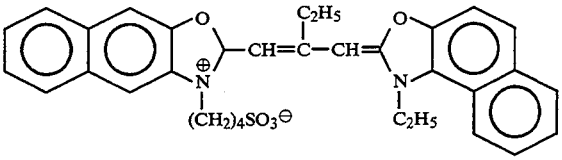

-continued
ExS-6
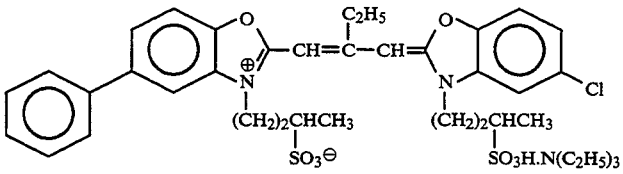
ExS-7
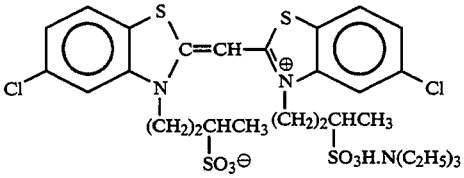
S-1
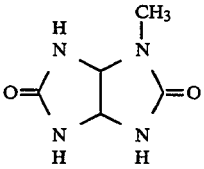
H-1
$CH_2{=}CH{-}SO_2{-}CH_2{-}CONH{-}CH_2$
$CH_2{=}CH{-}SO_2{-}CH_2{-}CONH{-}CH_2$
B-1
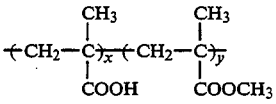
x/y = 10/90
B-2
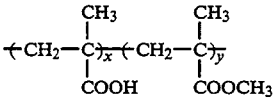
x/y = 40/60
B-3
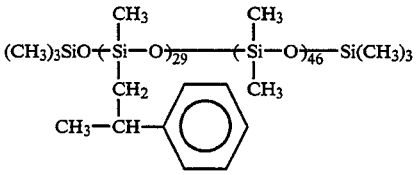
B-4
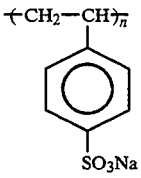
B-5
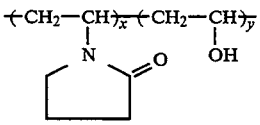
x/y = 70/30
B-6
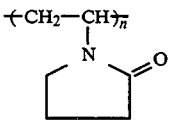
(mol. wt. 10,000)
W-1
$C_8F_{17}SO_2NHCH_2CH_2CH_2OCH_2CH_2N^{\oplus}(CH_3)_3$
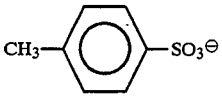

-continued
W-2
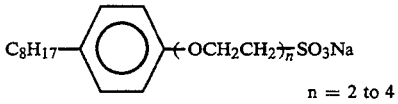
W-3
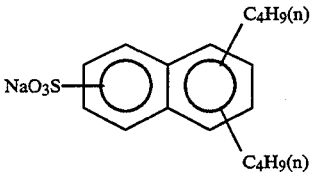
F-1
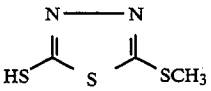
F-2
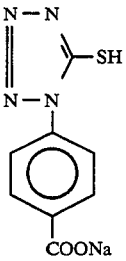
F-3
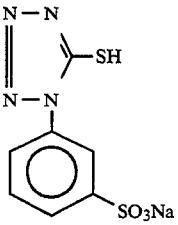
F-4
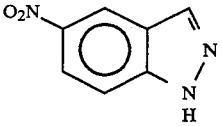
F-5
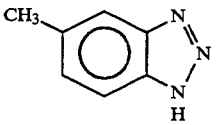
F-6
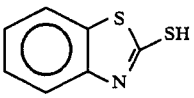
F-7
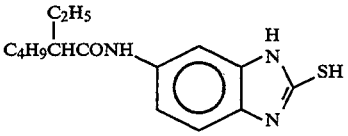

-continued

F-8

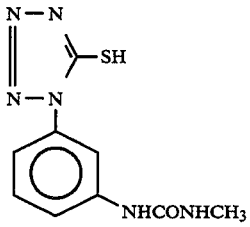

F-9

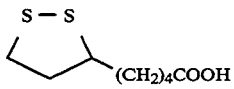

F-10

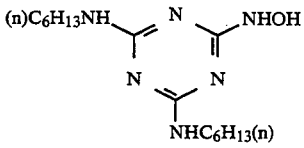

F-11

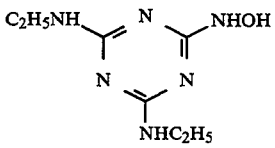

F-12

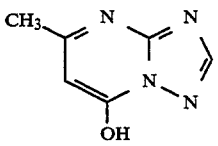

F-13

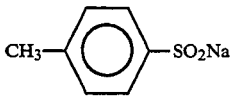

F-14

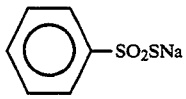

F-15

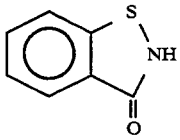

F-16

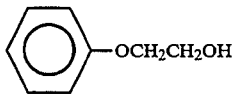

F-17

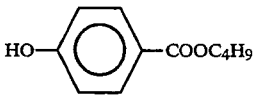

Samples 302–313

Samples 302 to 313 were made following the same procedures as for the sample 301 except that the types and addition amounts of compounds in the 3rd, 4th, 7th, 8th, and 11th layers were changed as shown in Table 6 and a compound represented by Formula (A) or (B) was added to the 3rd, 4th, 7th, and 8th layers as shown in Table 6.

TABLE 6

| Sample No. | 3rd layer | 4th layer | 7th layer | 8th layer | 11th layer |
|---|---|---|---|---|---|
| 302 | — | — | — | — | — |

TABLE 6-continued

| Sample No. | 3rd layer | 4th layer | 7th layer | 8th layer | 11th layer |
|---|---|---|---|---|---|
| (Comparative example) | — | — | — | — | (D-5) 0.04 g/m$^2$ |
| 303 (Comparative example) | (D-36) 0.02 g/m$^2$ — | (D-36) 0.015 g/m$^2$ — | (D-5) 0.025 g/m$^2$ — | (D-5) 0.018 g/m$^2$ — | (D-5) 0.042 g/m$^2$ — |
| 304 (Comparative example) | — (A-18) 0.015 | — (A-18) 0.025 | — (A-18) 0.01 | — (A-18) 0.015 | — — |
| 305 (Present invention) | — (A-18) 0.015 | — (A-18) 0.025 | — (A-18) 0.01 | — (A-18) 0.015 | (D-15) 0.042 — |
| 306 (Present invention) | (D-36) 0.02 (A-18) 0.015 | (D-36) 0.015 (A-18) 0.025 | (D-5) 0.025 (A-18) 0.01 | (D-5) 0.018 (A-18) 0.015 | (D-5) 0.042 — |
| 307 (Present invention) | (D-36) 0.02 (A-50) 0.029 | (D-36) 0.015 (A-50) 0.048 | (D-5) 0.025 (A-50) 0.019 | (D-5) 0.018 (A-50) 0.029 | (D-5) 0.042 — |
| 308 (Present invention) | (D-36) 0.02 (B-1) 0.033 | (D-36) 0.015 (B-1) 0.055 | (D-5) 0.025 (B-1) 0.022 | (D-5) 0.018 (B-1) 0.033 | (D-5) 0.042 — |
| 309 (Present invention) | (D-9) 0.015 (A-18) 0.015 | (D-9) 0.015 (A-18) 0.025 | (D-5) 0.025 (A-18) 0.01 | (D-5) 0.018 (A-18) 0.015 | (D-5) 0.042 — |
| 310 (Present | (D-20) 0.013 (A-18) 0.015 | (D-20) 0.013 (A-18) 0.025 | (D-5) 0.025 (A-18) 0.01 | (D-5) 0.018 (A-18) 0.015 | (D-5) 0.042 — |
| 311 (Present invention | (D-36) 0.02 (A-18) 0.015 | (D-36) 0.015 (A-18) 0.025 | (D-31) 0.022 (A-18) 0.01 | (D-31) 0.015 (A-18) 0.015 | (D-5) 0.042 — |
| 312 (Comparative example) | (Ex-1) 0.02 — | (Ex-1) 0.015 — | (Ex-1) 0.022 — | (Ex-1) 0.015 — | — |
| 313 (Present invention) | (Ex-1) 0.02 (A-18) 0.015 | (Ex-1) 0.015 (A-18) 0.025 | (Ex-1) 0.022 (A-18) 0.01 | (Ex-1) 0.015 (A-18) 0.015 | — |

Note:
(Ex-1) is the compound 2-(1-phenyl-5-tetrazolylthio)-4-(2,4-di-tert-amylphenoxyacetamido)-1-indanone used in the examples of JP-A-57-176032.

These samples were subjected to sensitometry exposure for 1/100 sec. by using a light source adjusted to have a color temperature of 4,800° K. and the color development described below. In addition, following the same procedures as in Example 1, the evaluation of latent image stability was performed by aging the individual samples, performing the following color development, and measuring the fog difference and the sensitivity difference before and after the aging through an R filter and a G filter.

Note, in this case, that the sensitivity is represented by a relative value of the reciprocal of an exposure amount at which an optical density of minimum optical density +1.2 is given on a characteristic curve. These results are summarized in Table 7.

TABLE 7

| Sample No. | Red-sensitive layer Fog difference | Red-sensitive layer Sensitivity difference | Changes due to storage of latent image Fog difference | Changes due to storage of latent image Sensitivity difference |
|---|---|---|---|---|
| 301 (Comparative example) | 0.13 | +15 | 0.14 | +20 |
| 302 (Comparative example) | 0.13 | +42 | 0.14 | +38 |
| 303 (Comparative example) | 0.11 | +55 | 0.12 | +51 |
| 304 (Comparative example) | 0.11 | +12 | 0.10 | +14 |
| 305 (Present invention) | 0.06 | +4 | 0.07 | +5 |
| 306 (Present invention) | 0.04 | +3 | 0.06 | +4 |
| 307 (Present invention) | 0.03 | +2 | 0.05 | +4 |
| 308 (Present invention) | 0.04 | +3 | 0.06 | +5 |
| 309 (Present invention) | 0.05 | +5 | 0.06 | +5 |
| 310 (Present invention) | 0.05 | +4 | 0.05 | +6 |
| 311 (Present invention) | 0.04 | +3 | 0.05 | +6 |
| 312 (Comparative example) | 0.14 | +57 | 0.14 | +55 |
| 313 (present invention) | 0.10 | +39 | 0.09 | +31 |

| Step | Processing Method Time | Temperature | Quantity of replenisher | Tank volume |
|---|---|---|---|---|
| Color development | 3 min. 15 sec. | 37.8° C. | 20 ml | 10 l |
| Bleaching | 45 sec. | 38° C. | 5 ml | 4 l |
| Bleach-fixing (1) | 45 sec. | 38° C. | — | 4 l |
| Bleach- | 45 sec. | 38° C. | 30 ml | 4 l |

-continued

| Step | Time | Processing Method Temperature | Quantity of replenisher | Tank volume |
|---|---|---|---|---|
| fixing (2) | | | | |
| Washing (1) | 20 sec. | 38° C. | — | 2 l |
| Washing (2) | 20 sec. | 38° C. | 30 ml | 2 l |
| Stabilization | 20 sec. | 38° C. | 20 ml | 2 l |
| Drying | 1 min | 55° C. | | |

The quantity of replenisher is represented by a value per meter of a 35-mm wide sample.

Each of the bleach-fixing and washing steps was performed by a counter flow piping from (2) to (1), and all of the overflow solution of a bleaching solution was introduced to the bleach-fixing (2).

Note that in the above processing, the amount of a bleach-fixing solution carried over to the washing step was 2 ml per meter of a 35-mm wide light-sensitive material.

| | Tank solution (g) | Replenisher (g) |
|---|---|---|
| (Color developing solution) | | |
| Diethylenetriamine-pentaacetate | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-[N-ethyl-N-β-hydroxylethylamino]-2-methylaniline sulfate | 4.7 | 6.2 |
| Water to make | 1.0 l | 1.0 l |
| pH | 10.00 | 10.15 |
| (Bleaching solution) | | |
| Ferric ammonium 1,3-diaminopropane-tetraacetate monohydrate | 144.0 | 206.0 |
| 1,3-diaminopropane-tetraacetate | 2.8 | 4.0 |
| Ammonium bromide | 84.0 | 120.0 |
| Ammonium nitrate | 17.5 | 25.0 |
| Ammonia water (27%) | 10.0 | 1.8 |
| Acetic acid (98%) | 51.1 | 73.0 |
| Water to make | 1.0 l | 1.0 l |
| pH | 4.3 | 3.4 |
| (Bleach-fixing solution) | | |
| Ferric ammonium ethylenediamine tetraacetate dehydrate | 50.0 | — |
| Disodium ethylene-diaminetetraacetate | 5.0 | 25.0 |
| Sodium sulfite | 12.0 | 20.0 |
| Aqueous ammonium thiosulfate solution (700 g/l) | 290.0 ml | 324.0 ml |
| Ammonia water (27%) | 6.0 ml | 15.0 ml |
| Water to make | 1.0 l | 1.0 l |
| pH | 6.8 | 8.0 |

Washing solution

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added. The pH of the solution fell within the range of 6.5 to 7.5.

| (Stabilizing solution) | Common for tank solution and replenisher (g) |
|---|---|
| Formalin (37%) | 1.2 ml |
| Surfactant ($C_{10}H_{21}$—O—$(CH_2CH_2O)_{10}$—H) | 0.4 |
| Ethylene glycol | 1.0 |
| Water to make | 1.0 l |
| pH | 5.0–7.0 |

As is apparent from Table 7, the use of a compound represented by Formula (A) or (B) of the present invention slightly decreased the sensitivity difference and the fog difference before and after the aging, but the effect was weak. However, when the samples contained the compound of the present invention which releases a diffusing development inhibitor or a precursor of a diffusing development inhibitor or the compound which cleaves after reacting with the oxidized form of a color developing agent, the cleaved compound of which in turn reacts with another molecule of the oxidized form of a color developing agent to cleave a development inhibitor, the effect of a compound represented by Formula (A) or (B) of the present invention was very strong. It was also found that when a compound, as used in JP-A-57-176032, which releases a development inhibitor with a low diffusivity was used, the effect of a compound represented by Formula (A) or (B) of the present invention was insignificant.

EXAMPLE 4

A sample 401 was made by removing the compound A-18 of the present invention used in the 4th, 7th, and 8th layers of the sample 306 of Example 3. A sample 402 was made by removing the compounds CII-3, YC-26, YM-1, and YM-9 of the present invention used in the 3rd, 4th, 7th, 8th, and 9th layers of the sample 401. These samples were processed following the same procedures as in Example 3, and the sensitivity difference after aging was measured through R, G, and B filters as a relative value of the reciprocal of an exposure amount at which an optical density of minimum optical density +1.2 was given. The results are summarized in Table 8.

TABLE 8

| Sample No. | Red-sensitive layer, sensitivity difference | Green-sensitive layer, sensitivity diference | Blue-sensitive layer, sensitivity difference |
|---|---|---|---|
| 306 | +3 | +4 | −5 |
| 401 | +52 | +50 | −32 |
| 402 | +49 | +47 | −9 |

As can be seen from Table 8, when a layer using a colored-coupler was increased in latensification and sensitivity, the sensitivity of a layer subjected to a masking effect of the colored coupler was decreased, thereby further degrading a sensitivity balance of blue, green, and red sensitivities. However, this problem could be solved by adding a compound represented by Formula (A) or (B) of the present invention.

EXAMPLE 5

Layers having the following compositions were formed on a subbed triacetylcellulose film support to make a multilayered color light-sensitive material, a sample 501.

Compositions of light-sensitive layers

The coating amount of each of a silver halide and colloidal silver is represented by a silver amount in units of g/m$^2$, and that of each of a coupler, an additive, and gelatin is represented in units of g/m$^2$. The coating amount of a sensitizing dye is represented by the number of moles per mole of a silver halide in the same layer. Note that symbols representing additives have the following meanings. Note also that an additive having a plurality of effects is represented by one of them.

UV; ultraviolet absorbent, Solv; high-boiling organic solvent, ExF; dye, ExS; sensitizing dye, ExC; cyan coupler, ExM; magenta coupler, ExY; yellow coupler, Cpd; additive.

| | |
|---|---|
| 1st layer (Antihalation layer) | |
| Black colloidal silver | 0.15 |
| Gelatin | 2.33 |
| ExM-2 | 0.11 |
| UV-1 | $3.0 \times 10^{-2}$ |
| UV-2 | $6.0 \times 10^{-2}$ |
| UV-3 | $7.0 \times 10^{-2}$ |
| Solv-1 | 0.16 |
| Solv-2 | 0.10 |
| ExF-1 | $1.0 \times 10^{-2}$ |
| ExF-2 | $4.0 \times 10^{-2}$ |
| ExF-3 | $5.0 \times 10^{-3}$ |
| Cpd-6 | $1.0 \times 10^{-3}$ |
| 2nd layer (Low-speed red-sensitive emulsion layer) | |
| Silver bromoiodide emulsion (AgI = 4.0 mole %, uniform AgI type, sphere-equivalent diameter = 0.4 μm, variation coefficient of sphere-equivalent diameter = 30%, tabular grain, diameter/thickness ratio = 3.0) | 0.35 |
| coating silver amount | |
| Silver bromoiodide emulsion (AgI = 6.0 mole %, internally high AgI type with core/shell ratio of 1:2, sphere-equivalent diameter = 0.45 μm, variation coefficient of sphere-equivalent diameter = 23%, tabular grain, diameter/thickness ratio = 2.0) | 0.18 |
| coating silver amount | |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.0 \times 10^{-2}$ |
| ExC-2 | $2.0 \times 10^{-2}$ |
| ExC-3 | $4.0 \times 10^{-2}$ |
| ExC-4 | $2.0 \times 10^{-2}$ |
| ExC-5 | $8.0 \times 10^{-2}$ |
| ExC-6 | $2.0 \times 10^{-2}$ |
| ExC-9 | $1.0 \times 10^{-2}$ |
| 3rd layer (Medium-speed red-sensitive emulsion layer) | |
| Silver bromoiodide emulsion (AgI = 6.0 mole %, internally high AgI type with core/shell ratio of 1:2, sphere-equivalent diameter = 0.65 μm, variation coefficient of sphere-equivalent diameter = 23%, tabular grain, diameter/thickness ratio = 2.0) | 0.80 |
| coating silver amount | |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $2.5 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $3.0 \times 10^{-2}$ |
| ExC-8 | $1.0 \times 10^{-2}$ |
| ExC-9 | $3.0 \times 10^{-2}$ |

-continued

| | |
|---|---|
| 4th layer (High-speed red-sensitive emulsion layer) | |
| Silver bromoiodide emulsion (AgI = 9.3 mole %, multiple structure grain with silver amount ratio of 3:4:2, AgI contents from inside 24, 0, and 6 mole %, sphere-equivalent diameter = 0.75 μm, variation coefficient of sphere-equivalent diameter = 23%, tabular grain, diameter/thickness ratio = 2.5) | 1.05 |
| coating silver amount | |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $8.0 \times 10^{-2}$ |
| ExC-4 | $9.0 \times 10^{-2}$ |
| ExC-6 | $2.0 \times 10^{-2}$ |
| ExC-9 | $1.0 \times 10^{-2}$ |
| Solv-1 | 0.20 |
| Solv-2 | 0.53 |
| 5th layer (Interlayer) | |
| Gelatin | 0.62 |
| Cpd-1 | 0.13 |
| Polyethylacrylate latex | $8.0 \times 10^{-2}$ |
| solv-1 | $8.0 \times 10^{-2}$ |
| 6th layer (Low-speed green-sensitive emulsion layer) | |
| Silver bromoiodide emulsion (AgI = 4.0 mole %, uniform AgI type, sphere-equivalent diameter 0.45 μm, variation coefficient of sphere-equivalent diameter = 15%, tabular grain, diameter/thickness ratio = 4.0) | 0.13 |
| coating silver amount | |
| Gelatin | 0.31 |
| ExS-3 | $1.0 \times 10^{-4}$ |
| ExS-4 | $3.1 \times 10^{-4}$ |
| ExS-5 | $6.4 \times 10^{-5}$ |
| ExM-1 | 0.12 |
| ExM-3 | $2.1 \times 10^{-2}$ |
| Solv-1 | 0.09 |
| Solv-4 | $7.0 \times 10^{-3}$ |
| 7th layer (Medium-speed green-sensitive emulsion layer) | |
| Silver bromoiodide emulsion (AgI = 4.0 mole %, uniform AgI type, sphere-equivalent diameter = 0.65 μm, variation coefficient of sphere-equivalent diameter = 18%, tabular grain, diameter/thickness ratio = 4.0) | 0.31 |
| coating silver amount | |
| Gelatin | 0.54 |
| ExS-3 | $2.7 \times 10^{-4}$ |
| ExS-4 | $8.2 \times 10^{-4}$ |
| ExS-5 | $1.7 \times 10^{-4}$ |
| ExM-1 | 0.27 |
| ExM-3 | $7.2 \times 10^{-2}$ |
| ExY-1 | $5.4 \times 10^{-2}$ |
| Solv-1 | 0.23 |
| Solv-4 | $1.8 \times 10^{-2}$ |
| 8th layer (High-speed green-sensitive emulsion layer) | |
| Silver bromoiodide emulsion (AgI = 8.7 mole %, multiple structure grain with silver amount ratio of 3:4:2, AgI contents from inside = 24, 0, and 3 mole %, sphere-equivalent diameter = 0.81 μm, variation coefficient of sphere-equivalent diameter = 23%, multiple twinned crystal tabular grain, diameter/thickness ratio = 2.5) | 0.49 |
| coating silver amount | |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-2 | $1.0 \times 10^{-2}$ |
| ExM-5 | $1.0 \times 10^{-2}$ |
| ExM-6 | $3.0 \times 10^{-2}$ |
| ExY-1 | $1.5 \times 10^{-2}$ |
| ExC-1 | $0.4 \times 10^{-2}$ |
| ExC-4 | $2.5 \times 10^{-3}$ |
| ExC-6 | $0.5 \times 10^{-2}$ |
| Solv-1 | 0.12 |
| Cpd-8 | $1.0 \times 10^{-2}$ |
| 9th layer (Interlayer) | |
| Gelatin | 0.56 |
| Cpd-1 | $4.0 \times 10^{-2}$ |

-continued

| | |
|---|---|
| Polyethylacrylate latex | $5.0 \times 10^{-2}$ |
| Solv-1 | $3.0 \times 10^{-2}$ |
| UV-4 | $3.0 \times 10^{-2}$ |
| UV-5 | $4.0 \times 10^{-2}$ |
| 10th layer (Donor layer having interlayer effect on red-sensitive layer) | |
| Silver bromoiodide emulsion (AgI = 8.0 mole %, internally high AgI type grain with core/shell ratio of 1:2, sphere-equivalent diameter = 0.72 μm, variation coefficient of sphere-equivalent diameter = 28%, multiple twinned crystal tabular grain, diameter/thickness ratio = 2.0) | 0.67 |
| coating silver amount | |
| Silver bromoiodide emulsion (AgI = 10.0 mole %, internally high AgI type grain with core/shell ratio of 1:3, sphere-equivalent diameter = 0.40 μm, variation coefficient of sphere-equivalent diameter = 15%, regular crystal grain) | 0.20 |
| coating silver amount | |
| Gelatin | 0.87 |
| ExS-3 | $6.7 \times 10^{-4}$ |
| ExM-8 | 0.18 |
| Solv-1 | 0.30 |
| Solv-6 | $3.0 \times 10^{-2}$ |
| 11th layer (Yellow filter layer) | |
| Yellow colloidal silver | $9.0 \times 10^{-2}$ |
| Gelatin | 0.84 |
| Cpd-2 | 0.13 |
| solv-1 | 0.13 |
| Cpd-1 | $5.0 \times 10^{-2}$ |
| Cpd-6 | $2.0 \times 10^{-3}$ |
| H-1 | 0.25 |
| 12th layer (Low-speed blue-sensitive emulsion layer) | |
| Silver bromoiodide emulsion (AgI = 9.0 mole %, multiple structure grain, sphere-equivalent diameter = 0.70 μm, variation coefficient of sphere-equivalent diameter = 20%, tabular grain, diameter/thickness ratio = 7.0, grains found to have 10 or more dislocation lines when observed by 200-kV transmission electron microscope occupy 50% or more of all grains) | 0.50 |
| coating silver amount | |
| Silver bromoiodide emulsion (AgI = 2.5 mole %, uniform AgI type, sphere-equivalent diameter 0.50 μm, variation coefficient of sphere-equivalent diameter = 30%, tabular grain, diameter/thickness ratio = 6.0) | 0.30 |
| coating silver amount | |
| Gelatin | 2.18 |
| ExS-6 | $9.0 \times 10^{-4}$ |
| ExC-1 | 0.03 |
| ExC-2 | 0.08 |
| ExY-2 | 0.05 |
| ExY-5 | 1.09 |
| Solv-1 | 0.54 |

-continued

| | |
|---|---|
| 13th layer (Interlayer) | |
| Gelatin | 0.30 |
| ExY-4 | 0.14 |
| Solv-1 | 0.14 |
| 14th layer (High-speed blue-sensitive emulsion layer) | |
| Silver bromoiodide emulsion (AgI = 10.0 mole %, internally high AgI type grain, sphere-equivalent diameter = 1.2 μm, variation coefficient of sphere-equivalent diameter = 25%, multiple twinned crystal tabular grain, diameter/thickness ratio 2.0) | 0.40 |
| coating silver amount | |
| Gelatin | 0.59 |
| ExS-6 | $2.6 \times 10^{-4}$ |
| ExY-5 | 0.20 |
| ExC-1 | $1.0 \times 10^{-2}$ |
| Solv-1 | $9.0 \times 10^{-2}$ |
| 15th layer (1st protective layer) | |
| Fine grain silver bromoiodide emulsion (AgI = 2.0 mole %, uniform AgI type, sphere-equivalent diameter = 0.07 μm) | 0.12 |
| coating silver amount | |
| Gelatin | 0.63 |
| UV-4 | 0.11 |
| UV-5 | 0.18 |
| Solv-5 | $2.0 \times 10^{-2}$ |
| solv-1 | 0.10 |
| Polyethylacrylate latex | $9.0 \times 10^{-2}$ |
| 16th layer (2nd protective layer) | |
| Fine grain silver bromoiodide emulsion (AgI = 2.0 mole %, uniform AgI type, sphere-equivalent diameter = 0.07 μm) | 0.36 |
| coating silver amount | |
| Gelatin | 0.85 |
| B-1 (diameter 2.0 fm) | $8.0 \times 10^{-2}$ |
| B-2 (diameter 2.0 fm) | $8.0 \times 10^{-2}$ |
| B-3 | $2.0 \times 10^{-2}$ |
| W-4 | $2.0 \times 10^{-2}$ |
| H-1 | 0.18 |

In addition to the above components, the sample thus manufactured was added with 1,2-benzisothiazoline-3-one (200 ppm on average with respect to gelatin), n-butyl-p-hydroxybenzoate (about 1,000 ppm on average with respect to gelatin), and 2-phenoxyethanol (about 10,000 ppm on average with respect to gelatin). The sample also contained B-4, B-5, B-6, F-1, F-2, F-3, F-4, F-5, F-6, F-7, F-8, F-9, F-10, F-11, F-12, iron salt, lead salt, gold salt, platinum salt, iridium salt, and rhodium salt.

Each layer was added with surfactants W-1, W-2, and W-3 as coating aids or emulsion dispersants in addition to the above components.

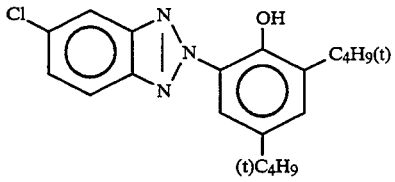

UV-1

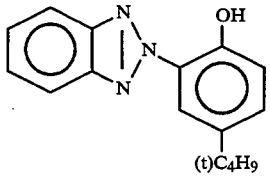

UV-2

-continued
UV-3
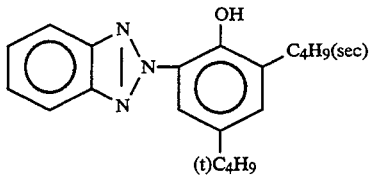
UV-4
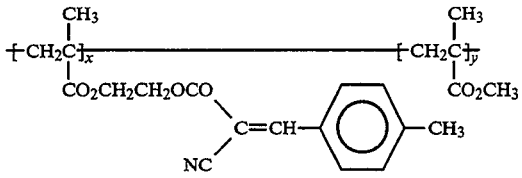
x:y = 70:30 (wt %)
UV-5
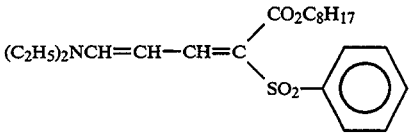
Solv-1
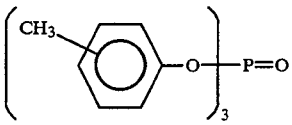
Solv-2
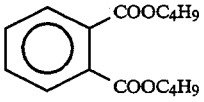
Solv-4
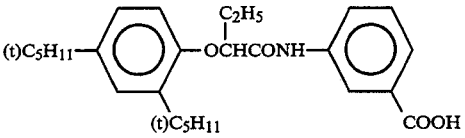
Solv-5
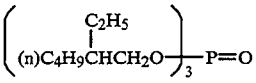
Solv-6
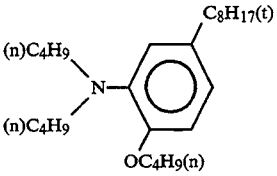
ExF-1
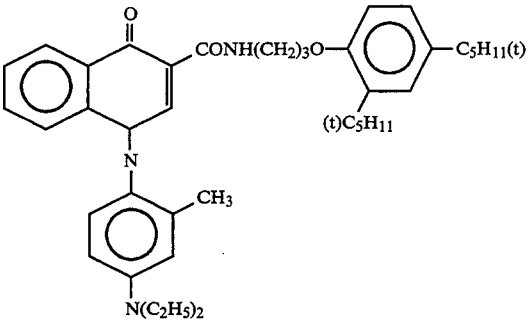

-continued
ExF-2
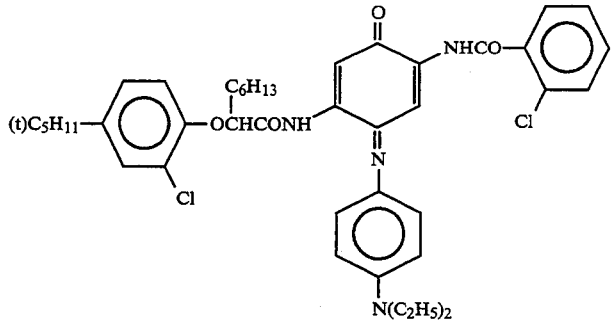
ExF-3
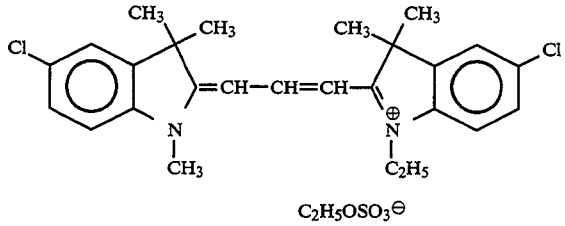
ExC-1
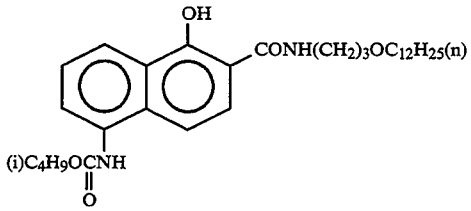
ExC-2
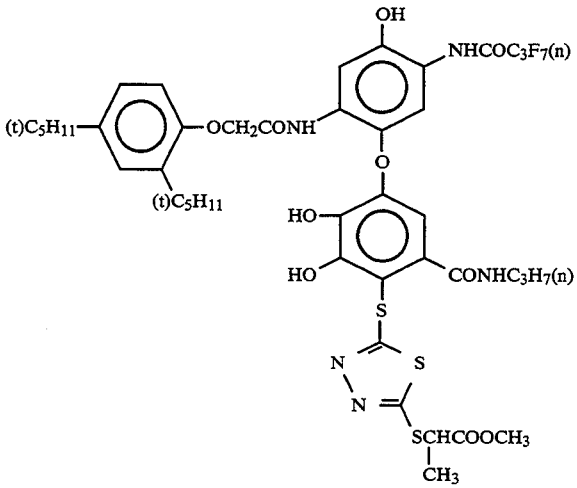
ExC-3
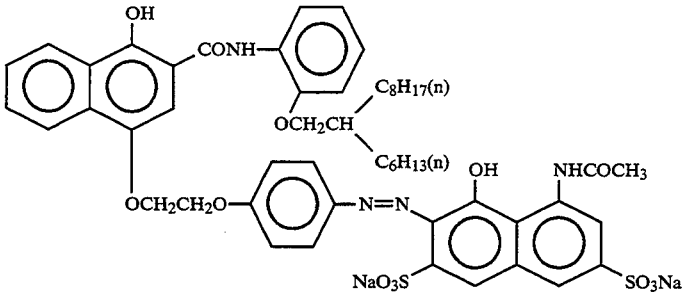

-continued
ExC-4
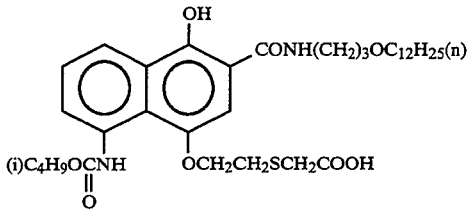
ExC-5
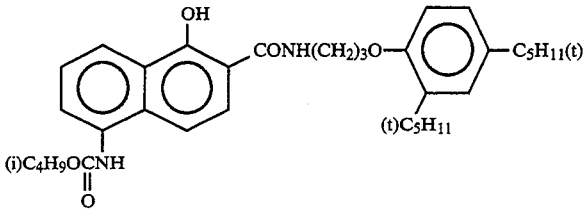
ExC-6
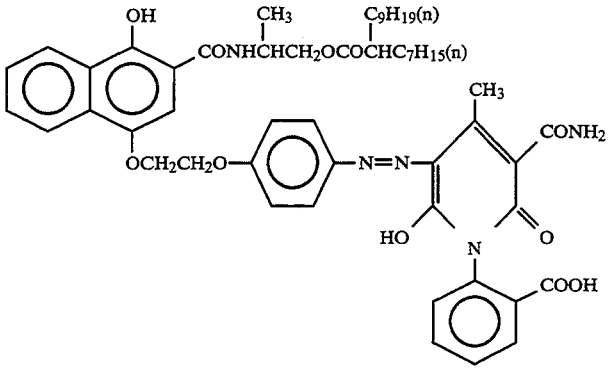
ExC-7
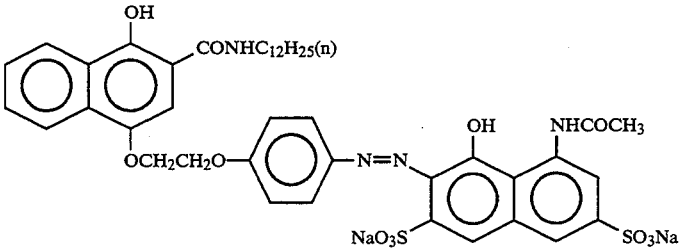
ExC-8
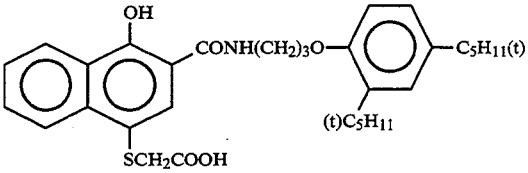

-continued
ExC-9
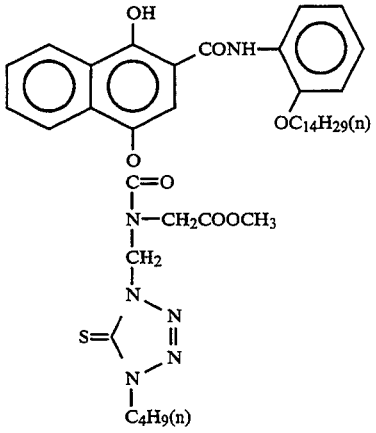
ExM-1
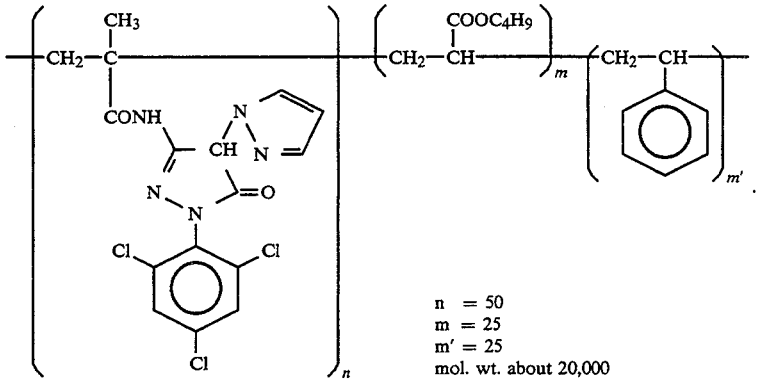
n = 50
m = 25
m' = 25
mol. wt. about 20,000
ExM-2
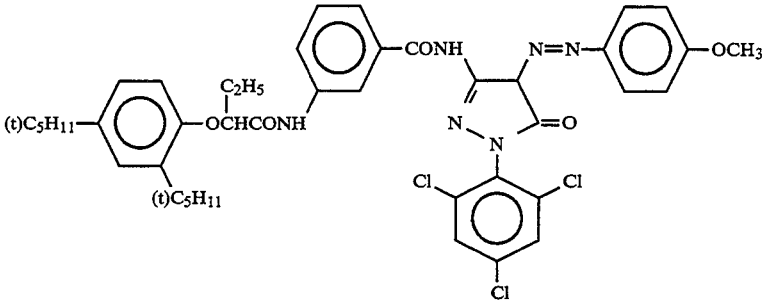
ExM-3
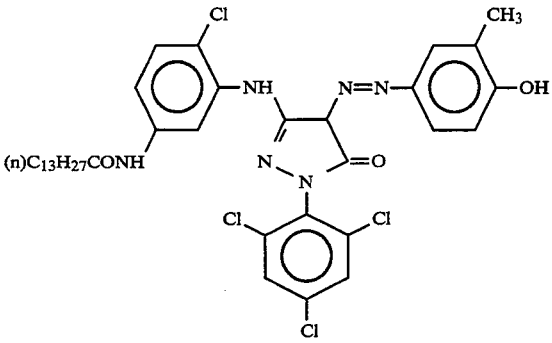

-continued
ExM-5
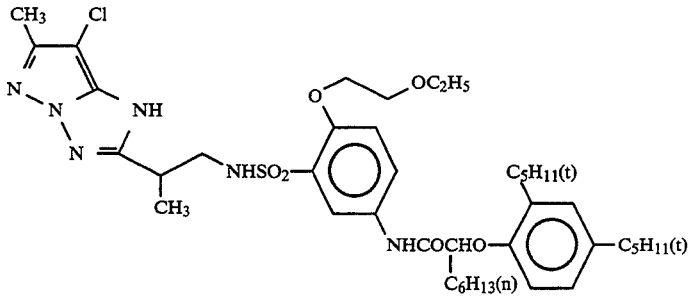
FxM-6
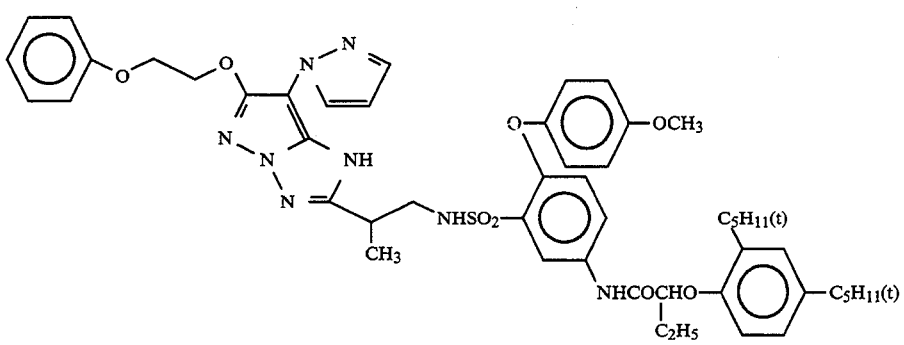
ExM-8
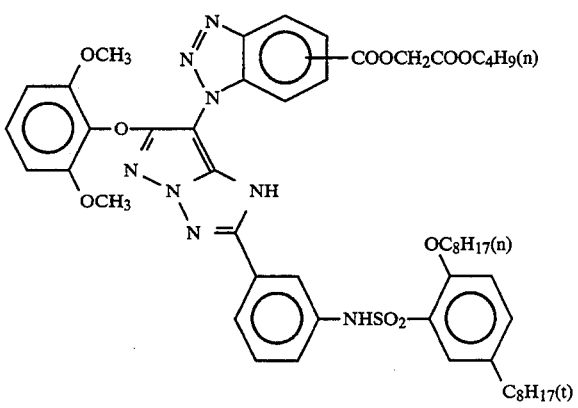
ExY-1
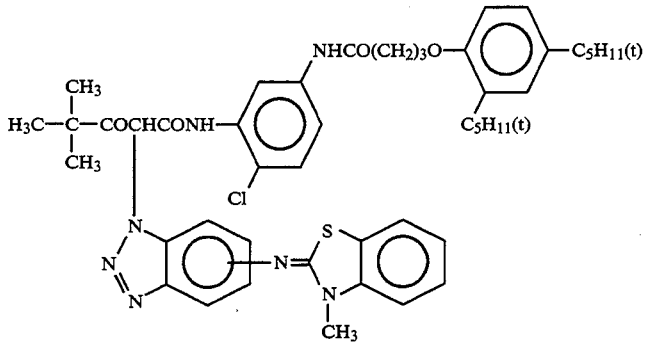
ExY-2
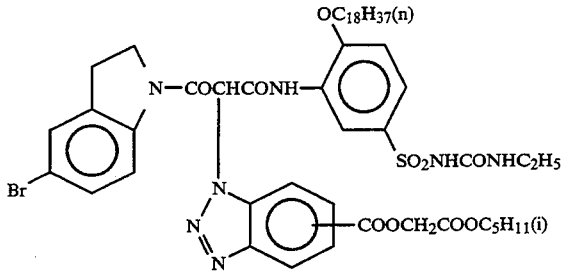

-continued
ExY-1
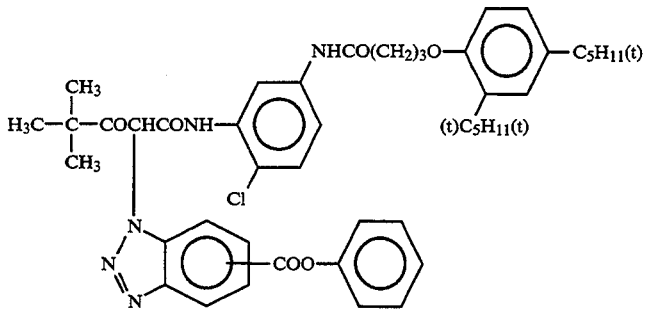
ExY-2
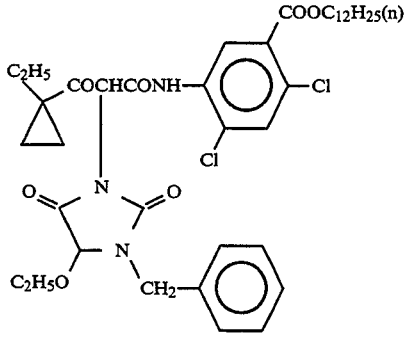
Cpd-1
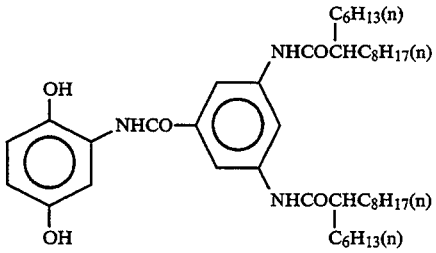
Cpd-2
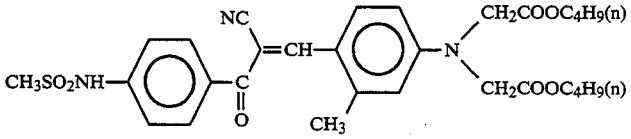
Cpd-5
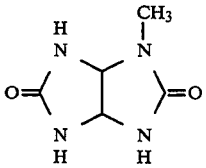
Cpd-6
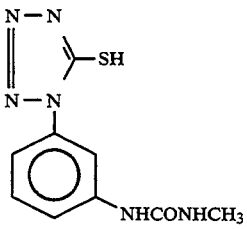
Cpd-8
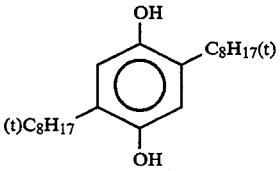

-continued
$CH_2{=}CH{-}SO_2{-}CH_2{-}CONH{-}CH_2$
$CH_2{=}CH{-}SO_2{-}CH_2{-}CONH{-}CH_2$ H-1
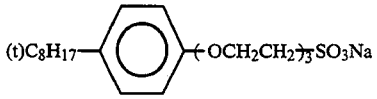
W-1
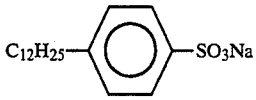
W-2
$(n)C_4H_9CH(C_2H_5)CH_2COOCH_2$
$(n)C_4H_9CH(C_2H_5)CH_2COOCH_2SO_3Na$ W-3
$C_8F_{17}SO_2N(C_3H_7)CH_2COOK$ W-4
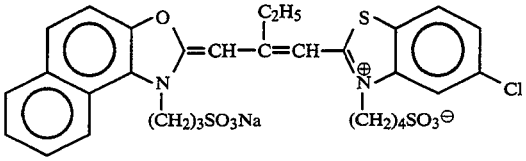
ExS-1
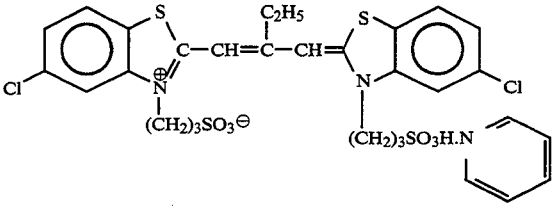
ExS-2
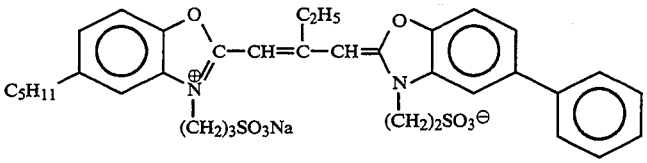
ExS-3
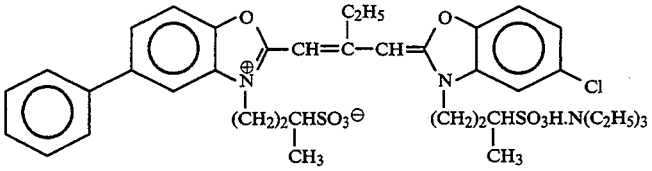
ExS-4
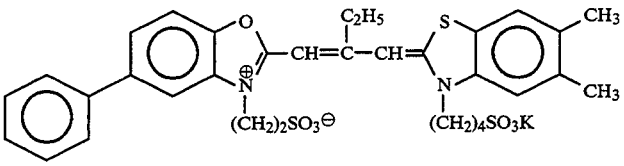
ExS-5
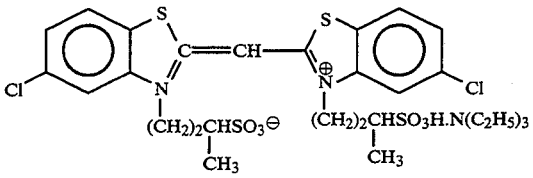
ExS-6

-continued
ExS-7
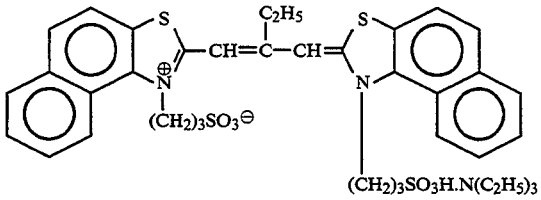
ExS-8
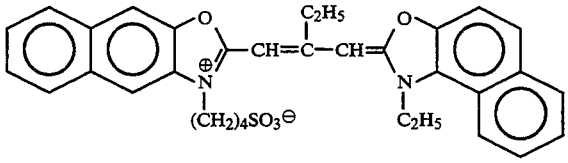
F-1
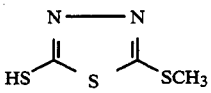
F-2
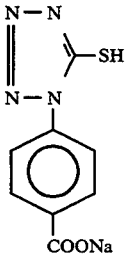
F-3
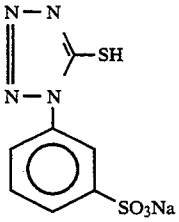
F-4
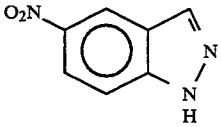
F-5
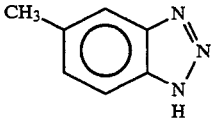
F-6
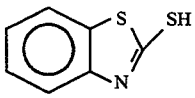
F-7
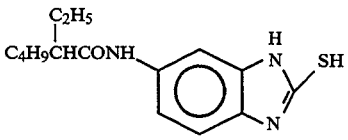
F-8
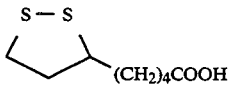

-continued
F-9
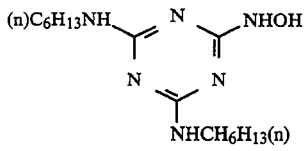
F-10
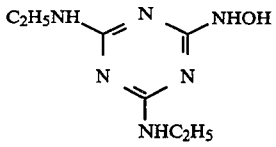
F-11
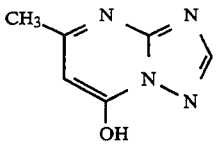
F-12
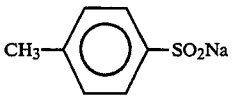
B-1
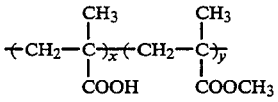
x/y = 10/90
B-2
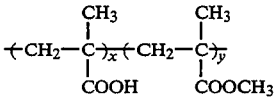
x/y = 40/60
B-3
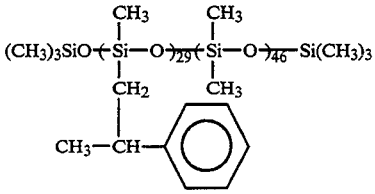
B-4
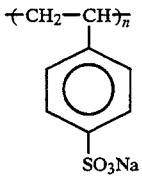
B-5
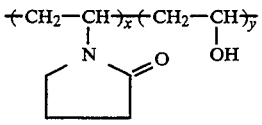
x/y = 70/30
B-6
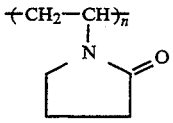
(mol. wt. about 10,000)
Following the same procedures as in Example 2, the compounds A-18, A-50, and B-1 of the present invention were added to the 2nd, 3rd, 4th, and 10th layers of the sample 501. Consequently, the same effects as in Example 2 were also confirmed in this combination.
What is claimed is:

1. A silver halide color photographic light-sensitive material having at least one negative silver halide emulsion layer on a support, wherein said silver halide color photographic light-sensitive material contains at least one compound which reacts with the oxidized form of a developing agent to release a development inhibitor or a precursor of a development inhibitor and/or at least one compound which cleaves after reacting with the oxidized form of a color developing agent, the cleaved compound of which in turn reacts with another molecule of the oxidized form of a color developing agent to cleave a development inhibitor, and contains at least one compound selected from compounds represented by Formulae (A) and (B) below:

Formula (A)

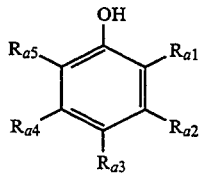

in Formula (A), $R_{a1}$ to $R_{a5}$ may be the same or different and each represents a hydrogen atom, a group of alkyl, alkenyl, aryl, alkyloxycarbonyl, aryloxycarbonyl, acyl, sulfonyl, carbamoyl, sulfamoyl, acylamino or sulfonamido, a halogen atom, or —X—$R_{a0}$ wherein —X— represents —O—, —S—, or —N($R_{a6}$)—, $R_{a0}$ represents a group of alkyl, alkenyl or aryl, and $R_{a6}$ represents a hydrogen atom or the group defined for $R_{a0}$, substituents at the ortho positions with each other of the groups represented by $R_{a1}$ to $R_{a5}$ can combine to form a 5- to 7-membered ring, the groups represented by $R_{a1}$ to $R_{a5}$ are not simultaneously hydrogen atoms, and at least one of $R_{a1}$ and $R_{a5}$ is an alkyl group;

Formula (B)

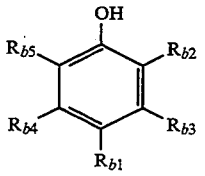

Formula (B), $R_{b1}$ represents a hydrogen atom, a group of alkyl, alkenyl, aryl, heterocyclic ring, alkyloxycarbonyl, aryloxycarbonyl, acyl, sulfonyl, carbamoyl, sulfamoyl or acylamino, a halogen atom, or —X—$R_{b0}$ wherein —X— represents —O—, —S—, or —N($R_{b6}$)—, $R_{b0}$ represents a group of alkyl, alkenyl, aryl or heterocyclic ring, $R_{b6}$ represents a hydrogen atom or the group defined for $R_{b0}$, and $R_{b2}$ to $R_{b5}$ may be the same or different and each represents a hydroxyl group or the group defined for $R_{b1}$, substituents at the ortho positions with each other of the groups represented by $R_{b1}$ to $R_{b5}$ can combine to form a 5- to 7-membered ring, and one or two of $R_{b2}$, $R_{b3}$, $R_{b4}$ and $R_{b5}$ are hydroxyl groups except that only one of $R_{b2}$ and $R_{b5}$ can represent a hydroxyl group, wherein said compound selected from compounds represented by Formulae (A) and (B) imparts to the light-sensitive material upon exposure and color development a sensitivity reduction of 0.05 log E or less.

2. The silver halide color photographic light-sensitive material according to claim 1, containing $1\times10^{-5}$ mol/m$^2$ or more of said compound which reacts with the oxidized form of a developing agent to release a development inhibitor or a precursor of a development inhibitor and/or said compound which cleaves after reacting with the oxidized form of a color developing agent, the cleaved compound of which in turn reacts with another molecule of the oxidized form of a color developing agent to cleave a development inhibitor.

3. The silver halide color photographic light-sensitive material according to claim 1, wherein an interlayer effect on at least one color-sensitive layer present in said light-sensitive material is 1.3 or more.

4. The silver halide color photographic light-sensitive material according to claim 1, wherein at least one of said negative silver halide emulsion layers comprises a silver halide emulsion containing a spectral sensitizing dye in an amount of at least $5\times10^{-4}$ mol per mol of silver halide.

5. The silver halide color photographic light-sensitive material according to claim 1, wherein an aspect ratio of silver halide grains occupying 60% or more of a total projected area of all silver halide grains contained in at least one negative silver halide emulsion layer is 3 or more.

6. The silver halide color photographic light-sensitive material according to claim 1, wherein an average aspect ratio of silver halide grains of all silver halide grains contained in at least one negative silver halide emulsion layer is 3 or more and less than 20.

7. The silver halide color photographic light-sensitive material according to claim 1, containing $1\times10^{-4}$ mol/m$^2$ or more of said compound which reacts with the oxidized form of a developing agent to release a development inhibitor or a precursor of a development inhibitor and/or said compound which cleaves after reacting with the oxidized form of a color developing agent, the cleaved compound of which in turn reacts with another molecule of the oxidized form of a color developing agent to cleave a development inhibitor.

8. The silver halide color photographic light-sensitive material according to claim 4, wherein said spectral sensitizing dye is represented by Formula (1):

Formula (1)

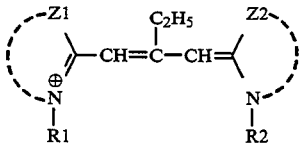

$(X1^-)_{n-1}$ wherein $R_1$ and $R_2$ represent alkyl, $X_1^-$ represents an anion, Z1 and Z2 each represent an atom group required to form a thiazole ring, a benzothiazole ring, a naphthothiazole ring, an oxazole ring, a benzoxazole ring, or a naphthoxazole ring, and "n−1" represents an integer of 0 or 1.

9. The silver halide color photographic light-sensitive material according to claim 1, wherein silver halide grains contained in at least one negative silver halide emulsion layer are subjected to reduction sensitization.

10. The silver halide color photographic light-sensitive material according to claim 9, wherein the reduction sensitization is carried out during growth of the grains, and the grain surface is treated with an oxidizing agent against silver.

11. The silver halide color photographic light-sensitive material according to claim 8, wherein "n−1" is 0.

12. A silver halide color photographic light-sensitive material having at least one negative silver halide emulsion layer containing at least one yellow-colored magenta coupler and at least one magenta-colored cyan coupler on a support, wherein said silver halide color photographic light-sensitive material contains at least one compound which reacts with the oxidized form of a developing agent to release a development inhibitor or a precursor of a development inhibitor and/or at least one compound which cleaves after reacting with the oxidized form of a color developing agent, the cleaved compound of which in turn reacts with another molecule of the oxidized form of a color developing agent to cleave a development inhibitor, and contains at least one compound selected from compounds represented by Formulae (A) and (B) below:

Formula (A)

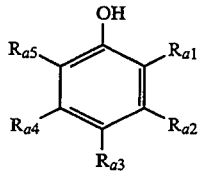

in Formula (A), $R_{a1}$ to $R_{a5}$ may be the same or different and each represents a hydrogen atom, a group of alkyl, alkenyl, aryl, alkyloxycarbonyl, aryloxycarbonyl, acyl, sulfonyl, carbamoyl, sulfamoyl, acylamino or sulfonamido, a halogen atom, or —X—$R_{a0}$ wherein —X— represents —O—, —S—, or —N($R_{a6}$)—, $R_{a0}$ represents a group of alkyl, alkenyl or aryl, and $R_{a6}$ represents a hydrogen atom or the group defined for $R_{a0}$, substituents at the ortho positions with each other of the groups represented by $R_{a1}$ to $R_{a5}$ can combine to form a 5- to 7-membered ring, the groups represented by $R_{a1}$ to $R_{a5}$ are not simultaneously hydrogen atoms, and at least one of $R_{a1}$ and $R_{a5}$ is an alkyl group;

Formula (B)

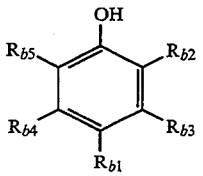

in Formula (B), $R_{b1}$ represents a hydrogen atom, a group of alkyl, alkenyl, aryl, heterocyclic ring, alkyloxycarbonyl, aryloxycarbonyl, acyl, sulfonyl, carbamoyl, sulfamoyl or acylamino, a halogen atom, or —X—$R_{b0}$ wherein —X— represents —O—, —S—, or —N($R_{b6}$)—, $R_{b0}$ represents a group of alkyl, alkenyl, aryl or heterocyclic ring, $R_{b6}$ represents a hydrogen atom or the group defined for $R_{b0}$, and $R_{b2}$ to $R_{b5}$ may be the same or different and each represents a hydroxyl group or the group defined for $R_{b1}$, substituents at the ortho positions with each other of the groups represented by $R_{b1}$ to $R_{b5}$ can combine to form a 5- to 7-membered ring, and one or two of $R_{b2}$, $R_{b3}$, $R_{b4}$ and $R_{b5}$ are hydroxyl groups except that only one of $R_{b2}$ and $R_{b5}$ can represent a hydroxyl group, wherein said compound selected from compounds represented by Formulae (A) and (B) imparts to the light-sensitive material upon exposure and color development a sensitivity reduction of 0.05 log E or less.

13. A silver halide color photographic light-sensitive material having at least one negative silver halide emulsion layer containing at least one yellow-colored cyan coupler on a support, wherein said silver halide color photographic light-sensitive material contains at least one compound which reacts with the oxidized form of a developing agent to release a development inhibitor or a precursor of a development inhibitor and/or at least one compound which cleaves after reacting with the oxidized form of a color developing agent, the cleaved compound of which in turn reacts with another molecule of the oxidized form of a color developing agent to cleave a development inhibitor, and contains at least one compound selected from compounds represented by Formulae (A) and (B) below:

Formula (A)

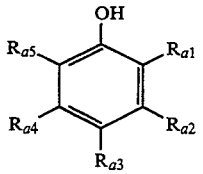

in Formula (A), $R_{a1}$ to $R_{a5}$ may be the same or different and each represents a hydrogen atom, a group of alkyl, alkenyl, aryl, alkyloxycarbonyl, aryloxycarbonyl, acyl, sulfonyl, carbamoyl, sulfamoyl, acylamino or sulfonamido, a halogen atom, or —X—$R_{a0}$ wherein —X— represents —O—, —S—, or —N($R_{a6}$)—, $R_{a0}$ represents a group of alkyl, alkenyl or aryl, and $R_{a6}$ represents a hydrogen atom or the group defined for $R_{a0}$, substituents at the ortho positions with each other of the groups represented by $R_{a1}$ to $R_{a5}$ can combine to form a 5- to 7-membered ring, the groups represented by $R_{a1}$ to $R_{a5}$ are not simultaneously hydrogen atoms, and at least one of $R_{a1}$ and $R_{a5}$ is an alkyl group;

Formula (B)

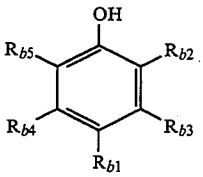

in Formula (B), $R_{b1}$ represents a hydrogen atom, a group of alkyl, alkenyl, aryl, heterocyclic ring, alkyloxycarbonyl, aryloxycarbonyl, acyl, sulfonyl, carbamoyl, sulfamoyl or acylamino, a halogen atom, or —X—$R_{b0}$ wherein —X— represents —O—, —S—, or —N($R_{b6}$)—, $R_{b0}$ represents a group of alkyl, alkenyl, aryl or heterocyclic ring, $R_{b6}$ represents a hydrogen atom or the group defined for $R_{b0}$, and $R_{b2}$ to $R_{b5}$ may be the same or different and each represents a hydroxyl group or the group defined for $R_{b1}$, substituents at the ortho positions with each other of the groups represented by $R_{b1}$ to $R_{b5}$ can combine to form a 5- to 7-membered ring, and one or two of $R_{b2}$, $R_{b3}$, $R_{b4}$ and $R_{b5}$ are hydroxyl groups except that only one of $R_{b2}$ and $R_{b5}$ can represent a hydroxyl group, wherein said compound selected from compounds represented by Formulae (A) and (B) imparts to the light-sensitive material upon exposure and color development a sensitivity reduction of 0.05 log E or less.

* * * * *